US008911057B2

(12) United States Patent
Yoshida

(10) Patent No.: US 8,911,057 B2
(45) Date of Patent: Dec. 16, 2014

(54) PRINTING APPARATUS AND NOZZLE TESTING METHOD

(71) Applicant: Seiko Epson Corporation, Tokyo (JP)

(72) Inventor: Masahiko Yoshida, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/199,006

(22) Filed: Mar. 6, 2014

(65) Prior Publication Data

US 2014/0267480 A1 Sep. 18, 2014

(30) Foreign Application Priority Data

Mar. 14, 2013 (JP) ..... 2013-051377

(51) Int. Cl.
*B41J 29/393* (2006.01)
*B41J 2/12* (2006.01)

(52) U.S. Cl.
CPC ..... *B41J 2/12* (2013.01)
USPC ..... 347/19

(58) Field of Classification Search
None
See application file for complete search history.

(56) References Cited

U.S. PATENT DOCUMENTS

| | | | | |
|---|---|---|---|---|
| 7,410,240 | B2 * | 8/2008 | Kadomatsu et al. | 347/44 |
| 7,429,093 | B2 | 9/2008 | Shinkawa | |
| 8,444,247 | B2 * | 5/2013 | Shinkawa | 347/19 |
| 8,727,489 | B2 * | 5/2014 | Hosono et al. | 347/35 |

FOREIGN PATENT DOCUMENTS

JP 4114638 B2 7/2008

* cited by examiner

*Primary Examiner* — Lamson Nguyen
(74) *Attorney, Agent, or Firm* — Global IP Counselors, LLP

(57) ABSTRACT

A printing apparatus includes a head unit and a control section. The head unit includes nozzles, pressure chambers, and piezoelectric elements. The control section is configured to determine whether or not there is a liquid discharge failure in the nozzles corresponding to the piezoelectric elements based on a detection signal obtained by applying a testing waveform included in a driving signal to the piezoelectric elements. The control section is further configured to detect residual vibration using a first testing waveform in a first print mode performed at a first print speed, and to detect residual vibration using a second testing waveform in a second print mode performed at a second print speed with the first print speed being slower than the second print speed, a period of time for testing with the first testing waveform being longer than a period of time for testing with the second testing waveform.

6 Claims, 50 Drawing Sheets

BEFORE PAPER DUST ATTACHMENT

AFTER PAPER DUST ATTACHMENT

Fig. 37A
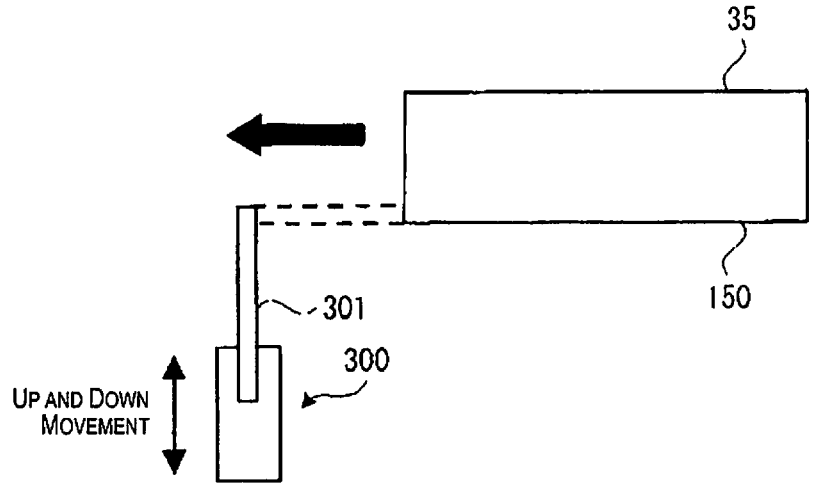
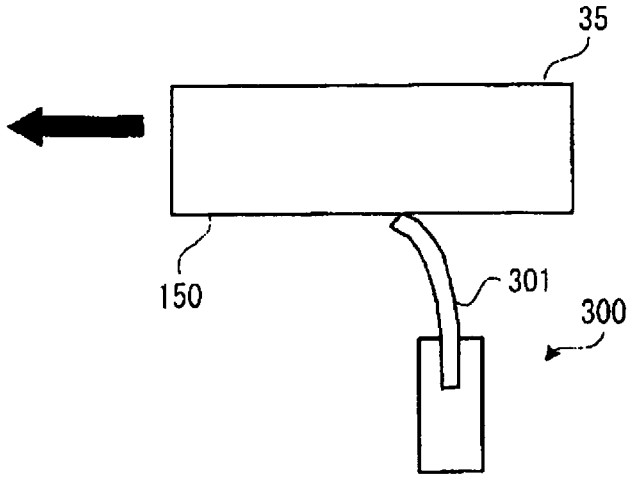
Fig. 37B

| Printing Mode | Waveform | Discharge Amount For Each Partition (Discharge Amount For Each Partition (ng) | Maximum Ink Discharge Amount (ng) | Maximum Frequency Which Is Able To Be Set (1/s) | Printing Speed | Main Scanning Speed | Resolution | Advantages | | Disadvantage | |
|---|---|---|---|---|---|---|---|---|---|---|---|
| Maximum Image Quality | (A) | 12+8+0 | 20 | 10 | Slow | Slow | Low | • It Is Possible To Detect Discharging Abnormalities Without Discharging Ink<br>• It Is Possible To Obtain More Detailed Nozzle Information Since It Is Possible To Set The Period Where It Is Possible To Detect The Residual Vibration To Be Long | • It Is Possible To Obtain Particularly Detailed Nozzle Information Since It Is Possible To Set The Period Where It Is Possible To Detect The Residual Vibration To Be Particularly Long<br>• It Is Possible To Reduce The Residual Vibration Since The Voltage During Abnormality Detecting Is Low<br>• It Is Difficult For Residual Vibration To Have An Effect Since The Resolution Is Low | • There Is A Danger That Erroneous Detections Will Be Generated Without The Detection Signal Being Correctly Output Since The Driving Amount Of The Pzt Element During Abnormality Detection Is Small | •It Is Not Possible To Perform High-Speed Driving Since The Driving Frequency Is Small |
| High-Speed High-Quality | (B) | 12+8+0 | 20 | 14.8 | Fast | Fast | High | | The Resolution Is High | | |
| Normal | (C) | 12+8+12 | 32 | 9.8 | Slow | Slow | Low | • Printing And Abnormality Detecting Are Possible At High Speed<br>• It Is Possible To Detect The Residual Vibration While Printing | • It Is Possible To Obtain More Detailed Nozzle Information Since It Is Possible To Set The Period Where It Is Possible To Detect The Residual Vibration To Be Long<br>• It Is Difficult For Residual Vibration To Have An Effect Since The Resolution Is Low | • Abnormality Detecting Is Not Possible When Ink Is Not Discharged<br>• Since Ink Discharging And Abnormality Detecting Are Performed At The Same Time, The Discharge Stability At That Time Is Poor | • There Is A Danger That Erroneous Detections Will Be Generated Without The Detection Signal Being Correctly Output Since There Are Cases Where The Driving Amount Of The Piezo Elements During Detecting Is Not Sufficient |
| High Speed Draft | (D) | 12+8+8 | 28 | 10.2 | Fast | Fast | High | | • The Effect Of The Residual Vibration After Detecting Is Low Since The Voltage During Detecting Is Low<br>• The Resolution Is High | | |

Fig. 50

PRINTING APPARATUS AND NOZZLE TESTING METHOD

CROSS-REFERENCE TO RELATED APPLICATIONS

This application claims priority to Japanese Patent Application No. 2013-051377 filed on Mar. 14, 2013. The entire disclosure of Japanese Patent Application No. 2013-051377 is hereby incorporated herein by reference.

BACKGROUND

1. Technical Field

The present invention relates to the testing of nozzles.

2. Related Art

Ink jet printers perform printing by discharging ink inside cavities. The ink thickens when drying. When the ink inside the cavities thickens, discharging failure may be caused. Therefore, it is preferable to test whether the ink has thickened. As such a test, a method is known where vibration is applied to the ink inside the cavities to determine the degree of viscosity based on the behavior of the ink with regard to the vibration. This vibration is known as residual vibration. The method is superior in terms of being able to be carried out without interrupting printing (for example, Japanese Patent No. 4114638).

SUMMARY

A problem which exists in the prior art described above is that there are cases where it is not possible to appropriately execute the nozzle testing depending on the print mode. In addition, improvements in size reduction or cost reduction, resource saving, ease of manufacturing, and ease of use or the like of the apparatus are desirable.

The present invention solves at least a portion of the problems described above and is able to be realized as the following aspects.

(1) According to one aspect of the present invention, there is provided a printing apparatus including a head unit and a control section. The head unit includes a plurality of nozzles configured and arranged to discharge a liquid, a plurality of pressure chambers linked with the nozzles, and a plurality of piezoelectric elements respectively provided in each of the pressure chambers. The head unit is configured and arranged to discharge the liquid from the nozzles by applying a driving signal to the piezoelectric elements. The control section is configured to determine whether or not there is a liquid discharge failure in the nozzles corresponding to the piezoelectric elements based on a detection signal obtained by applying a testing waveform included in the driving signal to the piezoelectric elements. The control section is further configured to detect residual vibration using a first testing waveform in a first print mode performed at a first print speed, and to detect residual vibration using a second testing waveform in a second print mode performed at a second print speed with the first print speed being slower than the second print speed, a period of time for testing with the first testing waveform being longer than a period of time for testing with the second testing waveform. According to this aspect, appropriate testing is possible according to the print mode. This is because the period of time (referred to below as the "duration") for testing with the testing waveform is longer in a case where the print speed is slow, and the duration is shorter in a case where the print speed is fast.

(2) In the aspect described above, the cycle of a timing signal which defines a discharge timing in the first print mode is longer than the cycle of a timing signal which defines a discharge timing in the second print mode. According to this aspect, appropriate testing is possible according to the print mode. This is because the duration is longer in a case where the cycle of a timing signal is longer and the duration is shorter in a case where the cycle of a timing signal is shorter.

(3) In the aspect described above, an absolute value of a difference between an intermediate potential and the maximum or minimum potential of the first testing waveform is larger than an absolute value of a difference between an intermediate potential and the maximum or minimum potential of the second testing waveform. According to this aspect, it is possible to achieve a balance between testing precision and attenuation of the residual vibration. The amplitude of the residual vibration is preferably large for the testing. On the other hand, when the amplitude of the residual vibration is large, it takes time for the residual vibration to attenuate. Therefore, it is possible to realize the effects described above by increasing the absolute value described above in a case where the print speed is slow and decreasing the absolute value described above in a case where the print speed is fast as in this aspect.

(4) In the aspect described above, the movement speed of the head in the first print mode is slower than the movement speed of the head in the second print mode. According to this aspect, appropriate testing is possible according to the print mode. This is because the duration is longer in a case where the movement speed of the head is slow, and the duration is shorter in a case where the print speed is fast.

(5) In the aspect described above, resolution in the first print mode is lower than resolution in the second print mode. According to this aspect, it is possible to appropriately set the duration according to the resolution. Typically, the liquid droplets are large in a case where the resolution is low compared to a case where the resolution is high. It is often the case that large liquid droplets are not easily affected by disturbances compared to small liquid droplets. As such, the droplets are not easily affected in a case where the resolution is low even when residual vibration remains in the next cycle. Therefore, it is possible to realize the effects described above by setting the duration according to the print mode as in this aspect.

It is also possible to realize the present invention as various aspects which are different to the description above. For example, it is possible to realize the present invention as a nozzle testing method, a program for realizing this method, a storage medium which stores this program in a permanent manner, and the like.

BRIEF DESCRIPTION OF THE DRAWINGS

Referring now to the attached drawings which form a part of this original disclosure:

FIGS. 37A and 37B are diagrams illustrating a positional relationship between a wiper and a head unit shown in FIG. 36.

FIG. 50 is a table illustrating print modes in embodiment 4.

DETAILED DESCRIPTION OF EXEMPLARY EMBODIMENTS

Below, appropriate embodiments of a liquid droplet discharging apparatus and an ink jet printer of the present invention will be described in detail with reference to FIG. 1 to FIG. 52. Here, the embodiments are given as examples, and due to this, should not be interpreted as limiting the content of the present invention. Here, description will be given below using an ink jet printer which prints an image on a recording sheet (a liquid droplet receiving object) by discharging ink (a material in liquid form) as an example in the present embodiment.

First Embodiment

Figure 1:
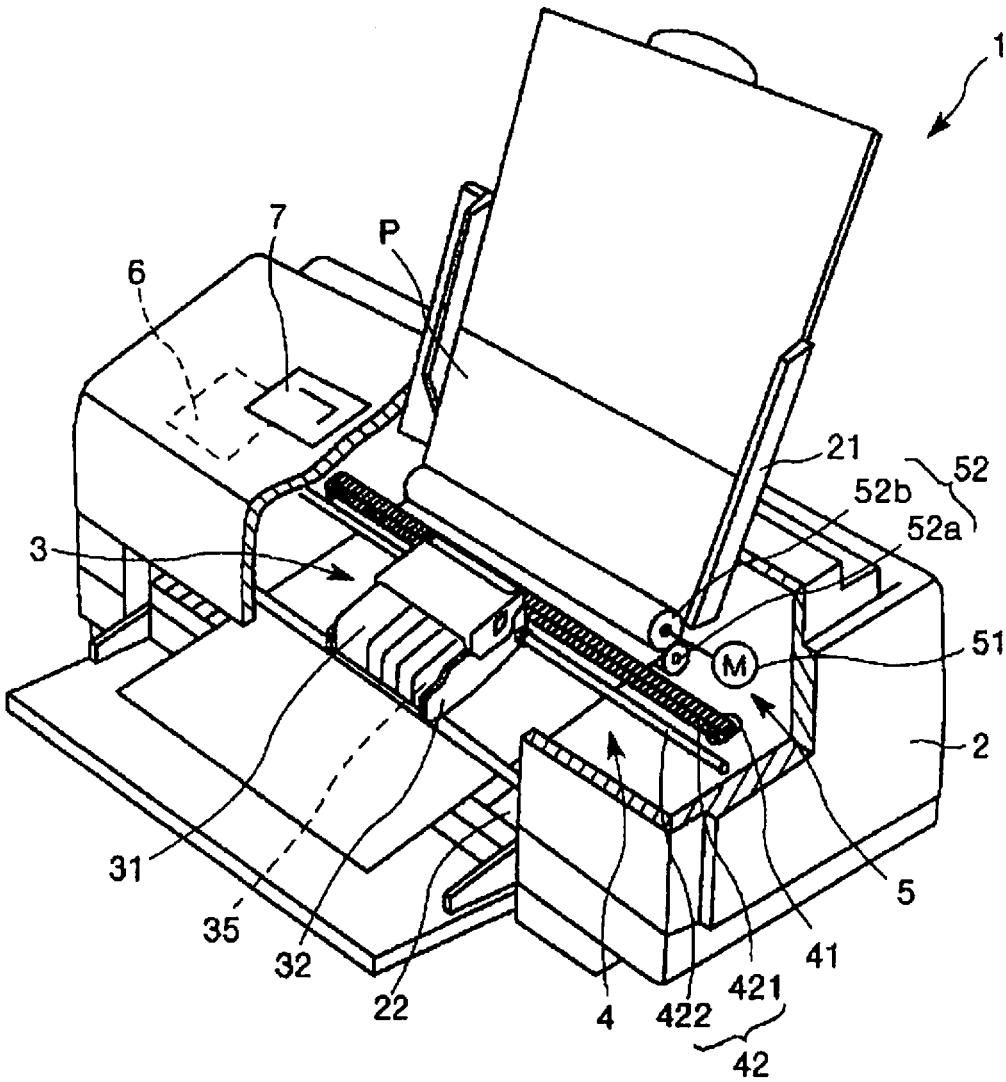
FIG. 1 is a schematic diagram illustrating a configuration of an ink jet printer which is one type of a liquid droplet discharging apparatus in the present invention.

FIG. 1 is a schematic diagram illustrating the configuration of an ink jet printer 1 which is one type of the liquid droplet discharging apparatus in the first embodiment of the present invention. Here, the upper side in FIG. 1 is referred to as the "upper section" and the lower side in FIG. 1 is referred to as the "lower section" in the following description. Firstly, the configuration of the ink jet printer 1 will be described.

The ink jet printer 1 shown in FIG. 1 is provided with an apparatus body 2, and is provided with a tray 21 where a recording sheet P is placed in the upper section to the rear, a paper output port 22 where the recording sheet P is output to the lower section to the front, and an operation panel 7 on the upper section surface.

The operation panel 7 is provided with a display section (which is not shown in the diagram) which is configured by, for example, a liquid crystal display, an organic EL display, an LED lamp, or the like and displays error messages or the like, and an operation section (which is not shown in the diagram) which is configured by various types of switches and the like. The display section of the operation panel 7 functions as a notification means.

In addition, the inner section of the apparatus body 2 mainly has a printing apparatus (a print means) 4 which is provided with a printing means (a moving body) 3 which moves back and forth, a sheet supplying apparatus (a liquid droplet receiving object transport means) 5 which supplies and outputs the recording sheet P with regard to the printing apparatus 4, and a control section (a control means) 6 which controls the printing apparatus 4 and the sheet supplying apparatus 5.

Due to controlling by the control section 6, the sheet supplying apparatus 5 intermittently feeds the recording sheets P one by one. The recording sheets P pass in the vicinity of the lower section of the printing means 3. At this time, the printing means 3 moves back and forth in a direction which is substantially perpendicular to the feeding direction of the recording sheet P and performs printing on the recording sheets P. That is, ink jet printing is executed by the back and forth movement of the printing means 3 and the intermittent feeding of the recording sheet P in the main scanning and the sub-scanning during printing.

The printing apparatus 4 is provided with the printing means 3, a carriage motor 41 which is a driving source which moves (back and forth) the printing means 3 in the main scanning direction, and a back and forth movement mechanism 42 which moves the printing means 3 back and forth by receiving rotation of the carriage motor 41.

The printing means 3 has a plurality of head units 35, ink cartridges (I/C) 31 which supply ink to each of the head units 35, and a carriage 32 where each of the head units 35 and the ink cartridges 31 are mounted. Here, in a case of an ink jet printer which consumes a large amount of ink, there may be a configuration where the ink cartridges 31 are placed in a separate location without being mounted in the carriage 32 and are linked with the head units 35 by tubes so as to supply the ink (not shown in the diagram).

Here, full-color printing is possible by using cartridges which are filled with ink with four colors of yellow, cyan, magenta, and black as the ink cartridges 31. In this case, head units 35 (the configuration of which will be described in detail later) which correspond respectively to each of the colors are provided in the printing means 3. Here, the four ink cartridges 31 which correspond to the four colors of ink are illustrated in FIG. 1, but the printing means 3 may be configured so as to be further provided with the ink cartridges 31 with other colors such as, for example, light cyan, light magenta, dark yellow, or special color inks.

The back and forth movement mechanism 42 has a carriage guide shaft 422 where both ends are supported on a frame (which is not shown in the diagram), and a timing belt 421 which extends in parallel with the carriage guide shaft 422.

The carriage 32 is supported so as to freely move back and forth on the carriage guide shaft 422 of the back and forth movement mechanism 42 and is fixed to a portion of the timing belt 421.

When the timing belt 421 travels forward and backward via a pulley according to the operation of the carriage motor 41, the printing means 3 moves back and forth by being guided by the carriage guide shaft 422. Then, during the back and forth movement, printing is performed on the recording sheet P by discharging appropriate ink droplets from each of the ink jet heads 100 in the head units 35 to correspond to the image data (the printing data) to be printed.

The sheet supplying apparatus 5 has a sheet supplying motor 51 which is the driving source of the sheet supplying apparatus 5 and a sheet supplying roller 52 which rotates according to the operation of the sheet supplying motor 51.

The sheet supplying roller 52 is configured by a driven roller 52*a* and a driving roller 52*b* which face upward and downward while interposing the transport path of the recording sheet P (or the recording sheet P), and the driving roller 52*b* is coupled with the sheet supplying motor 51. Due to this, the sheet supplying roller 52 feeds the large number of recording sheets P which are placed in the tray 21 toward the printing apparatus 4 one sheet at a time and outputs the recording sheets P from the printing apparatus 4 one sheet at a time. Here, a configuration may be adopted where it is possible to mount a sheet supplying cassette, which accommodates the recording sheets P, so as to be able to be freely attached and detached, instead of the tray 21.

Furthermore, the sheet supplying motor 51 also performs sheet feeding of the recording sheets P according to the resolution of the image by working together with the back and forth operation of the printing means 3. It is also possible for the sheet supplying operation and the sheet feeding operation to each be performed by separate motors and, in addition, it is also possible for the sheet supplying operation and the sheet feeding operation to each be performed by the same motor using components which perform switching of the torque transmission such as an electromagnetic clutch.

The control section 6 performs, for example, a printing process on the recording sheets P by controlling the printing apparatus 4, the sheet supplying apparatus 5, and the like based on printing data which is input from a host computer 8 such as a personal computer (PC) or a digital camera (DC). In addition, the control section 6 displays error messages or the like on the display section of the operation panel 7 or turns on and off LED lamps or the like, and executes corresponding processes for each of the sections based on pressing signals from various types of switches which are input from the operation section. Furthermore, the control section 6 transfers information such as error messages or discharge abnormalities to the host computer 8 according to necessity.

Figure 2:
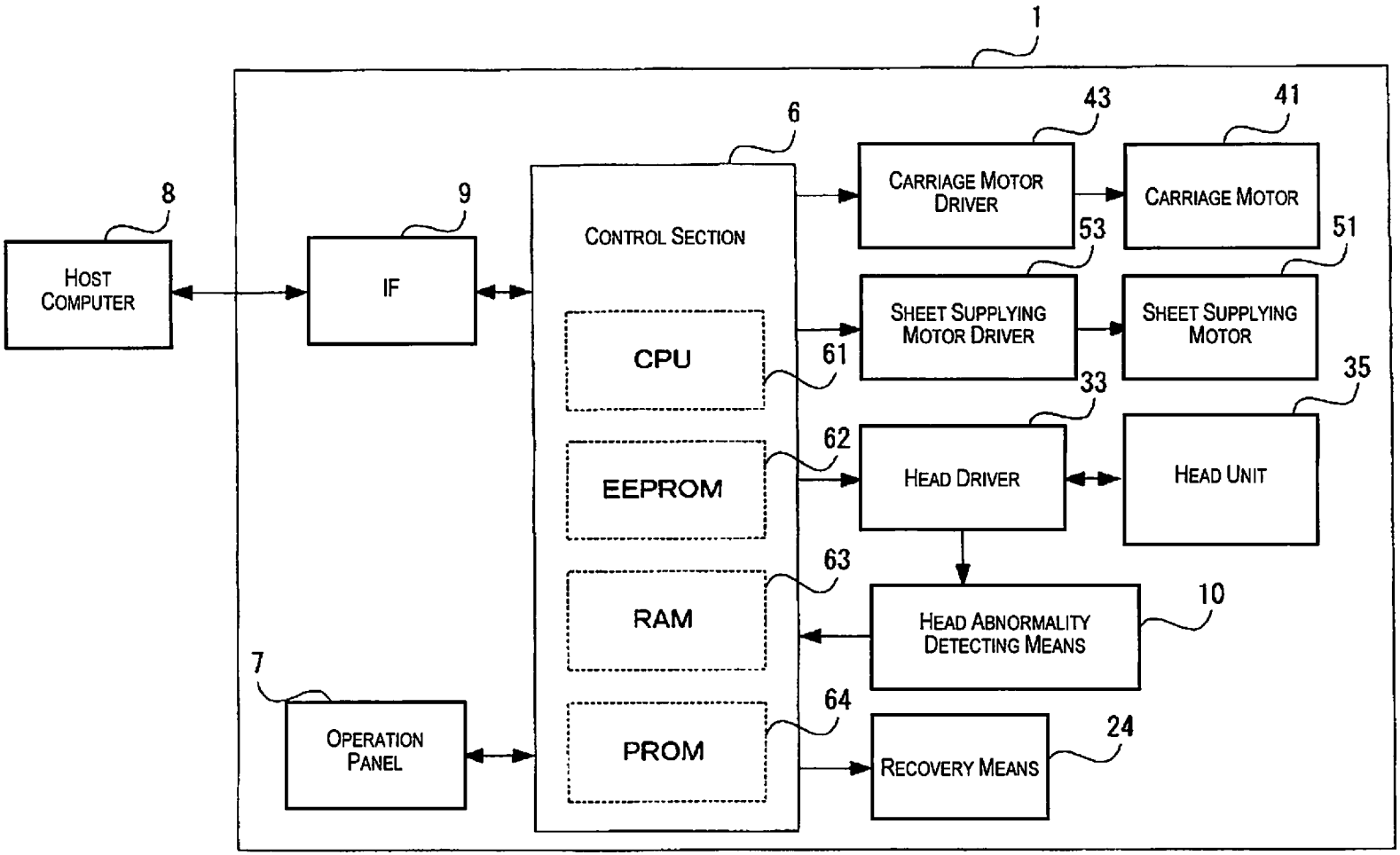
FIG. 2 is a block diagram schematically illustrating a main portion of the ink jet printer of the present invention.

FIG. 2 is a block diagram schematically illustrating a main portion of the ink jet printer of the present invention. In FIG. 2, the ink jet printer 1 of the present invention is provided with an interface section (IF: interface) 9 which receives printing data and the like which are input from the host computer 8, the control section 6, the carriage motor 41, a carriage motor driver 43 which drives and controls the carriage motor 41, the sheet supplying motor 51, a sheet supplying motor driver 53 which drives and controls the sheet supplying motor 51, the head units 35, a head driver 33 which drives and controls the head units 35, a discharging abnormality detecting means 10, a recovery means 24, and the operation panel 7. Here, the discharging abnormality detecting means 10, the recovery means 24, and the head driver 33 will be described in detail later.

In FIG. 2, the control section 6 is provided with a CPU (Central Processing Unit) 61 which executes various types of processes such as a printing process or a discharging abnormality detecting process, an EEPROM (Electrically Erasable Programmable Read-Only Memory) (a storage means) 62 which is one type of non-volatile semiconductor memory which holds printing data, which is input from the host computer 8 via the IF 9, in a data holding region (which is not shown in the diagram), a RAM (Random Access Memory) 63 which temporarily holds various types of data when executing a discharging abnormality detecting process or the like which will be described later or temporarily runs application programs such as a printing process, and a PROM 64 which is one type of non-volatile semiconductor memory which holds control programs or the like which control each of the sections. Here, each of the constituent components of the control section 6 is electrically connected via a bus which is not shown in the diagram.

As described above, the printing means 3 is provided with a plurality of head units 35 which correspond to each of the colors of the inks. In addition, each of the head units 35 is provided with a plurality of nozzles 110 and electrostatic actuators 120 which correspond to each of the nozzles 110. That is, the head units 35 are configured to be provided with the plurality of ink jet heads 100 (liquid droplet discharging heads) which have one set of the nozzle 110 and the electrostatic actuator 120. Then, the head driver 33 is configured from a driving circuit 18, which controls the discharge timing of the ink by driving the electrostatic actuators 120 of each of the ink jet heads 100, and a switching means 23 (refer to FIG. 16). Here, the configuration of the electrostatic actuator 120 will be described later.

In addition, although not shown in the diagrams, various types of sensors which are able to detect, for example, the remaining amount of ink in the ink cartridges 31, the position of the printing means 3, the printing environment such as temperature or humidity, and the like are electrically connected with each other in the control section 6.

When printing data is obtained from the host computer 8 via the IF 9, the control section 6 holds the printing data in the EEPROM 62. Then, the CPU 61 executes predetermined processes on the printing data and outputs driving signals to each of the drivers 33, 43, and 53 based on the process data and input data from the various types of sensors. When these driving signals are input via each of the drivers 33, 43, and 53, the plurality of electrostatic actuators 120 in the head units 35, and the carriage motor 41 of the printing apparatus 4 and the sheet supplying apparatus 5 are each operated. Due to this, the printing process is performed on the recording sheets P.

Figure 3:
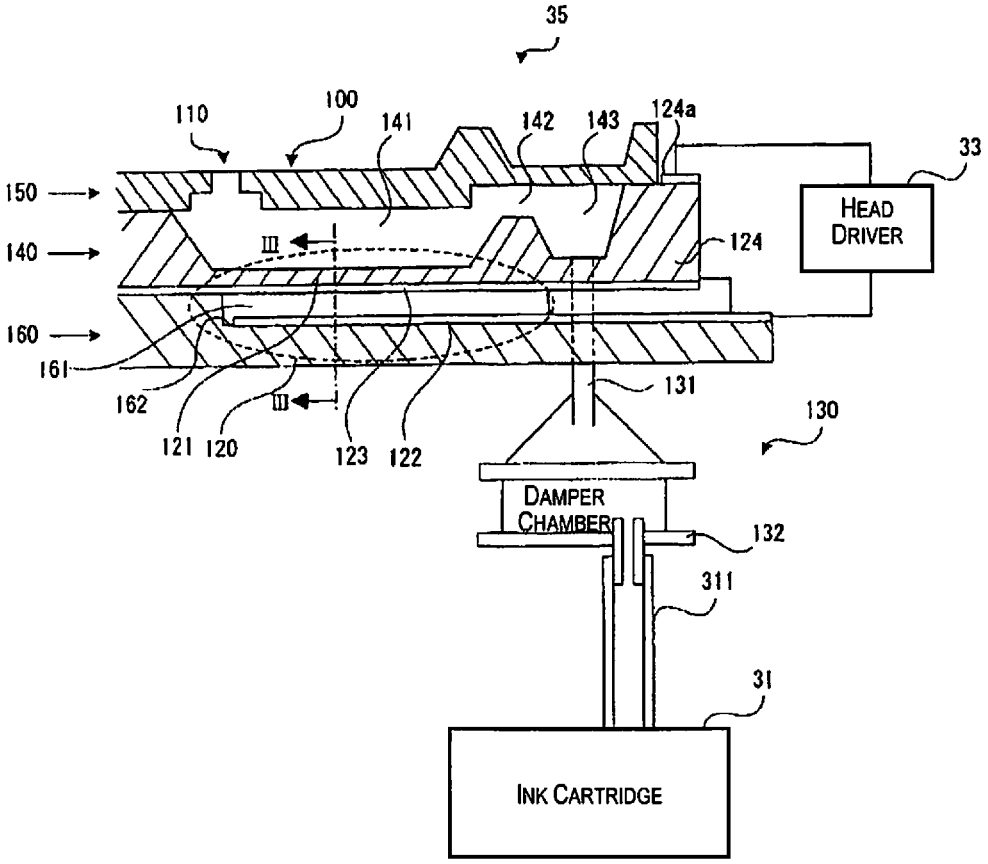
FIG. 3 is a schematic cross sectional diagram of a head unit (an ink jet head) in the ink jet printer shown in FIG. 1.
Figure 4:
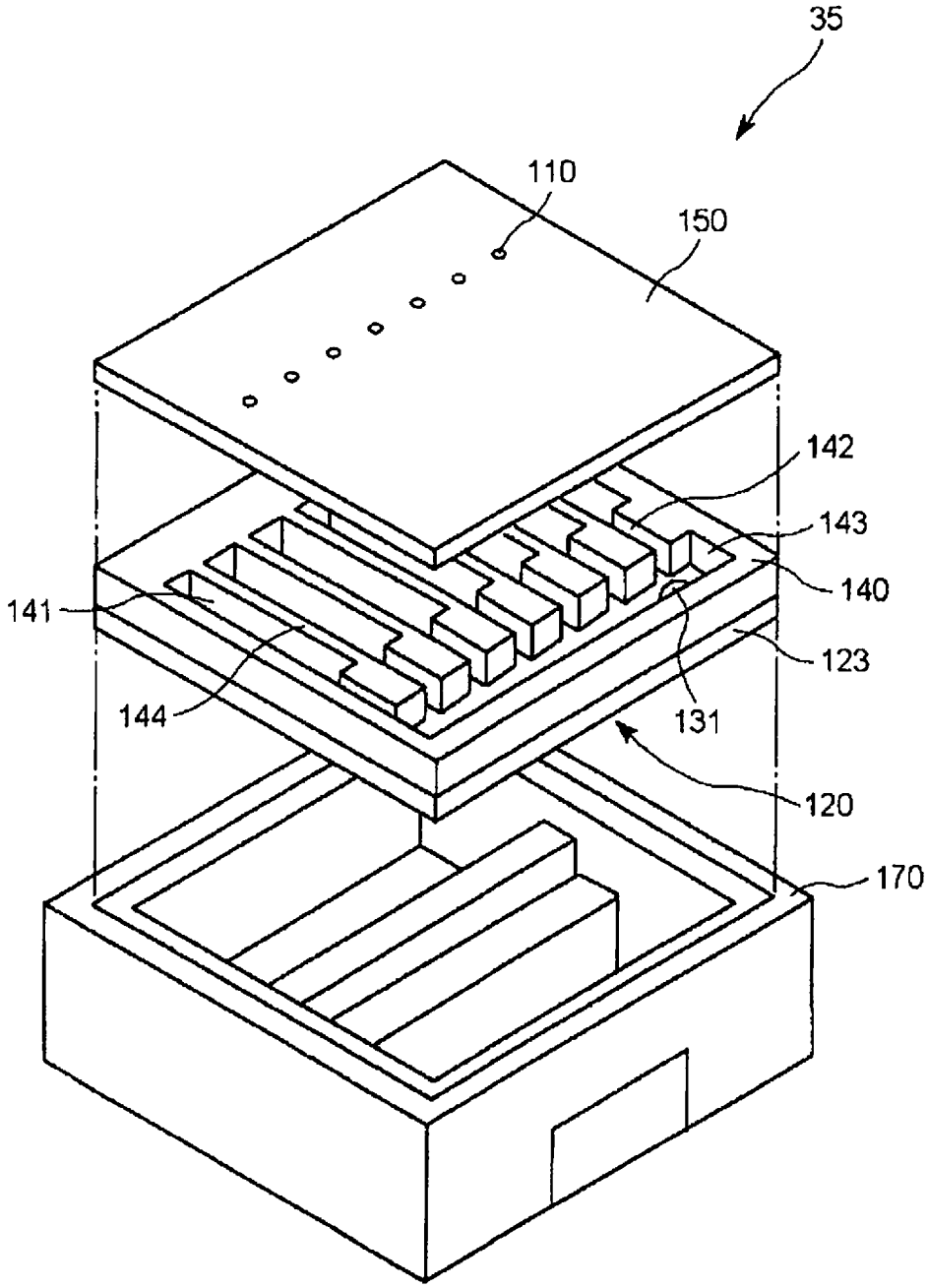
FIG. 4 is an exploded perspective diagram illustrating a configuration of the head unit in FIG. 3.
Figure 5:
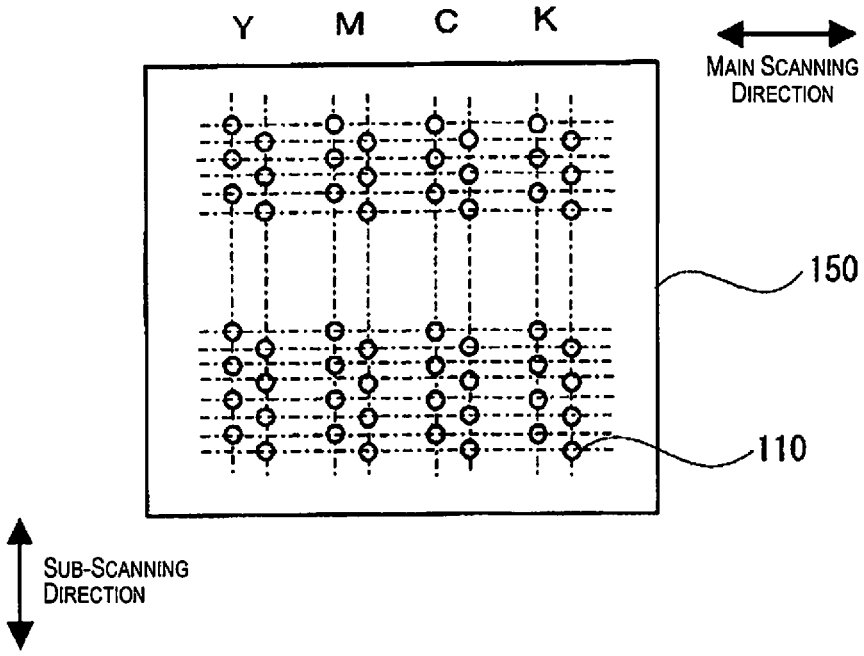
FIG. 5 is an example of a nozzle arrangement pattern on a nozzle plate in the head unit which uses four colors of ink.

Next, the structure of each of the head units 35 inside the printing means 3 will be described. FIG. 3 is a schematic cross sectional diagram of the head unit 35 (the ink jet head 100) shown in FIG. 1, FIG. 4 is an exploded perspective diagram illustrating a schematic configuration of the head unit 35 which corresponds to one color of ink, and FIG. 5 is a planar diagram illustrating an example of a nozzle surface of the printing means 3 where the head units 35 shown in FIG. 3 and FIG. 4 are applied. Here, FIG. 3 and FIG. 4 illustrate a state where up and down are reversed compared to the state of normal use.

As shown in FIG. 3, the head unit 35 is connected with the ink cartridge 31 via an ink inlet port 131, a damper chamber 130, and an ink supply tube 311. Here, the damper chamber 130 is provided with a damper 132 which is formed from rubber. By using the damper chamber 130, it is possible to absorb ink fluctuations and changes in the ink pressure when the carriage 32 is traveling back and forth, and due to this, it is possible to stably supply predetermined amounts of ink to the head units 35.

In addition, the head unit 35 has a three layer structure where lamination is carried out so that a silicon substrate 140 is interposed by a nozzle plate 150 which is also made of silicon on the upper side and a borosilicate glass substrate (a glass substrate) 160 with a thermal expansion coefficient which is close to silicon at the lower side. On the silicon substrate 140 in the middle, grooves are formed which each function as a plurality of independent cavities (pressure chambers) 141 (seven cavities are shown in FIG. 4), one reservoir (a common ink chamber) 143, and ink supply ports (orifices) 142 which link the reservoir 143 with each of the cavities 141. For example, it is possible for each of the grooves to be formed from the surface of the silicon substrate 140 by carrying out etching processes. The nozzle plate 150, the silicon substrate 140, and the glass substrate 160 are bonded in this order, and each of the cavities 141, the reservoir 143, and each of the ink supply ports 142 are formed to be partitioned.

The cavities 141 are configured such that each is formed in strip shapes (rectangular shapes), it is possible for the volume of the cavities 141 to change according to vibration (displacement) of a diaphragm 121 which will be described later, and ink (a material in liquid form) is discharged from the nozzles 110 according to the changes in volume. The nozzles 110 are formed on the nozzle plate 150 at positions which correspond to portions of the front end sides of each of the cavities 141 and the nozzles 110 are linked with each of the cavities 141. In addition, the ink inlet port 131 which is linked with the reservoir 143 is formed in a portion of the glass substrate 160 where the reservoir 143 is positioned. The ink is supplied from the ink cartridge 31 via the ink supply tube 311 and the damper chamber 130 through the ink inlet port 131 to the reservoir 143. The ink which is supplied to the reservoir 143 is supplied to each of the independent cavities 141 by passing through each of the ink supply ports 142. Here, each of the cavities 141 is formed to be partitioned by the nozzle plate 150, side walls (partition walls) 144, and a bottom wall 121.

The bottom wall 121 of each of the independent cavities 141 is formed to be thin and the bottom wall 121 is configured to function as a diaphragm which is able to elastically change shape (to be elastically displaced) in the out-of-plane direction (the thickness direction), that is, in the up and down direction in FIG. 3. Accordingly, for convenience of the following description, a portion of the bottom wall 121 may be described as the diaphragm 121 (that is, both the "bottom wall" and the "diaphragm" use the reference number 121 below).

Shallow concave sections 161 are each formed on the surface on the silicon substrate 140 side of the glass substrate 160 at positions which correspond to each of the cavities 141 of the silicon substrate 140. Accordingly, the bottom walls 121 of each of the cavities 141 are face to face at predetermined intervals with the surface of an opposing wall 162 of the glass substrate 160 where the concave sections 161 are formed. That is, there are gaps with a predetermined thickness (for example, approximately 0.2 microns) between the bottom walls 121 of the cavities 141 and segment electrodes 122 which will be described later. Here, it is possible for the concave sections 161 to be formed by, for example, etching or the like.

Here, the bottom walls (the diaphragm) 121 of each of the cavities 141 configure portions of a common electrode 124 on the sides of each of the cavities 141 for storing each electrical charge according to driving signals which are supplied from the head driver 33. That is, the diaphragms 121 in each of the cavities 141 also serve as one opposing electrode (an opposing electrode of the capacitor) of the corresponding electrostatic actuator 120 which will be described later. Then, the segment electrodes 122 which are electrodes which are opposed to the common electrode 124 are each formed on the surface of the concave sections 161 of the glass substrate 160 so as to be face to face with the bottom walls 121 of each of the cavities 141. In addition, the surfaces of the bottom walls 121 of each of the cavities 141 are covered by an insulating layer 123 which is formed of a silicon oxide film ($SiO_2$) as shown in FIG. 3. In this manner, the bottom walls 121 of each of the cavities 141, that is, the diaphragms 121, and the respective segment electrodes 122 which correspond to the bottom walls 121 form (configure) opposing electrodes (opposing electrodes of the capacitor) via the insulating layer 123 which is formed on the surface of the lower side of the bottom walls 121 of the cavities 141 in FIG. 3 and a gap inside the concave sections 161. Accordingly, the main portion of the electrostatic actuator 120 is configured by the diaphragm 121, the segment electrode 122, and the insulating layer 123 and the gap, which are between the diaphragm 121 and the segment electrode 122.

As shown in FIG. 3, the head driver 33, which includes the driving circuit 18 for applying a driving voltage between the opposing electrodes, performs charging and discharging between the opposing electrodes according to printing signals (printing data) which are input from the control section 6. One output terminal of the head driver (a voltage application means) 33 is connected with the individual segment electrodes 122 and the other output terminal is connected with an input terminal 124*a* of the common electrode 124 which is formed on the silicon substrate 140. Here, impurities are implanted into the silicon substrate 140 and it is possible for voltage to be supplied from the input terminal 124*a* of the common electrode 124 to the common electrode 124 of the bottom wall 121 since the impurities themselves have conductivity. In addition, for example, a thin film of a conductive material such as gold or copper may be formed on one surface of the silicon substrate 140. Due to this, it is possible to supply a voltage (an electrical charge) to the common electrode 124 with a low electrical resistance (with good efficiency). It is sufficient if the thin film is formed by, for example, vapor deposition, sputtering, or the like. Here, for example, since the silicon substrate 140 and the glass substrate 160 are joined (bonded) by anodic bonding in the present embodiment, a conductive film which is used as an electrode in the anodic joining is formed on the flow path forming surface side of the silicon substrate 140 (the upper section side of the silicon substrate 140 shown in FIG. 3). Then, the conductive film is used as it is as the input terminal 124*a* of the common electrode 124. Here, in the present invention, for example, the input terminal 124*a* of the common electrode 124 may be omitted, and in addition, the bonding method of the silicon substrate 140 and the glass substrate 160 is not limited to anodic bonding.

As shown in FIG. 4, the head unit 35 is provided with the nozzle plate 150 where a plurality of the nozzles 110 are formed, the silicon substrate (an ink chamber substrate) 140 where a plurality of the cavities 141, a plurality of the ink supply ports 142, and the one reservoir 143 are formed, and the insulating layer 123, and the head units 35 are housed in a base body 170 which includes the glass substrate 160. The base body 170 is configured by, for example, various types of resin material, various types of metal material, and the like, and the silicon substrate 140 is fixed to and supported by the base body 170.

Here, the nozzles 110 which are formed in the nozzle plate 150 are arranged in a straight line and substantially parallel with regard to the reservoir 143 for simplicity of illustration in FIG. 4, but the arrangement pattern of the nozzles is not limited to this configuration and is normally arranged in staggered steps as in, for example, the nozzle arrangement pattern shown in FIG. 5. In addition, it is possible for the pitch between the nozzles 110 to be appropriately set according to the printing resolution (dpi: dots per inch). Here, the arrangement pattern of the nozzles 110 in a case where four colors of inks (ink cartridges 31) are applied is shown in FIG. 5.

Figure 6C:
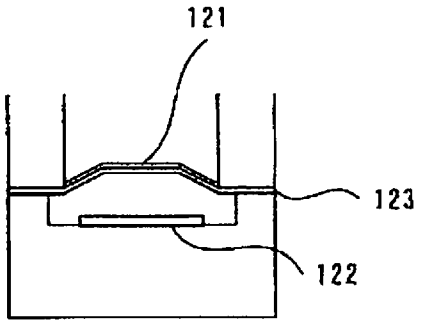
FIGS. 6A to 6C are state diagrams illustrating each state of the cross section III-III in FIG. 3 when a driving signal is input.
Figure 6B:
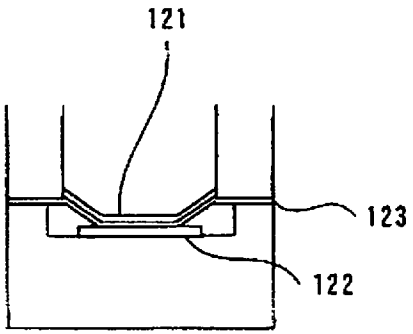
Figure 6A:
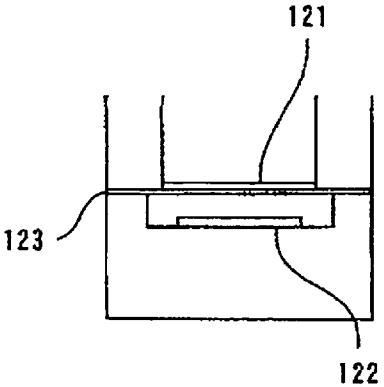

FIGS. 6A to 6C illustrate each state of the cross section III-III in FIG. 3 when a driving signal is input. When a driving voltage is applied between the opposing electrodes from the head driver 33, Coulomb force is generated between the opposing electrodes and the bottom wall (the diaphragm) 121 bends to the segment electrode 122 side with regard to the initial state (FIG. 6A) and the volume of the cavity 141 expands (FIG. 6B). In this state, when an electrical charge is rapidly discharged between the opposing electrodes due to controlling by the head driver 33, the diaphragm 121 is restored upward in the diagram due to the elastic restoring force, moves to the upper section past the position of the diaphragm 121 in the initial state, and the volume of the cavity 141 shrinks rapidly (FIG. 6C). Due to the compression pressure which is generated inside the cavity 141 at this time, a portion of the ink (the material in liquid form) which fills the cavity 141 is discharged as ink droplets from the nozzle 110 which is linked with the cavity 141.

According to this series of operations (ink discharging operation according to the driving signals of the head driver 33), the diaphragms 121 of each of the cavities 141 have attenuated vibration until the ink droplets are discharged again due to the input of the next driving signal (the driving voltage). Below, the attenuated vibration is referred to as residual vibration. The residual vibration of the diaphragm 121 is assumed to have a unique vibration frequency which is determined according to the shapes of the nozzles 110 and the ink supply ports 142 or acoustic resistance r according to the ink viscosity or the like, inertance m according to the weight of the ink inside the flow path, and compliance Cm of the diaphragms 121.

Figure 7:
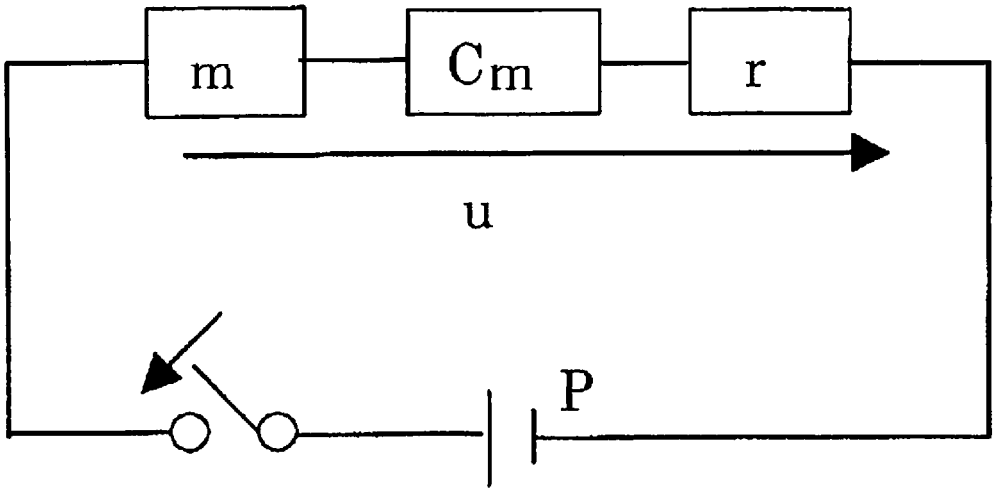
FIG. 7 is a circuit diagram illustrating a calculation model of simple vibration assuming the residual vibration of a diaphragm in FIG. 3.

A calculation model for the residual vibration of the diaphragms 121 will be described based on the assumption described above. FIG. 7 is a circuit diagram illustrating a calculation model of simple vibration assuming the residual vibration of the diaphragm 121. In this manner, the calculation model of the residual vibration of the diaphragm 121 is able to be represented by a sound pressure P, and the inertance m, the compliance Cm and the acoustic resistance r described above. Then, the following formula is able to be obtained when calculating a step response with regard to a volume velocity u when the sound pressure P is applied in the circuit of FIG. 7.

Formulas (1) to (3)

$$u = \frac{P}{\omega \cdot m} e^{\omega t} \cdot \sin\omega t \quad (1)$$

$$\omega = \sqrt{\frac{1}{m \cdot C_m} - \alpha^2} \quad (2)$$

$$\alpha = \frac{r}{2m} \quad (3)$$

Figure 8:
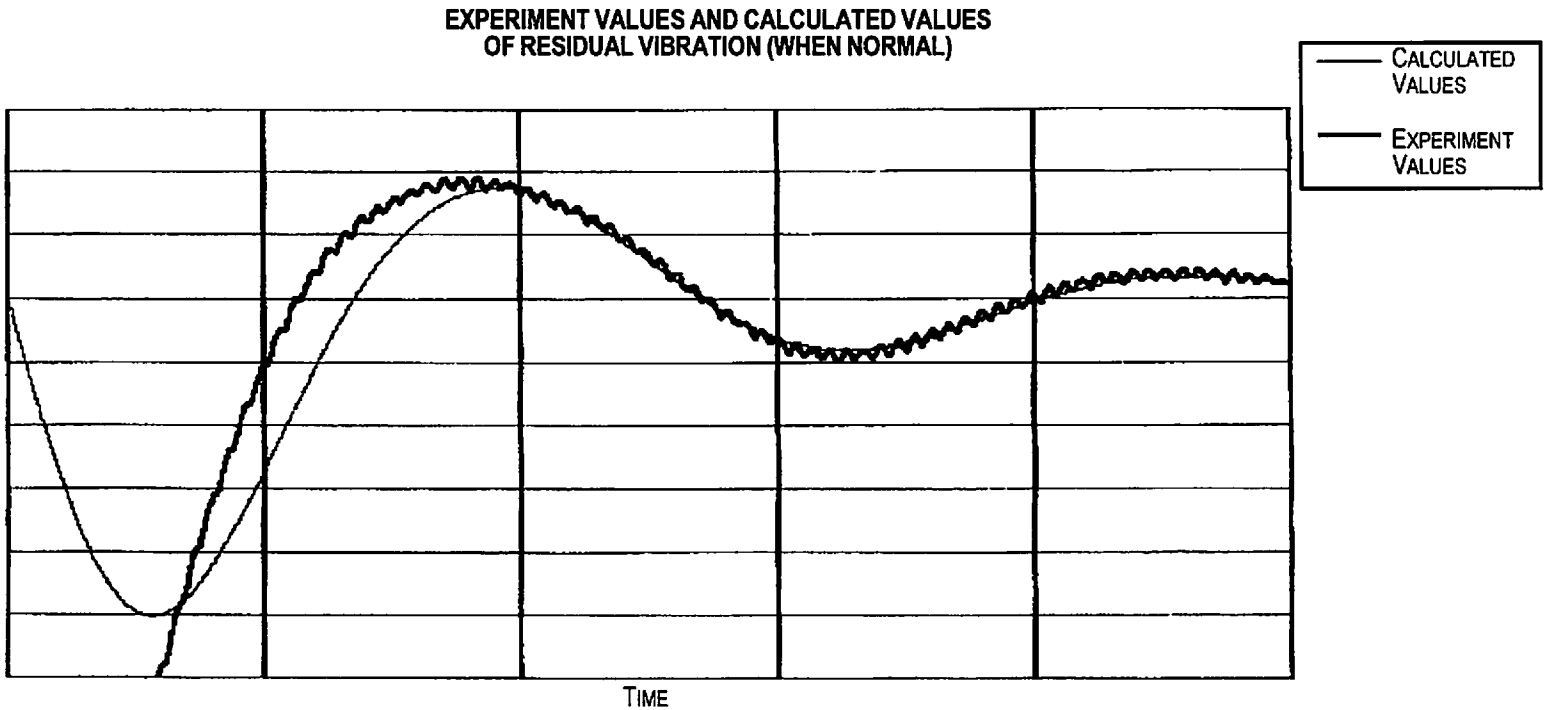
FIG. 8 is a graph illustrating the relationship between experiment values and calculated values of the residual vibration of the diaphragm in FIG. 3 in a case of normal discharge.

The calculation results which were obtained from this formula were compared with the experiment results of the experiments on the residual vibration of the diaphragm 121 after discharging of the ink droplets which was performed separately. FIG. 8 is a graph illustrating the relationship between the experiment values and the calculated values of the residual vibration of the diaphragm 121. As is understood from the graph shown in FIG. 8, the two waveforms of the experiment values and the calculated values approximately coincide.

Here, there are cases in each of the ink jet heads 100 of the head unit 35 where a phenomenon occurs where it is not possible for ink droplets to be discharged normally from the nozzles 110 regardless of whether the discharging operation described above is performed, that is, where discharge abnormalities in the liquid droplets occur. Examples of the causes which generate the discharge abnormalities include, as will be described later, (1) air bubbles mixing inside the cavities 141, (2) drying and thickening (fixing) of the ink in the vicinity of the nozzles 110, and (3) attachment of paper dust to the vicinity of the outlet ports of the nozzles 110, and the like.

When discharge abnormalities are generated, the liquid droplets are typically not discharged from the nozzles 110 as a result, that is, there is a phenomenon where the liquid droplets are not discharged, and in this case, missing dots occur in the pixels in the image which is printed (drawn) on the recording sheet P. In addition, in the case of discharge abnormalities, missing dots still appear in the pixels even when the liquid droplets are discharged from the nozzles 110 since the liquid droplets do not land correctly due to the amounts of the liquid droplets being too low or the flight direction (trajectory) of the liquid droplets deviating. For these reasons, there are cases in the following description where the discharging abnormalities of the liquid droplets are simply referred to as "missing dots".

Below, the values of the acoustic resistance r and/or the inertance m are adjusted such that the calculated values and the experiment values of the residual vibration of the diaphragm 121 match (approximately coincide) based on the comparison results shown in FIG. 8 for reasons other than causes of the missing dot (discharge abnormality) phenomenon (the phenomenon where the liquid droplets are not discharged) during the printing processing which are generated in the nozzles 110 of the ink jet head 100.

Figure 9:
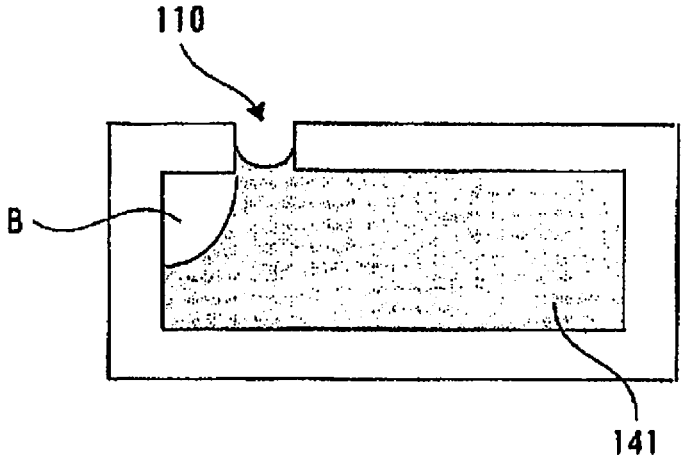
FIG. 9 is a conceptual diagram of the vicinity of the nozzle in a case where air bubbles are mixed inside the cavity in FIG. 3.

Firstly, mixing in of the air bubbles inside the cavity 141 which is one cause of missing dots will be examined. FIG. 9 is a conceptual diagram of the vicinity of the nozzle 110 in a case where an air bubble B is mixed inside the cavity 141 in FIG. 3. As shown in FIG. 9, the air bubble B which is generated is assumed to be generated and attached to the wall surface of the cavity 141 (a case where the air bubble B is attached to the vicinity of the nozzle 110 is shown in FIG. 9 as an example of the attachment position of the air bubble B).

In this manner, in a case where the air bubble B is mixed inside the cavity 141, it is thought that the total weight of the ink which fills the inside of the cavity 141 decreases and the inertance m decreases. In addition, since the air bubble B is attached to the wall surface of the cavity 141, it is thought that there will be a state where the diameter of the nozzle 110 is increased to the extent of the size of the diameter of the air bubble B and that the acoustic resistance r decreases.

Figure 10:
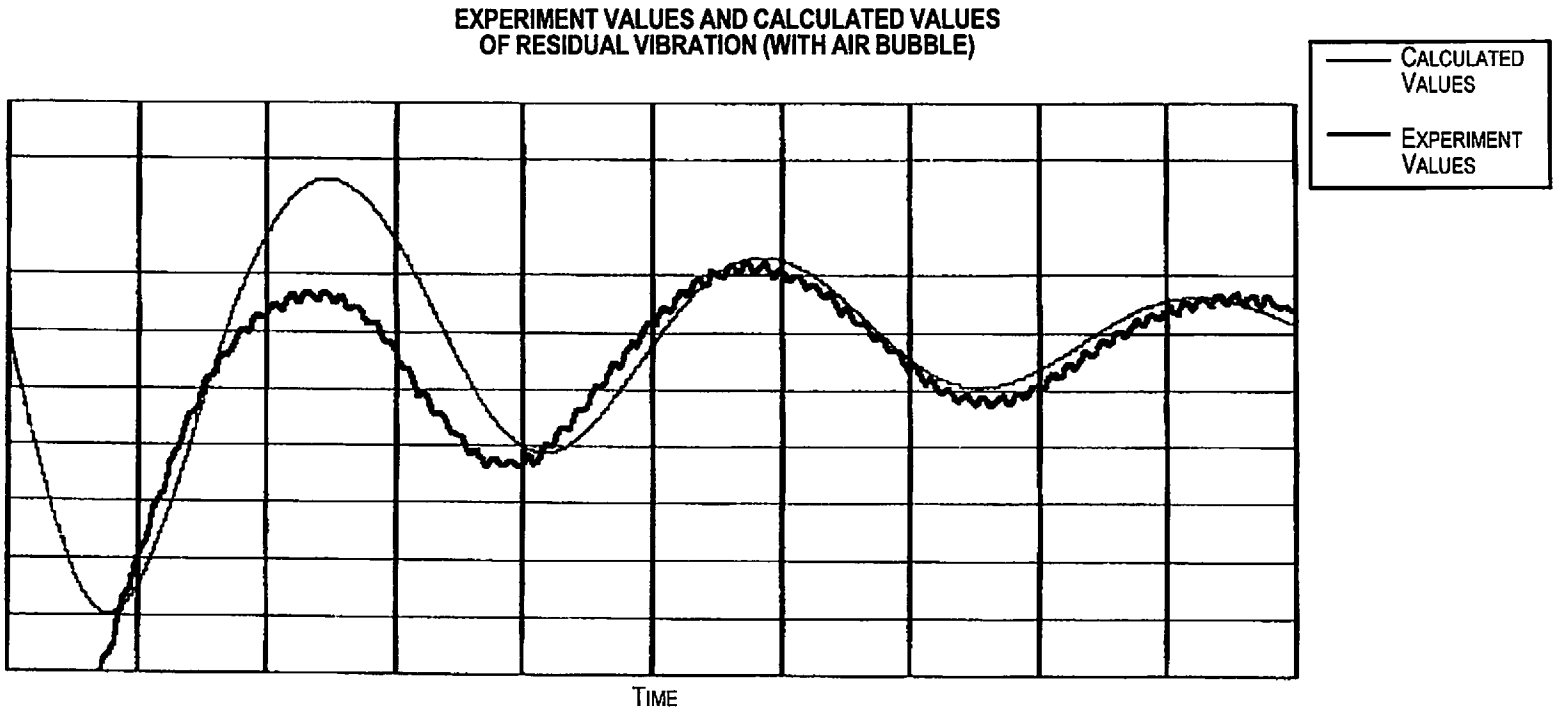
FIG. 10 is a graph illustrating calculated values and experiment values of the residual vibration in a state where ink droplets are not discharged due to mixing of air bubbles into the cavities.

Accordingly, with regard to the case of FIG. 8 where the ink is discharged normally, the results (the graph) in FIG. 10 were obtained by matching with the experiment values of the residual vibration when the air bubbles are mixed in due to setting both the acoustic resistance r and the inertance m to be small. As is understood from the graphs in FIG. 8 and FIG. 10, in a case where air bubble is mixed inside the cavity 141, a characteristic residual vibration waveform is obtained where the frequency is higher than during normal discharge. Here, the attenuation rate of the amplitude of the residual vibration is also reduced due to the reduction in the acoustic resistance r and the like and it is possible to confirm that the amplitude of the residual vibration is slowly reduced.

Figure 11:
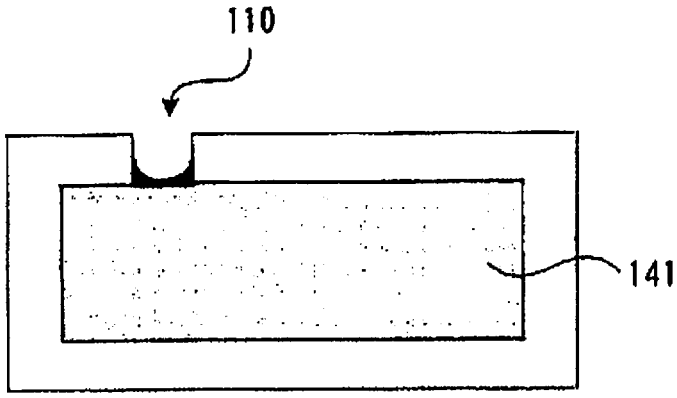
FIG. 11 is a conceptual diagram of the vicinity of the nozzles in a case where the ink in the vicinity of the nozzles in FIG. 3 is fixed by drying.

Next, drying (fixing and thickening) of the ink in the vicinity of the nozzles 110 which is another cause of missing dots will be examined. FIG. 11 is a conceptual diagram of the vicinity of the nozzles 110 in a case where the ink is fixed by drying in the vicinity of the nozzles 110 in FIG. 3. As shown in FIG. 11, in a case where the ink in the vicinity of the nozzles 110 is fixed by drying, the ink inside the cavity 141 enters a state of being trapped inside the cavity 141. In this manner, in a case where the ink in the vicinity of the nozzle 110 has thickened due to drying, it is thought that the acoustic resistance r increases.

Figure 12:
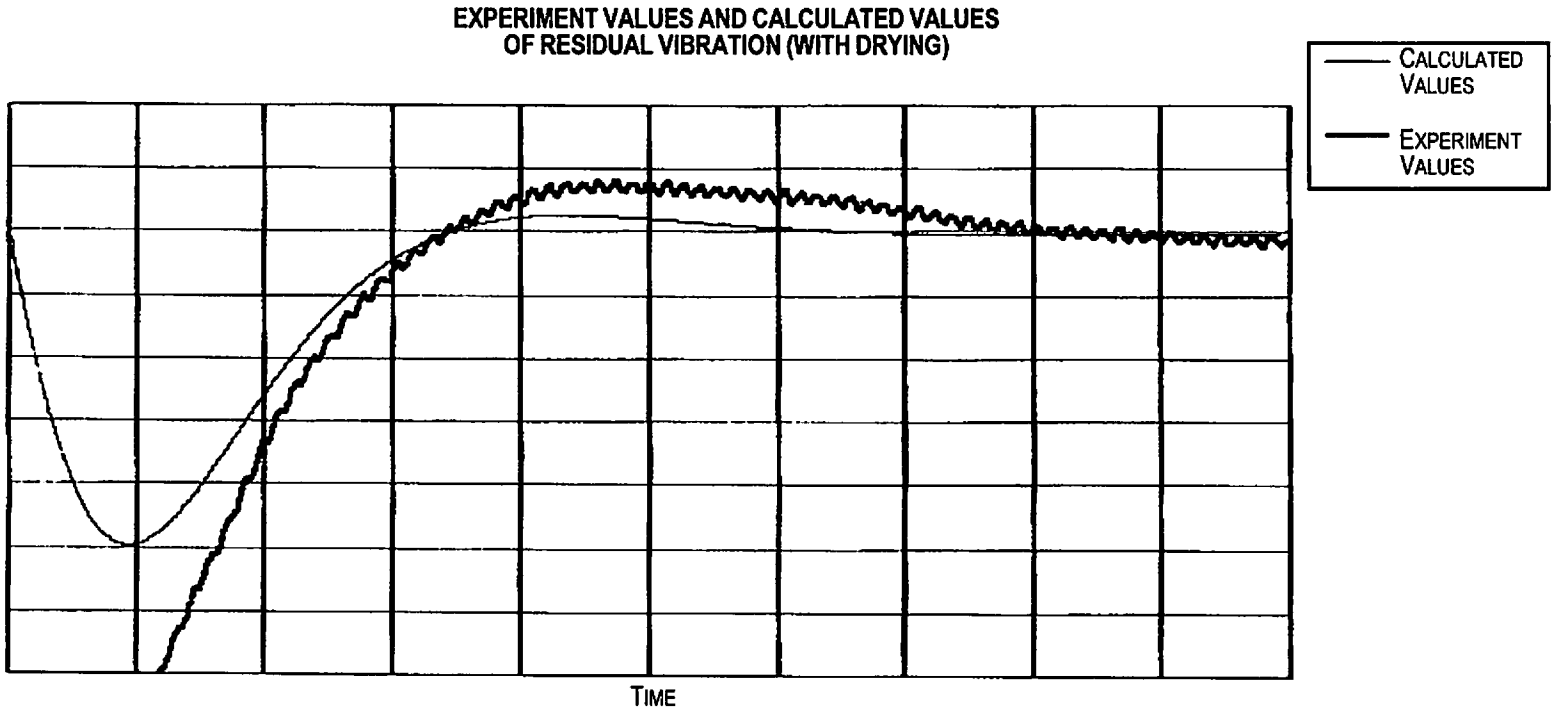
FIG. 12 is a graph illustrating calculated values and experiment values of the residual vibration in a state where the ink in the vicinity of the nozzles has thickened due to drying.

Accordingly, with regard to the case of FIG. 8 where the ink is discharged normally, the results (the graph) in FIG. 12 were obtained by matching with the experiment values of the residual vibration when the ink was fixed due to drying (thickened) in the vicinity of the nozzles 110 due to setting of the acoustic resistance r to be large. Here, the experiment values shown in FIG. 12 are values where the residual vibration of the diaphragm 121 has been measured in a state where it is not possible to discharge ink due to the head unit 35 being left to stand for several days in a state where a cap (which is not shown in the diagram) was not mounted and the ink in the vicinity of the nozzle 110 has thickened due to drying (where the ink is fixed). As is understood from the graphs of FIG. 8 and FIG. 12, in a case where the ink in the vicinity of the nozzles 110 is fixed due to drying, a characteristic residual vibration waveform is obtained where the frequency is extremely low compared to during normal discharge and the residual vibration is excessively attenuated. This is because, after the ink flows inside the cavity 141 from the reservoir 143 due to the diaphragm 121 being drawn downward in FIG. 3 in order to discharge the ink droplets, it is not possible for the diaphragms 121 to rapidly vibrate (due to the excessive attenuation) since there is no way for the ink inside the cavity 141 to escape when the diaphragm 121 has moved upward in FIG. 3.

Figure 13:
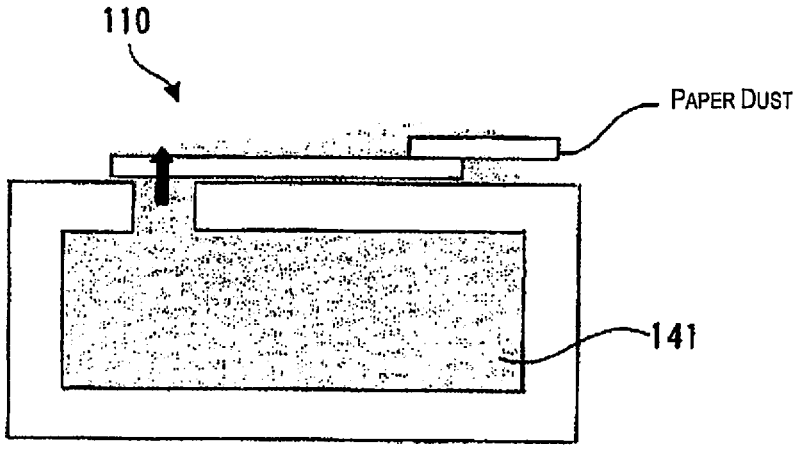
FIG. 13 is a conceptual diagram of the vicinity of the nozzles in a case where paper dust is attached to the vicinity of nozzle outlet ports in FIG. 3.

Next, the attachment of paper dust to the vicinity of the outlet ports of the nozzle 110, which is yet another cause of missing dots, will be examined. FIG. 13 is a conceptual diagram of the vicinity of the nozzle 110 in a case where paper dust is attached to the vicinity of the outlet port of the nozzle 110 in FIG. 3. As shown in FIG. 13, in a case where paper dust is attached to the vicinity of the outlet port of the nozzle 110, the ink seeps out from inside the cavity 141 via the paper dust and it is not possible to discharge the ink from the nozzle 110. In this manner, in a case where paper dust is attached to the vicinity of the outlet port of the nozzle 110 and the ink seeps out from the nozzle 110, it is thought that the inertance m increases because the ink which is inside the cavity 141 and the ink which seeps out increase to be more than normal when viewed from the diaphragm 121. In addition, it is thought that the acoustic resistance r increases due to fibers of the paper dust which is attached to the vicinity of the outlet port of the nozzle 110.

Figure 14:
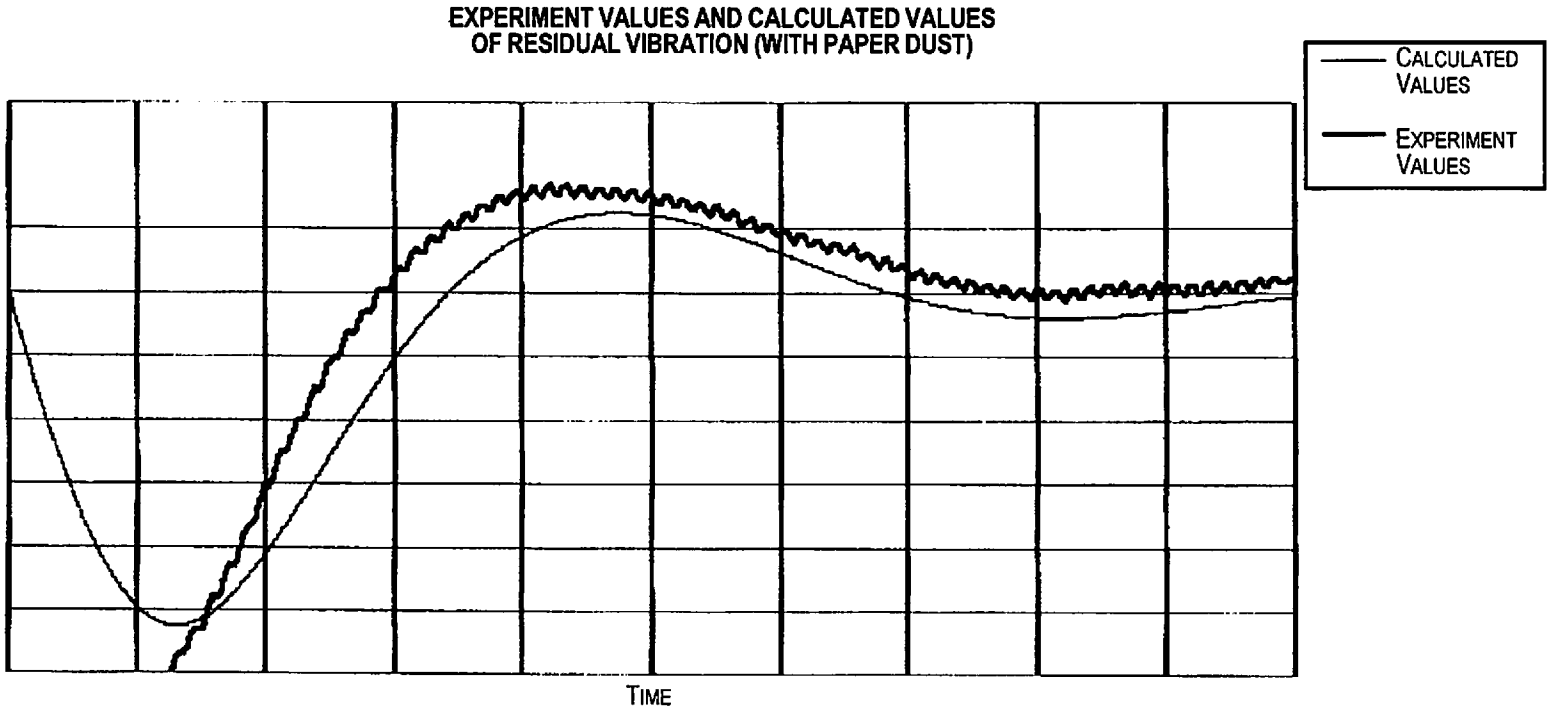
FIG. 14 is a graph illustrating calculated values and experiment values of the residual vibration in a state where paper dust is attached to the nozzle outlet ports.
Figure 15A:
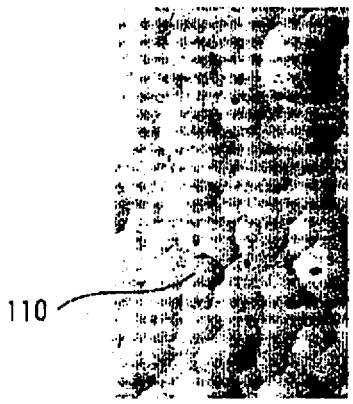
FIGS. 15A and 15B are photographs illustrating states of nozzles before and after paper dust is attached to the vicinity of the nozzles.
Figure 15B:
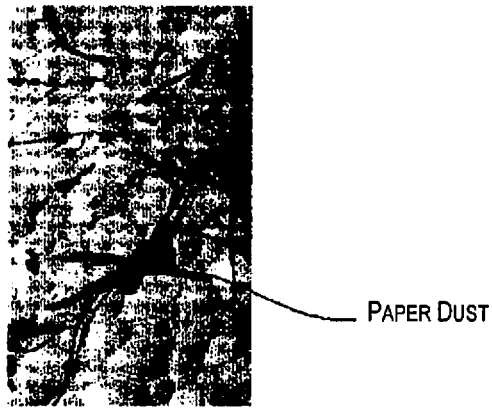

Accordingly, with regard to the case of FIG. 8 where the ink is discharged normally, the results (the graph) in FIG. 14 were obtained by matching with the experiment values of the residual vibration when the paper dust is attached to the vicinity of the outlet port of the nozzle 110 due to setting both the inertance m and the acoustic resistance r to be large. As is understood from the graphs of FIG. 8 and FIG. 14, in a case where paper dust is attached to the vicinity of the outlet ports of the nozzles 110, a characteristic residual vibration waveform is obtained where the frequency is low compared to during normal discharge (here, it is understood from the graphs of FIG. 12 and FIG. 14 that the frequency of the residual vibration is higher in the case of the attached paper dust than in the case of the dried ink). Here, FIGS. 15A and 15B are photographs illustrating states of the nozzles 110 before and after paper dust is attached. In FIG. 15B, it is possible to see a state where the ink seeps out along the paper dust when the paper dust is attached to the vicinity of the outlet port of the nozzle 110.

Here, in both of a case where the ink in the vicinity of the nozzle 110 is thickened due to drying and a case where the paper dust is attached to the vicinity of the outlet port of the nozzle 110, the frequency of the attenuated vibration is low compared to a case where the ink droplets are discharged normally. In order to specify these two causes of missing dots (non-discharging of the ink and discharge abnormalities) from the waveform of the residual vibration of the diaphragm 121, for example, it is possible to make a comparison with predetermined thresholds for the frequency, the cycle, or the phase of the attenuated vibration or to specify the cause from the attenuation rate of the changes in the cycle or the changes in amplitude of the residual vibration (the attenuated vibration). In this manner, it is possible to detect discharge abnormalities in each of the ink jet heads 100 using changes in the residual vibration of the diaphragm 121, in particular, changes in the frequency of the residual vibration, when the ink droplets are discharged from the nozzles 110 in each of the ink jet heads 100. In addition, by comparing the frequency of the residual vibration in such cases with the frequency of the residual vibration during normal discharging, it is also possible to specify the cause of the discharge abnormalities.

Figure 16:
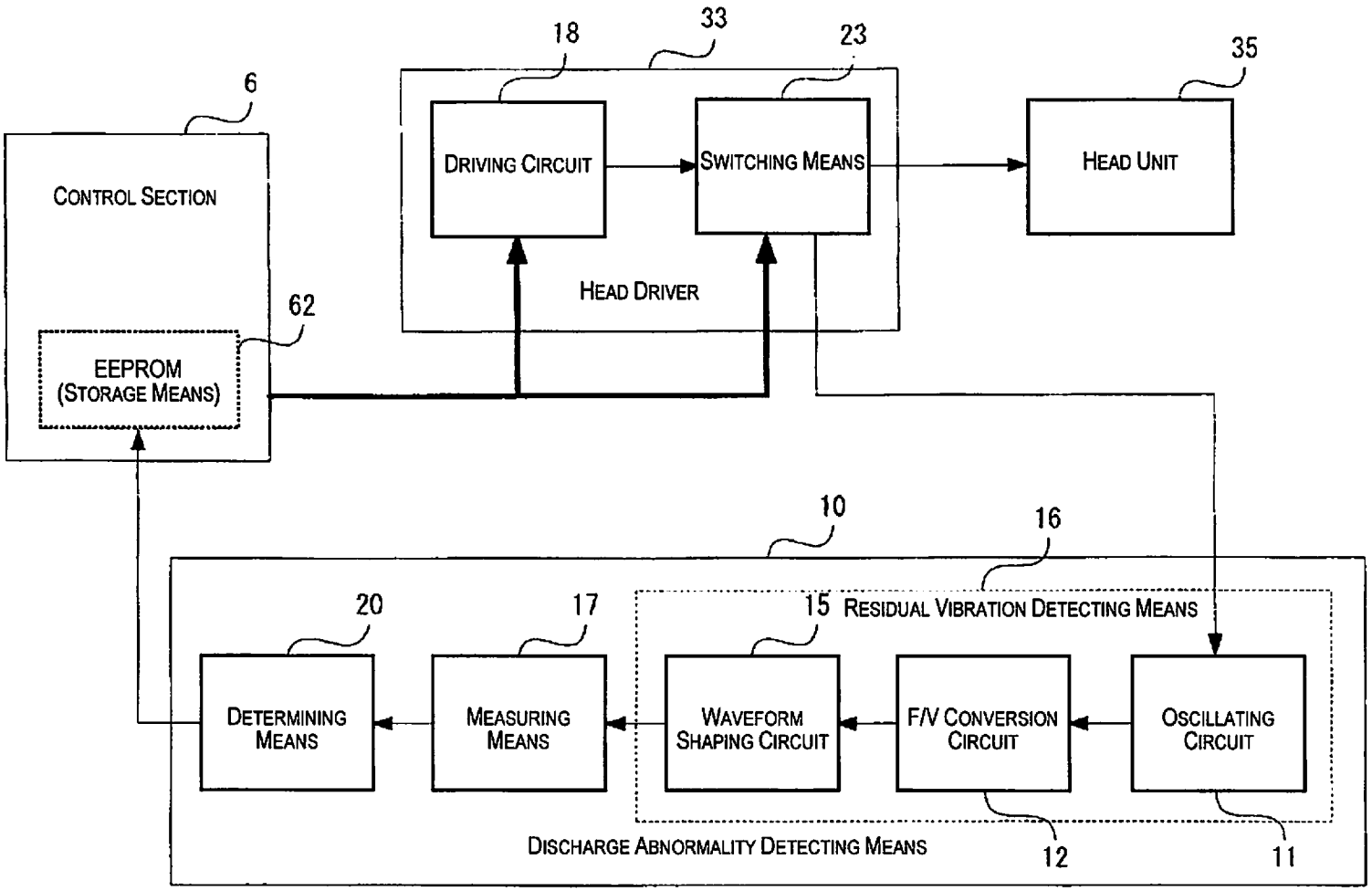
FIG. 16 is a schematic block diagram of a discharge abnormality detecting means.

Next, the discharging abnormality detecting means 10 will be described. FIG. 16 is a schematic block diagram of the discharging abnormality detecting means 10 shown in FIG. 3. As shown in FIG. 16, the discharging abnormality detecting means 10 is provided with a residual vibration detecting means 16 which is configured by an oscillation circuit 11, an F/V conversion circuit 12, and a waveform shaping circuit 15; a measuring means 17 which measures the cycle, amplitude, and the like from the residual vibration waveform data which is detected by the residual vibration detecting means 16; and a determining means 20 which determines discharge abnormalities in the ink jet heads 100 based on the cycle or the like which is measured by the measuring means 17. In the discharging abnormality detecting means 10, the residual vibration detecting means 16 carries out detection by the oscillation circuit 11 being oscillated based on the residual vibration of the diaphragm 121 of the electrostatic actuator 120 and a vibration waveform being formed in the F/V conversion circuit 12 and the waveform shaping circuit 15 from the oscillation frequency. Then, the measuring means 17 measures the cycle and the like of the residual vibration based on the vibration waveform which is detected and the determining means 20 detects and determines discharge abnormalities in each of the ink jet heads 100, where each of the head units 35 is provided inside the printing means 3, based on the cycle or the like of the residual vibration which is measured. Below, each of the constituent components of the discharging abnormality detecting means 10 will be described.

Figure 17:
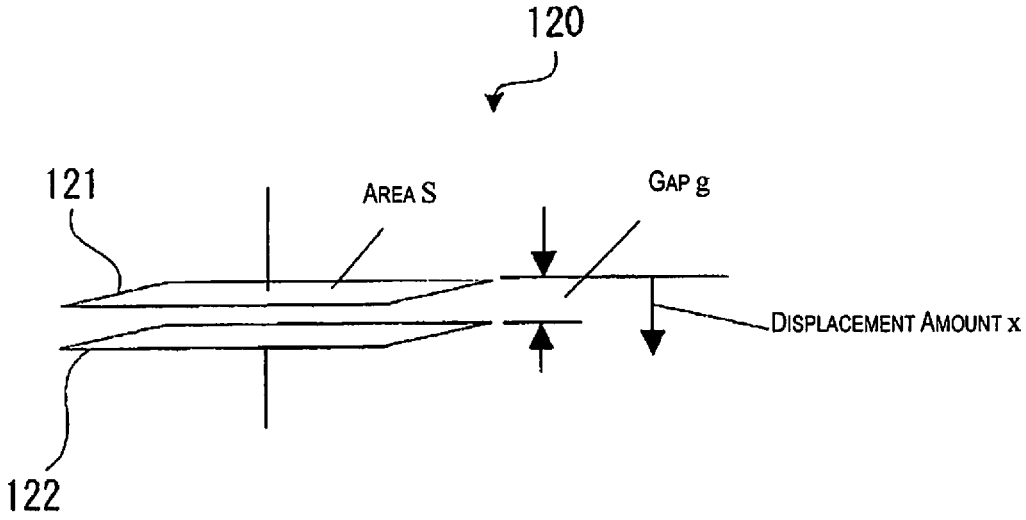
FIG. 17 is a conceptual diagram of a case where an electrostatic actuator in FIG. 3 is a parallel plate capacitor.
Figure 18:
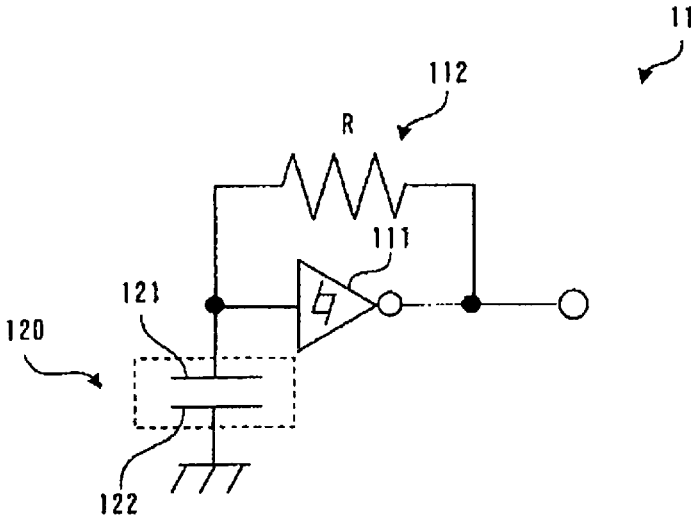
FIG. 18 is a circuit diagram of an oscillation circuit which includes a capacitor which is configured by the electrostatic actuator in FIG. 3.

Firstly, a method will be described where the oscillation circuit 11 is used in order to detect the frequency (the number of vibrations) of the residual vibration of the diaphragm 121 of the electrostatic actuator 120. FIG. 17 is a conceptual diagram of a case where the electrostatic actuator 120 in FIG. 3 is set as a parallel plate capacitor and FIG. 18 is a circuit diagram of the oscillation circuit 11 which includes a capacitor which is configured by the electrostatic actuator 120 in FIG. 3. Here, the oscillation circuit 11 shown in FIG. 18 is a CR oscillation circuit which uses a hysteresis characteristic of a Schmitt trigger, but the present invention is not limited to the CR oscillation circuit and the oscillation circuit 11 may be any oscillation circuit as long as it is an oscillation circuit which uses an electrostatic capacitance component (a capacitor C) of an actuator (including a diaphragm). For example, the oscillation circuit 11 may adopt a configuration which uses a LC oscillation circuit. In addition, the present embodiment is described using an example where a Schmitt trigger inverter is used, but there may be a configuration with, for example, a CR oscillation circuit which uses a three step inverter.

In the ink jet head 100 shown in FIG. 3, the electrostatic actuator 120 is configured so that the diaphragm 121 and segment electrodes 122 which are spaced at extremely small intervals (gaps) form opposing electrodes as described above. It is possible to consider the electrostatic actuator 120 as a parallel plate capacitor as shown in FIG. 17. When the electrostatic capacitance of the capacitor is C, each of the surface areas of the diaphragm 121 and the segment electrodes 122 are S, the distance (the length of the gap) between the two electrodes 121 and 122 is g, and the dielectric constant of the space (the gap) between the two electrodes is $\in$ (when the dielectric constant of the vacuum is co and the relative dielectric constant of the gap is $\in_r$, $\in = \in_0 \cdot \in_r$), the electrostatic capacitance C(x) of the capacitor (the electrostatic actuator 120) shown in FIG. 17 is expressed by the following formula.

Formula (4)

$$C(x) = \varepsilon_0 \cdot \varepsilon_r \frac{S}{g - x}(F) \tag{4}$$

Here, as shown in FIG. 17, x in formula (4) indicates the amount of displacement from a reference position of the diaphragm 121 which is generated due to the residual vibration of the diaphragm 121.

As is understood from formula (4), the electrostatic capacitance C(x) increases when the gap length g (gap length g−amount of displacement x) decreases, and conversely, the electrostatic capacitance C(x) decreases when the gap length g (gap length g−amount of displacement x) increases. In this manner, the electrostatic capacitance C(x) is inversely proportional to (gap length g−amount of displacement x) or (the gap length g in a case where x is 0). Here, in the electrostatic actuator 120 shown in FIG. 3, the relative dielectric constant $\in_r=1$ since the gap is filled with air.

In addition, typically, since the ink droplets (the ink dots) which are discharged are reduced in size as the resolution of the liquid droplet discharging apparatus (the ink jet printer 1 in the present embodiment) increases, the density of the electrostatic actuators 120 is increased in density and the electrostatic actuators 120 are made to be more compact. Due to this, a surface area S of the diaphragm 121 of the ink jet head 100 is reduced and the electrostatic actuator 120 is configured to be small. Furthermore, since the gap length g of the electrostatic actuator 120 which changes according to the residual vibration due to the discharging of the ink droplets is approximately 10% of an initial gap g0, the amount of change in the electrostatic capacitance of the electrostatic actuator 120 is an extremely small value as is understood from formula (4).

In order to detect the amount of change (which is different according to the vibration pattern of the residual vibration) in the electrostatic capacitance of the electrostatic actuator 120, the following method is used, that is, a method is used where the oscillation circuit in FIG. 18 is configured based on the electrostatic capacitance of the electrostatic actuator 120 and the frequency (the cycle) of the residual vibration is analyzed based on the oscillated signal. The oscillation circuit 11 shown in FIG. 18 is configured by a capacitor (C) which is configured by the electrostatic actuator 120, a Schmitt trigger inverter 111, and a resistance element (R) 112.

In a case where the output signal of the Schmitt trigger inverter 111 is a high level, the capacitor C is charged via the resistance element 112. When the charging voltage (the potential difference between the diaphragm 121 and the segment electrodes 122) of the capacitor C reaches an input threshold voltage VT+ of the Schmitt trigger inverter 111, the output signal of the Schmitt trigger inverter 111 is inverted to be low level. Then, when the output signal of the Schmitt trigger inverter 111 is a low level, the electrical charge which is charged in the capacitor C is discharged via the resistance element 112. When the voltage of the capacitor C reaches an input threshold voltage VT− of the Schmitt trigger inverter 111 due to discharging, the output signal of the Schmitt trigger inverter 111 is inverted again to be the high level. Then, the oscillation operation is repeated.

Here, in order to detect the changes in the time of the electrostatic capacitance of the capacitor C for each of the phenomena described above (mixing in of the air bubbles, drying, attaching of paper dust, and normal discharging), it is necessary to set the oscillation frequency according to the oscillation circuit 11 to an oscillation frequency where it is possible to detect the frequency when air bubbles are mixed in (refer to FIG. 10) where the frequency of the residual vibration is the highest. As a result, it is necessary for the oscillation frequency of the oscillation circuit 11 to be, for example, several times to several tens of times or more than the frequency of the residual vibration which is detected, that is, a frequency which is approximately ten times or more higher than the frequency when air bubbles are mixed in. In this case, since the frequency of the residual vibration when air bubbles are mixed in is a high frequency compared to the case of normal discharging, it is preferable if the residual vibration frequency when air bubbles are mixed in is set to an oscillation frequency which is able to be detected. If not, it is not possible to accurately detect the frequency of the residual vibration with regard to the phenomena of discharging abnormalities. As a result, the time constant of the CR of the oscillation circuit 11 is set according to the oscillation frequency in the present embodiment. In this manner, by setting the oscillation frequency of the oscillation circuit 11 to be high, it is possible to detect the residual vibration waveform more accurately based on minute changes in the oscillation frequency.

Here, for each cycle (pulse) of the oscillation frequency of the oscillation signal which is output from the oscillation circuit 11, the pulses are counted using a count pulse (counter) for measuring, and it is possible to obtain digital information for each oscillation frequency with regard to the residual vibration waveforms by subtracting the count amount of the pulses of the oscillation frequency, in the case of oscillating at the electrostatic capacitance of the capacitor C of the initial gap g0, from the count amount which is measured. By performing digital/analog (D/A) conversion based on the digital information, it is possible to generate a schematic residual vibration waveform. Such a method may be used, but it is necessary to have a high frequency (a high resolution) where it is possible to measure minute changes in the oscillation frequency in the count pulse (counter) for measuring. Since such a count pulse (counter) increases costs, the F/V conversion circuit 12 shown in FIG. 19 is used in the discharging abnormality detecting means 10.

Figure 19:
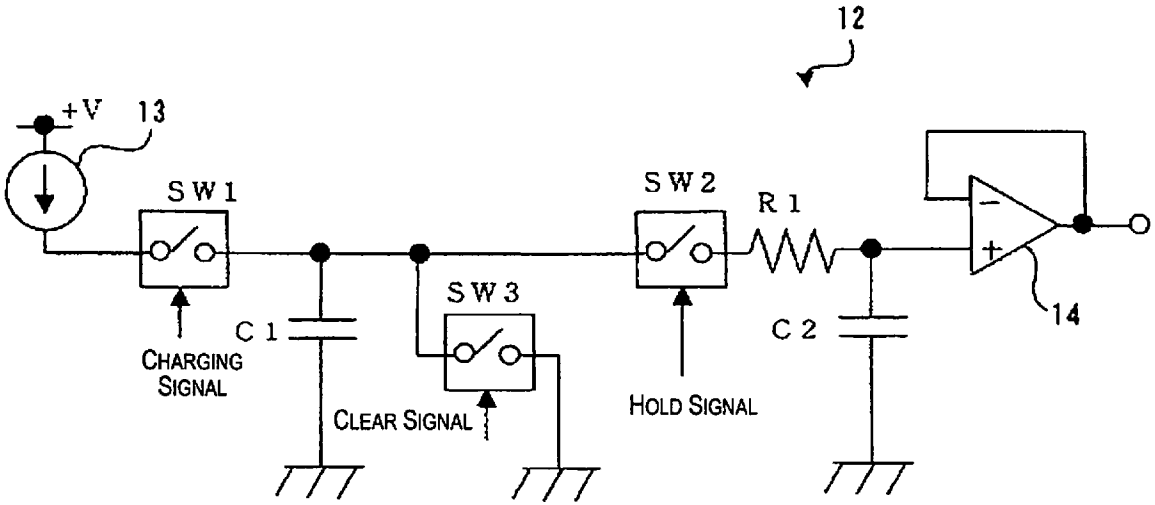
FIG. 19 is a circuit diagram of an F/V conversion circuit in the discharging abnormality detecting means shown in FIG. 16.

FIG. 19 is a circuit diagram of the F/V conversion circuit 12 in the discharging abnormality detecting means 10 shown in FIG. 16. As shown in FIG. 19, the F/V conversion circuit 12 is configured by three switches SW1, SW2, and SW3, two capacitors C1 and C2, a resistance element R1, a constant current source 13 which outputs a constant current Is, and a buffer 14. The operation of the F/V conversion circuit 12 will be described using the timing chart of FIG. 20 and the graph of FIG. 21.

Firstly, the method of generating a charging signal, a hold signal, and a clear signal shown in the timing chart of FIG. 20 will be described. A fixed time tr is set from the rising edge of an oscillation pulse of the oscillation circuit 11 and the charging signal is generated so as to be a high level during the fixed time tr. The hold signal is generated so as to rise in synchronization with the rising edge of the charging signal, to be held at the high level for a predetermined fixed time, and to fall to a low level. The clear signal is generated so as to rise in synchronization with the falling edge of the hold signal, to be held at the high level for a predetermined fixed time, and to fall to a low level. Here, as will be described later, since the movement of the electrical charge from the capacitor C1 to the capacitor C2 and the charging of the capacitor C1 are performed instantaneously, the pulses of the hold signal and the clear signal may each include one pulse up to the next rising edge of the output signal of the oscillation circuit 11 and are not limited to the rising edges and the falling edges as described above.

Figure 21:
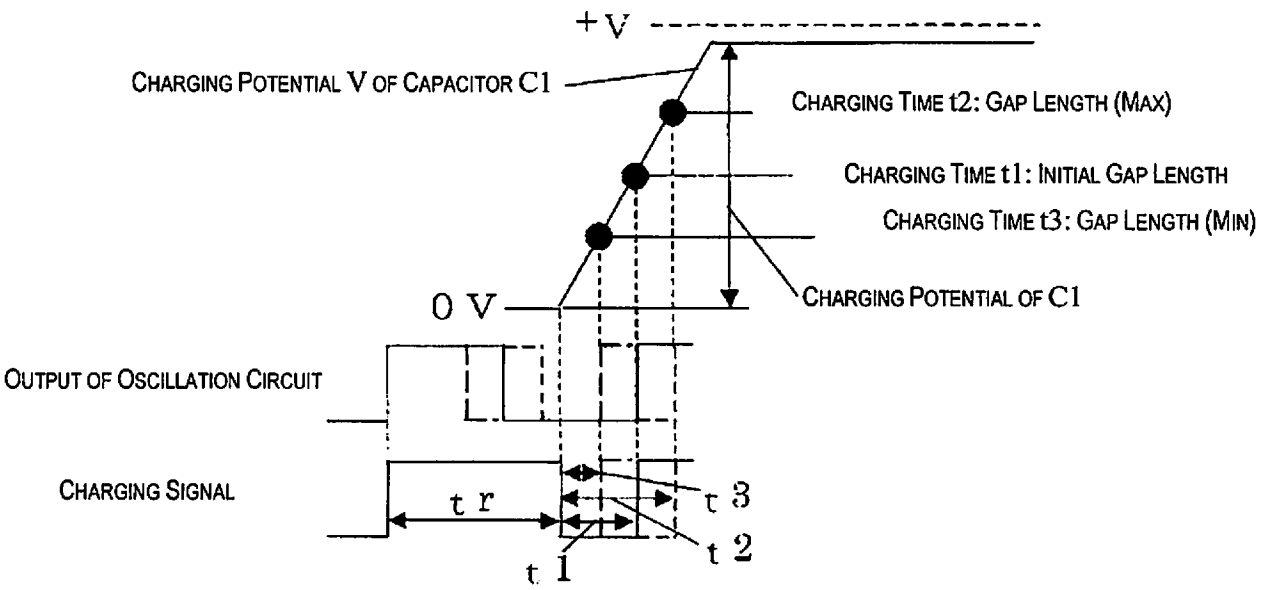
FIG. 21 is a diagram for describing a method for setting fixed times tr and t1.

The method of setting the fixed times tr and t1 in order to obtain a clean waveform (voltage waveform) of the residual vibration will be described with reference to FIG. 21. The fixed time tr is adjusted from the cycle of the oscillation pulse where the electrostatic actuator 120 oscillates at the electrostatic capacitance C at the time of the initial gap length g0 and the charging potential according to a charging time t1 is set so as to be in the vicinity of ½ of the charging range of C1. In addition, from a charging time t2 in the position where the gap length g is the maximum (Max) to the charging time t3 in the position where the gap length g is the minimum (Min), the slope of the charging potential is set so as not to exceed the charging range of the capacitor C1. That is, since the slope of the charging potential is determined according to dV/dt=Is/C1, it is sufficient to set the output constant current Is of the constant current source 13 to an appropriate value. By setting the output constant current Is of the constant current source 13 as high as possible within this range, it is possible to detect minute changes in the electrostatic capacitance of the capacitor which is configured by the electrostatic actuator 120 with high sensitivity and it is possible to detect minute changes in the diaphragm 121 of the electrostatic actuator 120.

Figure 22:
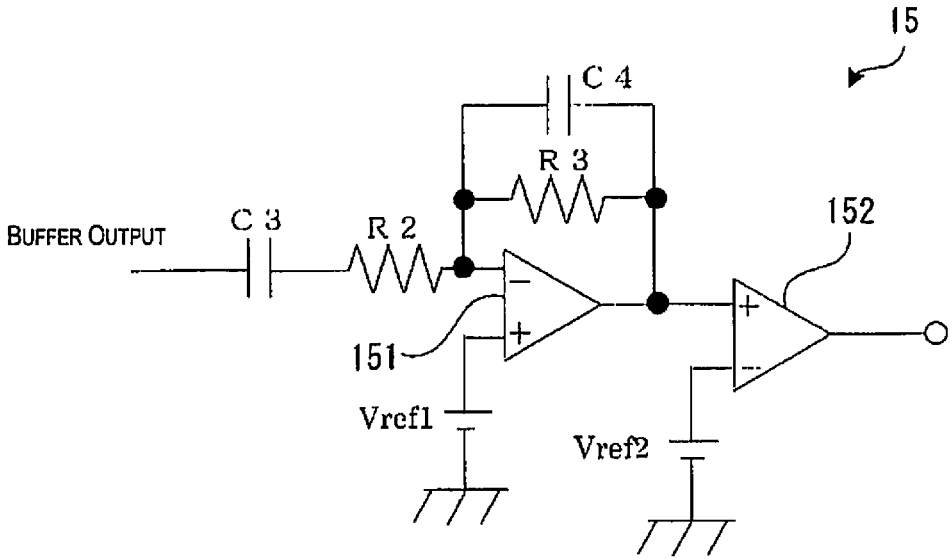
FIG. 22 is a circuit diagram illustrating a circuit configuration of a waveform shaping circuit in FIG. 16.

Next, the configuration of the waveform shaping circuit 15 shown in FIG. 16 will be described with reference to FIG. 22. FIG. 22 is a circuit diagram illustrating a circuit configuration of the waveform shaping circuit 15 in FIG. 16. The waveform shaping circuit 15 outputs a residual vibration waveform to the determining means 20 as a rectangular wave. As shown in FIG. 22, the waveform shaping circuit 15 is configured by two capacitors C3 (a DC component removing means) and C4, two resistance elements R2 and R3, two direct current voltage sources Vref1 and Vref2, an amplifier (an operational amplifier) 151, and a comparing device (a comparator) 152. Here, in the waveform shaping process of the residual vibration waveform, a configuration may be adopted so as to output the detected peak value as it is and measure the amplitude of the residual vibration waveform.

An electrostatic capacitance component of the DC component (direct current component) is included in the output from the buffer 14 of the F/V conversion circuit 12 based on the initial gap g0 of the electrostatic actuator 120. Since the direct current component varies according to each of the ink jet heads 100, the capacitor C3 removes the direct current component of the electrostatic capacitance. Then, the capacitor C3 removes the DC component in the output signal of the buffer 14 and outputs only the AC component of the residual vibration to an inverting input terminal of the operational amplifier 151.

The operational amplifier 151 configures a low pass filter for inverting and amplifying the output signal of the buffer 14 of the F/V conversion circuit 12 where the direct current component is removed and removing the high range of the output signal. Here, the operational amplifier 151 is assumed to be a single power source circuit. In the operational amplifier 151, an inverting amplifier is configured by two resistance elements R2 and R3, and the residual vibration (the alternating current component) which is input is amplified −R3/R2 times.

In addition, for the single power source operation of the operational amplifier 151, the amplified residual vibration waveform of the diaphragm 121 is output to vibrate centering on a potential which is set according to a direct current voltage source Vref1 which is connected with a non-inverting input terminal of the operational amplifier 151. Here, the direct current voltage source Vref1 is set to approximately ½ of the voltage range where it is possible to operate the operational amplifier 151 with a single power source. Furthermore, the operational amplifier 151 configures a low pass filter where a cut off frequency is $1/(2\pi\times C4\times R3)$ using the two capacitors C3 and C4. Then, as shown in the timing chart of FIG. 20, the residual vibration waveform of the diaphragm 121, which is amplified after the direct current component is removed, is compared with the potential of one more direct current voltage source Vref2 in the comparing device (comparator) 152 which is the next step and the comparison result is output from the waveform shaping circuit 15 as a rectangular waveform. Here, the direct current voltage source Vref2 may be used together with one more direct current voltage source Vref1.

Next, the operation of the F/V conversion circuit 12 and the waveform shaping circuit 15 of FIG. 19 will be described with reference to the timing chart shown in FIG. 20. The F/V conversion circuit 12 shown in FIG. 19 is operated based on the charging signal, the clear signal, and the hold signal which are generated as described above. In the timing chart of FIG. 20, when the driving signal of the electrostatic actuator 120 is input into the ink jet head 100 via the head driver 33, as shown in FIG. 6B, the diaphragm 121 of the electrostatic actuator 120 is drawn to the segment electrode 122 side, synchronizes with the falling edge of the driving signal, and rapidly contracts downward in FIGS. 6A to 6C (refer to FIG. 6C).

In synchronizing with the falling edge of the driving signal, a driving and detecting switch signal which switches between the driving circuit 18 and the discharging abnormality detecting means 10 is a high level. The driving and detecting switch signal is held at the high level during rest periods of driving of the corresponding ink jet head 100 and is the low level before the next driving signal is input. While the driving and detecting switch signal is the high level, the oscillation circuit 11 of FIG. 18 oscillates while changing the oscillation frequency to correspond to the residual vibration of the diaphragm 121 of the electrostatic actuator 120.

As described above, from the falling edge of the driving signal, that is, the rising edge of the output signal of the oscillation circuit 11, to the elapsing of the fixed time tr, which is set in advance such that the waveform of the residual vibration does not exceed a range where it is possible to charge the capacitor C1, the charging signal is held at a high level. Here, while the charging signal is the high level, the switch SW1 is in an off state.

When the fixed time tr passes and the charging signal is the low level, the switch SW1 is turned on in synchronization with the falling edge of the charging signal (refer to FIG. 19). Then, the constant current source 13 and the capacitor C1 are connected and the capacitor C1 is charged at a gradient Is/C1 as described above. The capacitor C1 is charged during the period where the charging signal is a low level, that is, until the charging signal is the high level in synchronization with the rising edge of the next pulse of the output signal of the oscillation circuit 11.

When the charging signal is a high level, the switch SW1 is turned off (open) and the constant current source 13 and the capacitor C1 are disconnected. At this time, the potential which is charged in the period t1 where the charging signal was the low level (that is, ideally Is×t1/C1(V)) is saved in the capacitor C1. In this state, when the hold signal is a high level, the switch SW 2 is turned on (refer to FIG. 19) and the capacitor C1 and the capacitor C2 are connected via the resistance element R1. After connecting the switch SW2, the electrical charge is moved from the capacitor C1 to the capacitor C2 such that the potential difference in the two capacitors C1 and C2 is substantially equal by performing mutual charging and discharging according to the charging potential difference of the two capacitors C1 and C2.

Here, the electrostatic capacitance of the capacitor C2 is set at approximately 1/10 or less with regard to the electrostatic capacitance of the capacitor C1. As a result, the amount of the electrical charge, which is moved (used) by the charging and discharging which is generated by the potential difference between the two capacitors C1 and C2, is 1/10 or less of the electric charge which is charged in the capacitor C1. Accordingly, the potential difference of the capacitor C1 does not change much (does not decrease much) even after the electrical charge is moved from the capacitor C1 to the capacitor C2. Here, a primary low pass filter is configured by the resistance element R1 and the capacitor C2 in the F/V conversion circuit 12 of FIG. 19 so that the charging potential does not rapidly jump upward due to the inductance or the like of the wiring of the F/V conversion circuit 12 when the capacitor C2 is charged.

After a charging potential which is substantially equal to the charging potential of the capacitor C1 is held in the capacitor C2, the hold signal is the low level and the capacitor C1 is disconnected from the capacitor C2. Furthermore, by the clear signal being the high level and the switch SW3 being turned on, a discharging operation is performed such that the capacitor C1 is connected with a ground GND and the electrical charge which is stored in the capacitor C1 is zero. By the clear signal becoming the low level and the switch SW3 being turned off after the discharging of the capacitor C1, the electrode of the upper section of the capacitor C1 in FIG. 19 is disconnected from the ground GND and is on standby until the next charging signal is input, that is, until the charging signal is the low level.

The potential which is held in the capacitor C2 is updated for each of the timings where the charging signal is rising, that is, for each of the timings where the charging to the capacitor C2 is complete, and is output to the waveform shaping circuit 15 of FIG. 22 via the buffer 14 as the residual vibration waveform of the diaphragm 121. Accordingly, when the electrostatic capacitance of the electrostatic actuator 120 (in this case, it is necessary to consider the variation range of the electrostatic capacitance due to the residual vibration) and the resistance value of the resistance element 112 are set so that the oscillation frequency of the oscillation circuit 11 does not increase, it is possible to detect the temporal changes in the electrostatic capacitance due to the residual vibration of the diaphragm 121 in more detail since each of the steps (the stages) of the potential (the output from the buffer 14) of the capacitor C2 which are shown in the timing chart in FIG. 20 are more detailed.

Below, in the same manner, the charging signal is repeatedly changed from low level to high level to low level . . . , and the potential which is held in the capacitor C2 is output to the waveform shaping circuit 15 via the buffer 14 at the predetermined timings described above. In the waveform shaping circuit 15, the direct current component of the voltage signal (the potential of the capacitor C2 in the timing chart in FIG. 20) which is input from the buffer 14 is removed by the capacitor C3 and input into the inverting input terminal of the operational amplifier 151 via the resistance element R2. The alternating current (AC) component of the residual vibration which is input is inverted and amplified by the operational amplifier 151 and output to one input terminal of the comparator 152. The comparator 152 compares a potential (a reference voltage) which is set by the direct current voltage source Vref2 in advance and a potential of the residual vibration waveform (alternating current component) and outputs a rectangular wave (the output from the comparison circuit in the timing chart of FIG. 20).

Figure 23:
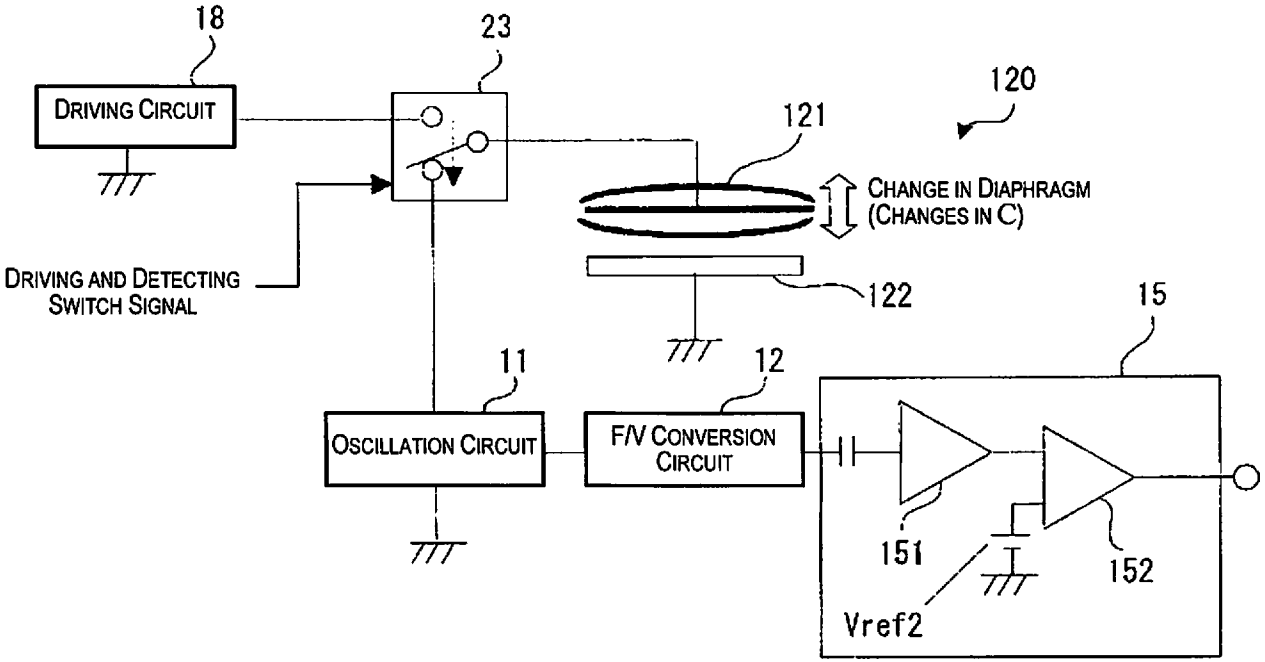
FIG. 23 is a block diagram illustrating a schematic of a switching means for a driving circuit and a detecting circuit.

Next, the switching timing between the ink droplet discharging operation (driving) and the discharging abnormality detection operation (driving rest) of the ink jet head 100 will be described. FIG. 23 is a block diagram illustrating a schematic of the switching means 23 of the driving circuit 18 and the discharging abnormality detecting means 10. Here, in FIG. 23, the driving circuit 18 inside the head driver 33 shown in FIG. 16 will be described as the driving circuit of the ink jet head 100. As shown in the timing chart of FIG. 20, the discharge abnormality detecting process is executed between the driving signals of the ink jet head 100, that is, in a driving rest period.

In FIG. 23, in order to drive the electrostatic actuator 120, the switching means 23 is initially connected with the driving circuit 18 side. As described above, when a driving signal (a voltage signal) is input from the driving circuit 18 to the diaphragm 121, the electrostatic actuator 120 is driven, and the diaphragm 121 is drawn to the segment electrode 122 side and starts vibrating (residual vibration) by being rapidly displaced in a direction away from the segment electrode 122 when the applied voltage is 0. At this time, ink droplets are discharged from the nozzles 110 of the ink jet head 100.

When the pulse of the driving signal falls, the driving and detecting switch signal (refer to the timing chart in FIG. 20) is input into the switching means 23 in synchronization with the falling edge of the driving signal, the switching means 23 is switched from the driving circuit 18 to the discharging abnormality detecting means (the detection circuit) 10 side, and the electrostatic actuator 120 (used as a capacitor of the oscillation circuit 11) is connected with the discharging abnormality detecting means 10.

Then, the discharging abnormality detecting means 10 executes a discharging abnormality (missing dots) detecting process as described above, and the residual vibration waveform data (rectangular wave data) of the diaphragm 121 which is output from the comparing device 152 of the waveform shaping circuit 15 is converted into numerals as the cycle, the amplitude, and the like of the residual vibration waveform by the measuring means 17. In the present embodiment, the measuring means 17 measures the specific vibration cycle from the residual vibration waveform data and outputs the measurement result (numerical values) to the determining means 20.

In detail, in order to measure the time from the initial rising edge of the waveform (rectangular wave) of the output signal of the comparing device 152 to the next rising edge (which is the cycle of the residual vibration), the measuring means 17 counts the pulses of the reference signal (a predetermined frequency) using a counter which is not shown in the diagram and measures the cycle (the specific vibration cycle) of the residual vibration from the counted value. Here, the measuring means 17 may measure the time from the initial rising edge to the next falling edge and output a time which is twice the measured time to the determining means 20 as the cycle of the residual vibration. Below, the cycle of the residual vibration which is obtained in this manner is set as Tw.

The determining means 20 determines the presence or absence of discharging abnormalities in the nozzles, the cause of the discharging abnormalities, the comparative deviation amount, and the like based on the specific vibration cycle and the like of the residual vibration waveform measured by the measuring means 17 (the measurement result) and outputs the determination result to the control section 6. The control section 6 saves the determination result in a predetermined data holding region of the EEPROM (storage means) 62. Then, at the timing when the next driving signal is input from the driving circuit 18, the driving and detecting switch signal is input again to the switching means 23, and the driving circuit 18 and the electrostatic actuator 120 are connected. Since the driving circuit 18 is maintained at the ground (GND) level when a driving voltage is applied once, switching as described above is performed by the switching means 23 (refer to the timing chart of FIG. 20). Due to this, it is possible to accurately detect the residual vibration waveform of the diaphragm 121 of the electrostatic actuator 120 without being affected by disturbances or the like from the driving circuit 18.

Here, in the present invention, the residual vibration waveform data is not limited to data formed into a rectangular wave by the comparing device 152. For example, there may be a configuration where the residual vibration amplitude data which is output from the operational amplifier 151 is converted into numerals as necessary by the measuring means 17 which performs A/D conversion without a comparing process being performed by the comparing device 152, the presence or absence and the like of discharging abnormalities is determined by the determining means 20 based on the data which is converted into numerals, and the determination result is stored in the storage means 62.

In addition, since the meniscus (the surface where the ink inside the nozzle 110 comes into contact with air) of the nozzle 110 vibrates in synchronization with the residual vibration of the diaphragm 121, the ink jet head 100 performs the next discharging operation after waiting for the attenuation of the residual vibration of the meniscus after the discharging operation of the ink droplets for a period of time which is substantially determined according to the acoustic resistance r (being on standby for a predetermined time). In the present invention, since the residual vibration of the diaphragm 121 is detected by effectively using the standby time, it is possible to perform discharging abnormality detection which does not affect the driving of the ink jet heads 100. That is, it is possible to execute the discharge abnormality detecting process of the nozzles 110 of the ink jet head 100 without decreasing throughput of the ink jet printer 1 (the liquid droplet discharging apparatus).

As described above, since the frequency is increased compared to the residual vibration waveform of the diaphragm 121 during normal discharging in a case where the air bubbles are mixed inside the cavities 141 of the ink jet head 100, the cycle is conversely shorter than the cycle of the residual vibration during normal discharging. In addition, since the residual vibration is excessively attenuated and the frequency is considerably lower compared to the residual vibration waveform during normal discharging in a case where the ink in the vicinity of the nozzles 110 thickens due to drying and is fixed, the cycle is much longer than the cycle of the residual vibration during normal discharging. In addition, since the frequency of the residual vibration is lower than the frequency of the residual vibration during normal discharging but higher than the frequency of the residual vibration when the ink is dry in a case where the paper dust is attached to the vicinity of the outlet ports of the nozzles 110, the cycle is longer than then cycle of the residual vibration during normal discharging and the shorter than the cycle of the residual vibration when the ink is dry.

Accordingly, a predetermined range Tr is provided as the cycle of the residual vibration during normal discharging, and in addition, it is possible to determine the cause of the discharging abnormalities of the ink jet head 100 by setting a predetermined threshold (a predetermined threshold value) T1 in order to distinguish the cycle of the residual vibration in a case where the paper dust is attached to the nozzle 110 outlet port and the cycle of the residual vibration in a case where the ink is dried in the vicinity of the outlet ports of the nozzles 110. The determining means 20 determines whether or not the cycle Tw of the residual vibration waveform which is detected by the discharge abnormality detecting process described above is a cycle in the predetermined range or whether or not the cycle Tw is longer than the predetermined threshold, thereby determining the cause of the discharging abnormality.

Figure 24:
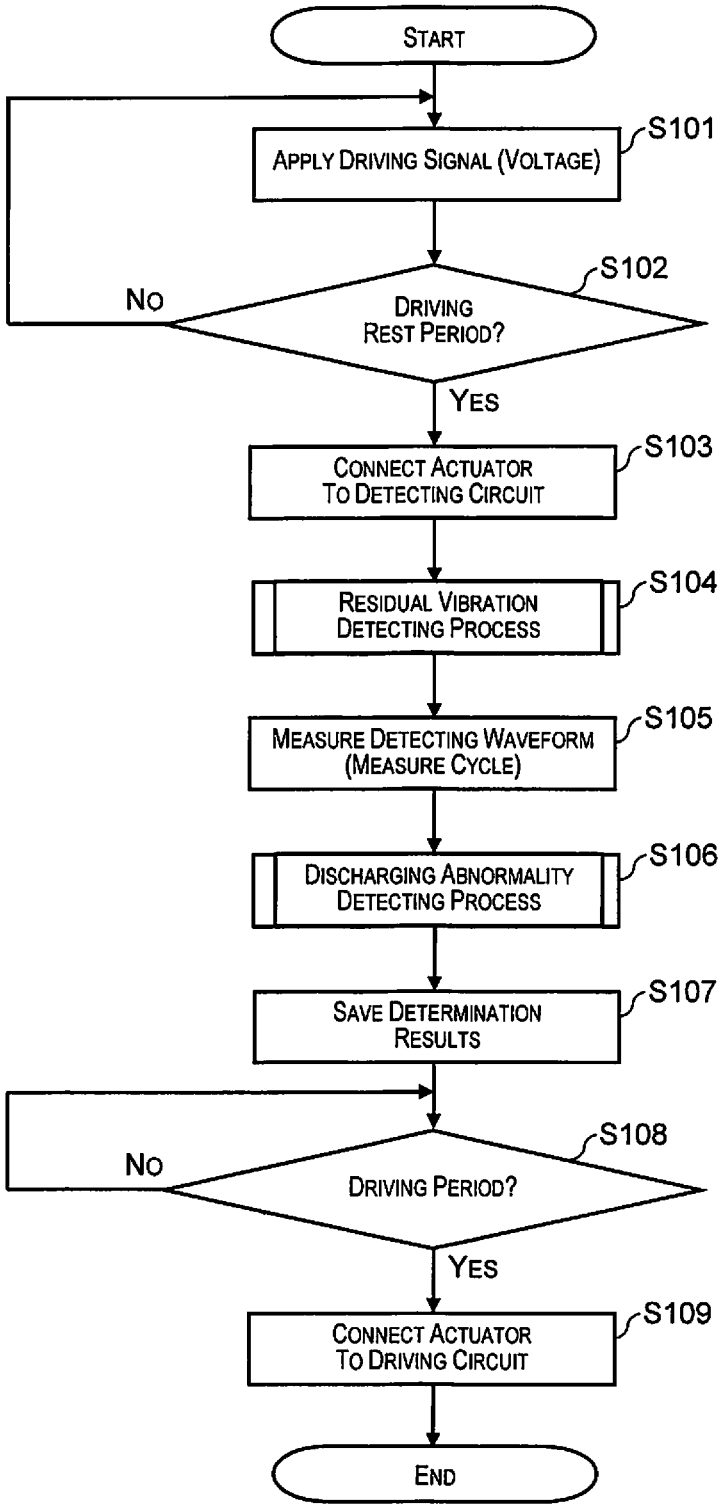
FIG. 24 is a flow chart illustrating a discharge abnormality detecting and determining process.

Next, the operation of the liquid droplet discharging apparatus of the present invention will be described based on the configuration of the ink jet printer 1 described above. Firstly, the discharge abnormality detecting process (including the driving and detecting switch process) will be described with regard to one of the nozzles 110 of the ink jet head 100. FIG. 24 is a flow chart illustrating a discharge abnormality detecting and determining process. When the printing data (or the discharge data in a flushing operation) to be printed is input into the control section 6 from the host computer 8 via the interface (IF) 9, the discharge abnormality detecting process is executed at a predetermined timing. Here, for convenience of description, a discharge abnormality detecting process, which corresponds to the discharging operation of one of the ink jet heads 100, that is, one of the nozzles 110, is shown in the flow chart shown in FIG. 24.

Figure 20:
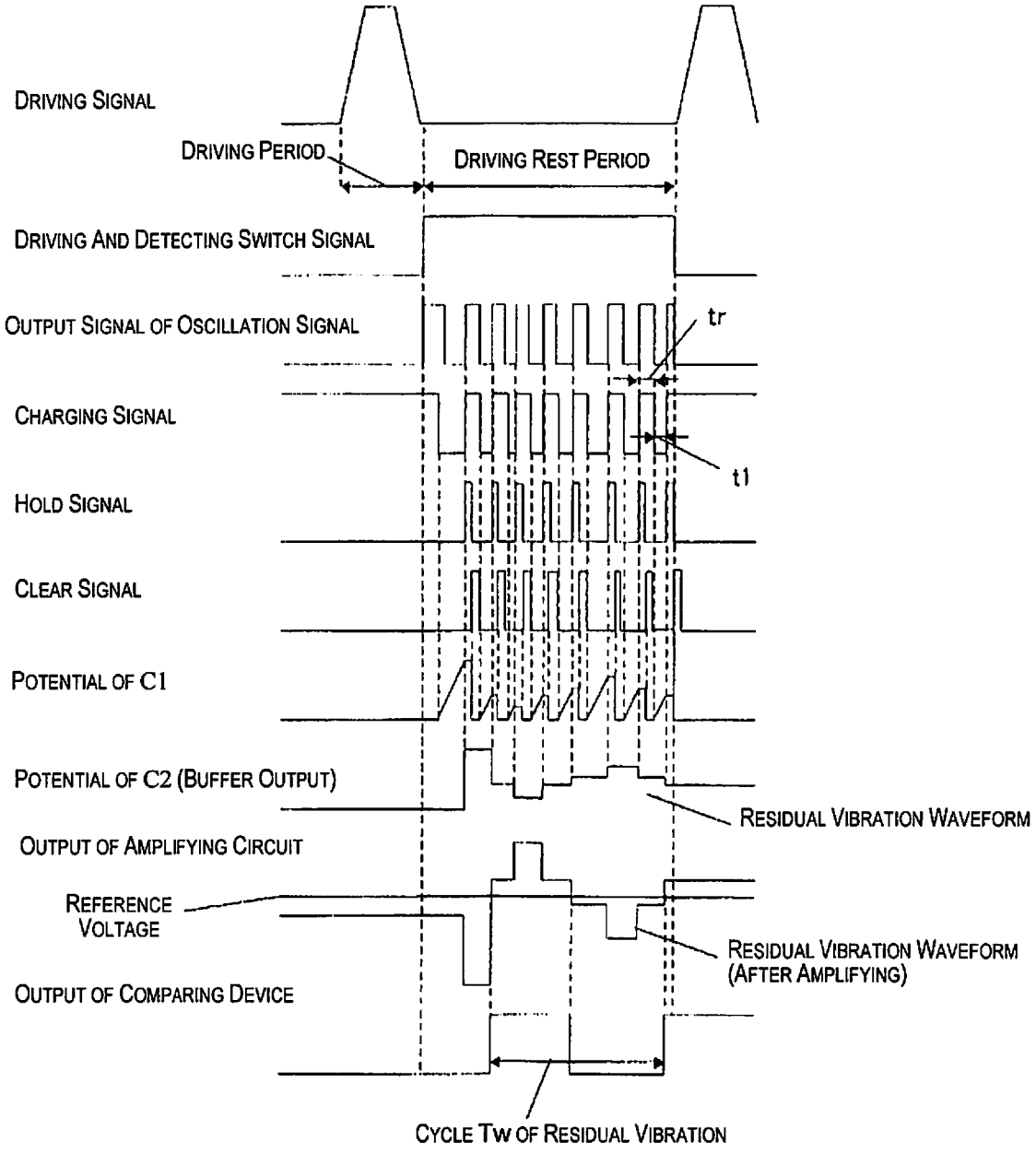
FIG. 20 is a timing chart illustrating timing for an output signal and the like for each of the sections based on the oscillation frequency which is output from the oscillation circuit.

Firstly, a driving signal which corresponds to the printing data (the discharge data) is input from the driving circuit 18 of the head driver 33, and due to this, the driving signal (the voltage signal) is applied between both of the electrodes of the electrostatic actuator 120 based on the timing of the driving signal (step S101) as shown in the timing chart of FIG. 20. Then, the control section 6 determines whether or not the ink jet head 100 which is discharging is in the driving rest period based on the driving and detecting switch signal (step S102). Here, the driving and detecting switch signal is the high level in synchronization with the falling edge of the driving signal (refer to FIG. 20) and is input from the control section 6 to the switching means 23.

When the driving and detecting switch signal is input into the switching means 23, the electrostatic actuator 120, that is, the capacitor which configures the oscillation circuit 11 is disconnected from the driving circuit 18 and connected with the discharging abnormality detecting means 10 (detection circuit) side, that is, the oscillation circuit 11 of the residual vibration detecting means 16 by the switching means 23 (step S103). Then, a residual vibration detecting process which will be described later is executed (step S104) and the measuring means 17 measures a predetermined numerical value from the residual vibration waveform data which is detected in the residual vibration detecting process (step S105). Here, the measuring means 17 measures the cycle of the residual vibration from the residual vibration waveform data as described above.

Next, based on the measuring result of the measuring means, a discharge abnormality detecting process which will be described later is executed by the determining means 20 (step S106) and the determination result is saved in a predetermined holding region of the EEPROM (the storage means) 62 in the control section 6. Then, it is determined whether or not the ink jet head 100 is in the driving period in step S108. That is, it is determined whether or not the driving rest period is finished and the next driving signal is input, and standby is continued in step S108 until the next driving signal is input.

When the driving and detecting switch signal is the low level in synchronization with the rising edge of the driving signal at the timing when the pulse of the next driving signal is input ("yes" in step S108), the switching means 23 finishes the discharge abnormality detecting process by switching the connection with the electrostatic actuator 120 from the discharging abnormality detecting means (the detection circuit) 10 to the driving circuit 18 (step S109).

Here, in the flow chart shown in FIG. 24, a case is shown where the measuring means 17 measures the cycle from the residual vibration waveform which is detected by the residual vibration detecting process (the residual vibration detecting means 16), but the present invention is not limited to such a case and the measuring means 17 may, for example, perform measuring of the phase difference, the amplitude, or the like of the residual vibration waveform from the residual vibration waveform data which is detected in the residual vibration detecting process.

Figure 25:
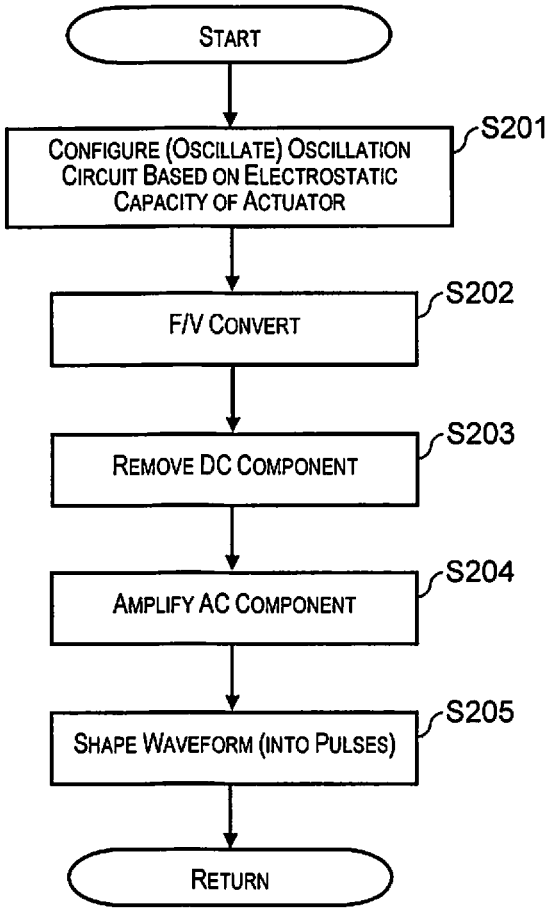
FIG. 25 is a flow chart illustrating a residual vibration detecting process.

Next, the residual vibration detecting process (the sub-routine) in step S104 in the flow chart shown in FIG. 24 will be described. FIG. 25 is a flow chart illustrating a residual vibration detecting process. As described above, when the electrostatic actuator 120 and the oscillation circuit 11 are connected by the switching means 23 (step S103 in FIG. 24), the oscillation circuit 11 configures a CR oscillation circuit and oscillates based on changes in the electrostatic capacitance of the electrostatic actuator 120 (the residual vibration of the diaphragm 121 of the electrostatic actuator 120) (step S201).

As shown in the timing chart and the like described above, the charging signal, the hold signal, and the clear signal are generated in the F/V conversion circuit 12 based on the output signal (the pulse signal) of the oscillation circuit 11, an F/V conversion process, where conversion is carried out from the frequency of the output signal of the oscillation circuit 11 to a voltage, is performed by the F/V conversion circuit 12 based on these signals (step S202), and the residual vibration waveform data on the diaphragm 121 is output from the F/V conversion circuit 12. In the residual vibration waveform data which is output from the F/V conversion circuit 12, the DC component (the direct current component) is removed by the capacitor C3 of the waveform shaping circuit 15 (step S203), and the residual vibration waveform (the AC component) where the DC component is removed is amplified by the operational amplifier 151 (step S204).

The residual vibration waveform data after amplification is shaped into a waveform by a predetermined process and formed into a pulse (step S205). That is, a voltage value (a predetermined voltage value) which is set by the direct current voltage source Vref2 and the output voltage of the operational amplifier 151 are compared in the comparing device 152 in the present embodiment. The comparing device 152 outputs a binarized waveform (a rectangular wave) based on the comparison result. The output signal of the comparing device 152 is the output signal of the residual vibration detecting means 16, and the output signal of the comparing device 152 is output to the measuring means 17 in order to perform the discharge abnormality detecting process and the residual vibration detecting process is finished.

Figure 26:
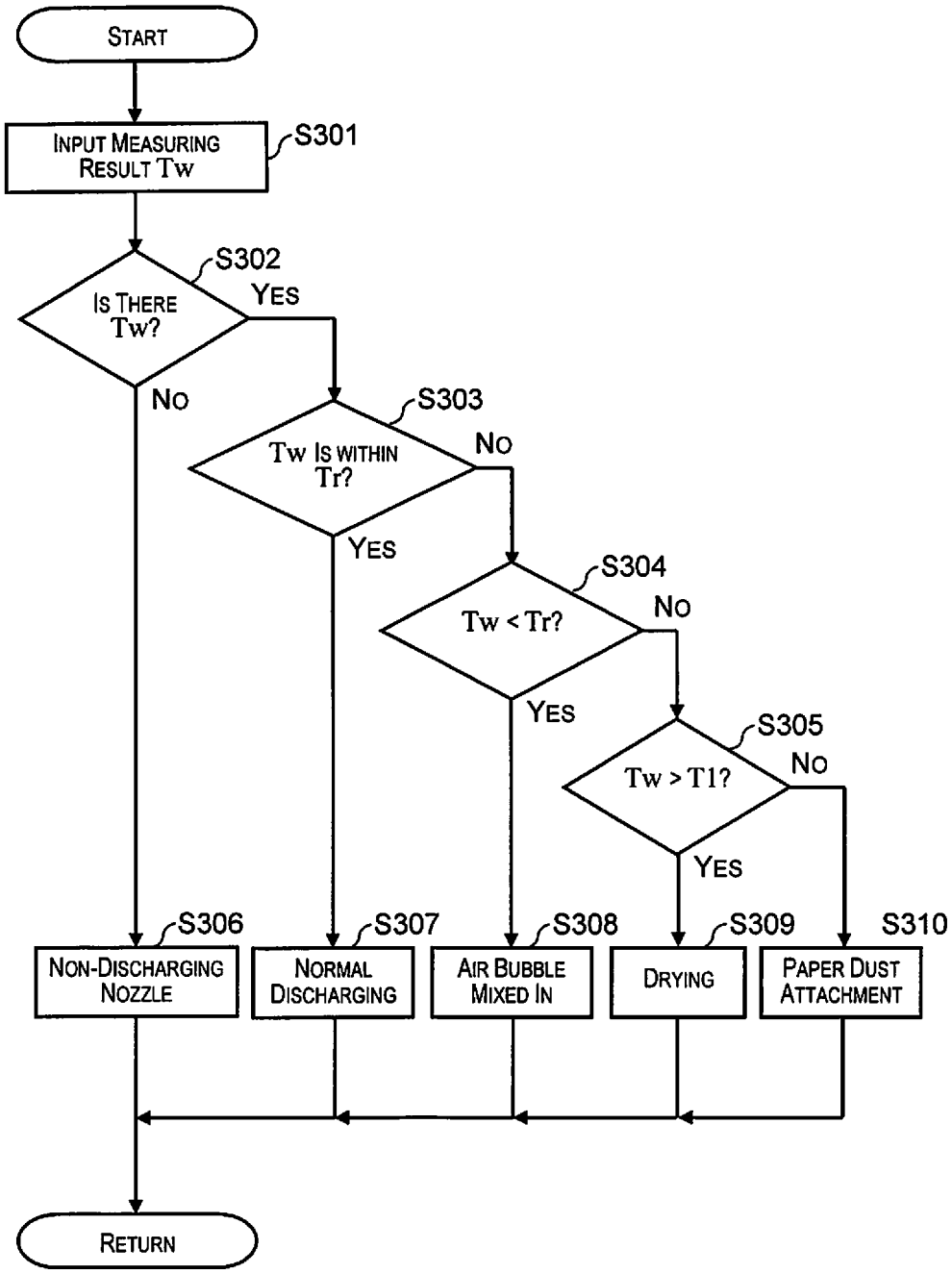
FIG. 26 is a flow chart illustrating a discharge abnormality determining process.

Next, the discharge abnormality detecting process (the sub-routine) in step S106 in the flow chart shown in FIG. 24 will be described. FIG. 26 is a flow chart illustrating a discharge abnormality determining process which is executed by the control section 6 and the determining means 20. Based on the measured data (the measuring result) of the cycle or the like which is measured by the measuring means 17 described above, the determining means 20 determines whether or not the ink droplets are discharged normally from the relevant ink jet head 100 and, in a case where the ink droplets are not discharged normally, that is, in the case of a discharge abnormality, determines the cause of the discharge abnormality.

Firstly, the control section 6 outputs the predetermined range Tr of the cycle of the residual vibration and the predetermined threshold T1 of the cycle of the residual vibration, which are stored in the EEPROM 62, to the determining means 20. The predetermined range Tr of the cycle of the residual vibration has a permitted range which is able to be determined as normal with regard to the residual vibration cycle during normal discharging. The data is held in a memory (which is not shown in the diagram) of the determining means 20 and the following processes are performed.

The measurement result, which is measured by the measuring means 17 in step S105 in FIG. 24, is input into the determining means 20 (step S301). Here, the measurement result in the present embodiment is the cycle Tw of the residual vibration of the diaphragm 121.

In step S202, the determining means 20 determines whether or not the cycle Tw of the residual vibration exists, that is, whether or not it was not possible to obtain the residual vibration waveform data using the discharging abnormality detecting means 10. In a case where it is determined that the cycle Tw of the residual vibration does not exist, the determining means 20 determines that the nozzle 110 of the ink jet head 100 is a non-discharging nozzle where the ink droplets are not discharged in the discharging abnormality detecting process (step S306). In addition, in a case where it is determined that the residual vibration waveform data exists, subsequently, the determining means 20 determines in step S303 whether or not the cycle Tw is within the predetermined range Tr which is recognized as the cycle during normal discharging.

A case where it is determined that the cycle Tw of the residual vibration is within the predetermined range Tr has the meaning that the ink droplets are normally discharged from the corresponding ink jet head 100, and the determining means 20 determines that the nozzle 110 of the ink jet head 100 discharged the ink droplets normally (normal discharge) (step S307). In addition, in a case where it is determined that the cycle Tw of the residual vibration is not within the predetermined range Tr, subsequently, the determining means 20 determines in step S304 whether or not the cycle Tw of the residual vibration is shorter than the predetermined range Tr.

A case where it is determined that the cycle Tw of the residual vibration is shorter than the predetermined range Tr has the meaning that the frequency of the residual vibration is high and it is thought that air bubbles are mixed inside the cavity 141 of the ink jet head 100 as described above, and the determining means 20 determines that air bubbles are mixed (mixing in of the air bubbles) into the cavity 141 of the ink jet head 100 (step S308).

In addition, in a case where it is determined that the cycle Tw of the residual vibration is longer than the predetermined range Tr, subsequently, the determining means 20 determines whether or not the cycle Tw of the residual vibration is longer than the predetermined threshold T1 (step S305). In a case where it is determined that the cycle Tw of the residual vibration is longer than the predetermined threshold T1, it is thought that the residual vibration is excessively attenuated, and the determining means 20 determines that the ink in the vicinity of the nozzle 110 of the ink jet head 100 has thickened due to drying (drying) (step S309).

Then, in a case where it is determined that the cycle Tw of the residual vibration is shorter than the predetermined threshold T1 in step S305, the cycle Tw of the residual vibration is a value in a range where $Tr<Tw<T1$ is satisfied and it is thought that paper dust is attached to the vicinity of the outlet port of the nozzle 110 where the frequency is higher due to drying as described above, and the determining means 20 determines that paper dust is attached to the vicinity of the outlet port of the nozzle 110 of the ink jet head 100 (paper dust attachment) (step S310).

In this manner, when the normal discharging of the ink jet head 100 which is a target or the cause or the like of the abnormal discharging is determined by the determining means 20 (step S306 to S310), the determination result is output to the control section 6 and the discharge abnormality detecting process finishes.

Next, assuming the ink jet printer 1 which is provided with the plurality of ink jet heads (liquid droplet discharging heads) 100, that is, the plurality of nozzles 110, a discharge selecting means (nozzle selector) 182 in the ink jet printer 1 and the timing of the discharging abnormality detecting and determining for each of the ink jet heads 100 will be described.

Here, to simplify the description, one of the head units 35 from out of the plurality of head units 35 which are provided in the printing means 3 will be described later, and in addition, the head unit 35 is provided with five ink jet heads 100*a* to 100*e* (that is, five of the nozzles 100 are provided), but the quantity of the head units 35 which are provided in the printing means 3 and the quantity of the ink jet heads 100 (the nozzles 110) which are provided in each of the head units 35 in the present invention may each be any number.

FIG. 27 to FIG. 30 are block diagrams illustrating several examples of the discharging abnormality detecting and determining timing in the ink jet printer 1 which is provided with the discharge selecting means 182. Below, the configuration examples of each of the diagrams will be described in order.

Figure 27:
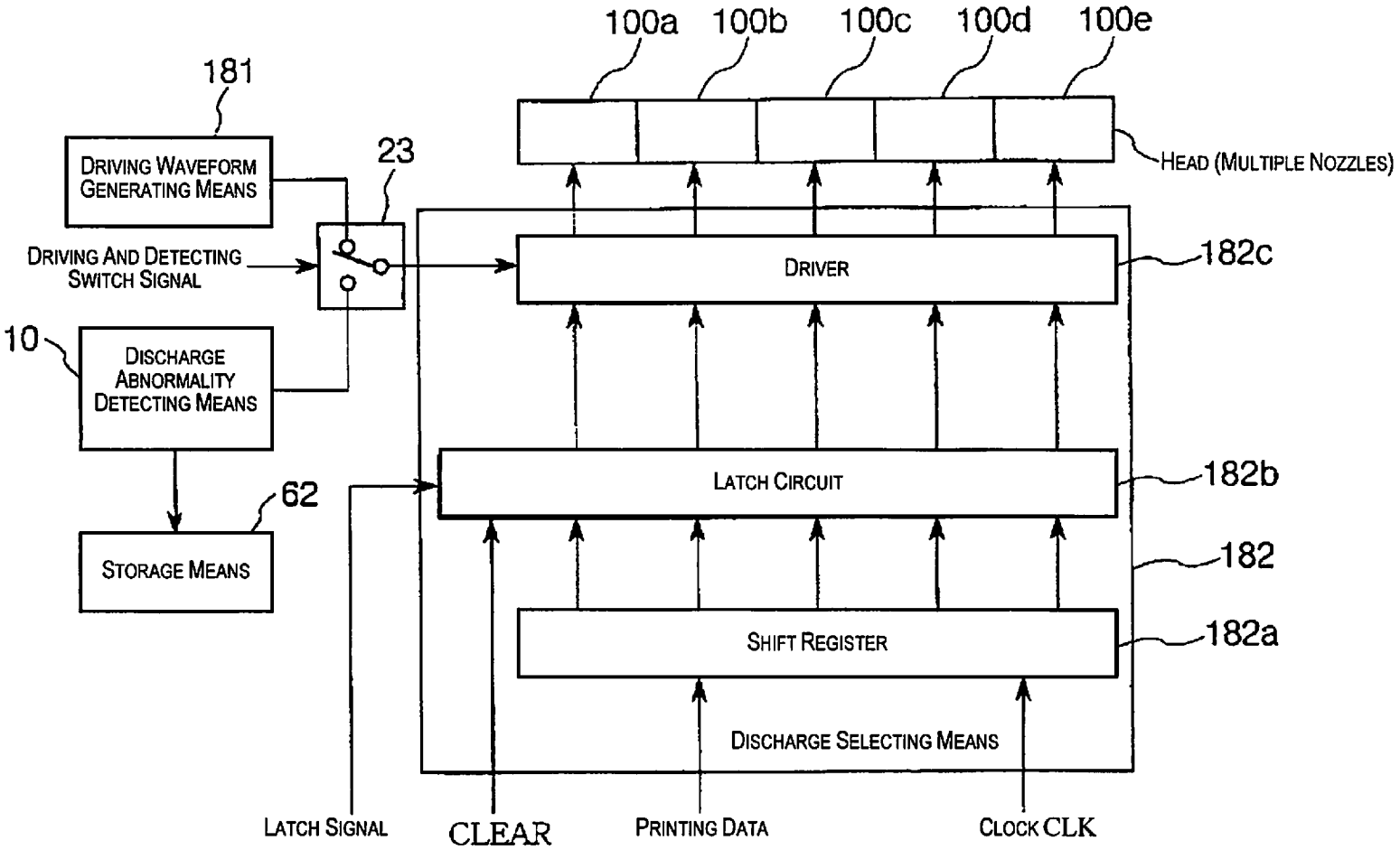
FIG. 27 is an example of the timing of detecting of discharge abnormalities in a plurality of ink jet heads (in a case where there is one discharge abnormality detecting means).

FIG. 27 is an example of the timing of detecting of discharging abnormalities in the plurality (five) of the ink jet heads 100*a* to 100*e* (in a case where there is the one discharging abnormality detecting means 10). As shown in FIG. 27, the ink jet printer 1 which has the plurality of ink jet heads 100*a* to 100*e* is provided with a driving waveform generating means 181 which generates a driving waveform, the discharge selecting means 182 which is able to select whether ink droplets are discharged from any of the nozzles 110, and the plurality of ink jet heads 100*a* to 100*e* which are selected by the discharge selecting means 182 and driven by the driving waveform generating means 181. Here, in the configuration of FIG. 27, since the configuration other than the configuration described above is the same as shown in FIG. 2, FIG. 16, and FIG. 23, description will be omitted.

Here, the driving waveform generating means 181 and the discharge selecting means 182 in the present embodiment will be described as included in the driving circuit 18 of the head driver 33 (shown as two blocks via the switching means 23 in FIG. 27, but both are typically configured inside the head driver 33), but the present invention is not limited to this configuration, and for example, the driving waveform generating means 181 may be configured to be independent of the head driver 33.

As shown in FIG. 27, the discharge selecting means 182 is provided with a shift register 182*a*, a latch circuit 182*b*, and a driver 182*c*. Printing data (discharge data), which is output from the host computer 8 shown in FIG. 2 and processed in a predetermined manner in the control section 6, and a clock signal (CLK) are input in sequence to the shift register 182*a*. The printing data is shifted and input from the initial step of the shift register 182*a* to the next step in the sequence according to the input pulse of the clock signal (CLK) (each time the clock signal is input) and output to the latch circuit 182*b* as printing data which corresponds to each of the ink jet heads 100*a* to 100*e*. Here, in the discharging abnormality detecting process which will be described later, discharge data during flushing (preliminary discharging) is input instead of the printing data, but the discharge data has the meaning of printing data with regard to all of the ink jet heads 100*a* to 100*e*. Here, during flushing, there may be processing using hardware such that the output from all of the output from the latch circuit 182*b* is set as a value to be discharged.

The latch circuit 182*b* latches each of the output signals of the shift register 182*a* according to the latch signals which are input after the printing data, which corresponds to the number of the nozzles 110 of the head unit 35, that is, the number of the ink jet heads 100, is held in the shift register 182*a*. Here, in a case where a CLEAR signal is input, the latch state is released, the output signal of the shift register 182*a* which was latched is 0 (the latch output is stopped) and the printing operation is stopped. In a case where the CLEAR signal is not input, the printing data in the shift register 182*a* which is latched is output to the driver 182*c*. After the printing data which is output from the shift register 182*a* is latched by the latch circuit 182*b*, the next printing data is input into the shift register 182*a* and the latch signal of the latch circuit 182*b* is updated in sequence in accordance with the print timing.

The driver 182*c* connects the driving waveform generating means 181 and the electrostatic actuators 120 of each of the ink jet heads 100, inputs an output signal (driving signal) of the driving waveform generating means 181 to each of the electrostatic actuators 120 (any or all of the electrostatic actuators 120 of the ink jet heads 100*a* to 100*e*) which are designated (specified) by the latch signal which is output from the latch circuit 182*b*, and due to this, the driving signal (the voltage signal) is applied between both electrodes of the electrostatic actuators 120.

The ink jet printer 1 shown in FIG. 27 is provided with the one driving waveform generating means 181 which drives the plurality of ink jet heads 100*a* to 100*e*, the discharging abnormality detecting means 10 which detects discharging abnormalities (non-discharging of the ink droplets) with regard to any of the ink jet heads 100 of each of the ink jet heads 100*a* to 100*e*, the storage means 62 which saves (holds) the determination results of the causes or the like of the discharging abnormalities which are obtained by the discharging abnormality detecting means 10, and the one switching means 23 which switches between the driving waveform generating means 181 and the discharging abnormality detecting means 10. Accordingly, the ink jet printer 1 drives one or a plurality out of the ink jet heads 100*a* to 100*e* which are selected by the driver 182*c* based on the driving signal which is input from the driving waveform generating means 181, and after the switching means 23 switches the connection with the electrostatic actuator 120 of the ink jet head 100 from the driving waveform generating means 181 to the discharging abnormality detecting means 10 by the driving and detecting switch signal being input into the switching means 23 after the discharging driving operation, discharging abnormalities (non-discharging of ink droplets) in the nozzles 110 of the ink jet head 100 are detected by the discharging abnormality detecting means 10 based on the residual vibration waveform of the diaphragm 121 and the causes of the discharging abnormalities are determined in the cases of discharging abnormalities.

Then, when the ink jet printer 1 detects and determines discharging abnormalities with regard to the nozzle 110 of the one ink jet head 100, discharging abnormalities are detected and determined with regard to the nozzle 110 of the ink jet head 100 which is designated next based on the driving signal which is next input from the driving waveform generating means 181, and the ensuing discharging abnormalities are detected and determined in sequence with regard to the nozzles 110 of the ink jet heads 100 which are driven by the output signal of the driving waveform generating means 181 in the same manner. Then, when the residual vibration detecting means 16 detects the residual vibration waveform of the diaphragm 121 as described above, the measuring means 17 measures the cycle and the like of the residual vibration waveform based on the waveform data and the determining means 20 determines normal discharging or discharging abnormality and the cause of the discharging abnormality in the case of a discharging abnormality (a head abnormality) based on the measurement result of the measuring means 17 and outputs the determination result to the storage means 62.

In this manner, since the ink jet printer 1 shown in FIG. 27 is configured such that the discharging abnormalities are detected and determined in sequence during the ink droplets discharging operation with regard to each of the nozzles 110 of the plurality of ink jet heads 100*a* to 100*e*, it is sufficient if only one each of the discharging abnormality detecting means 10 and the switching means 23 are provided, it is possible to scale down the circuit configuration of the ink jet printer 1 which is able to detect and determine discharging abnormalities, and it is possible to prevent an increase in manufacturing costs.

Figure 28:
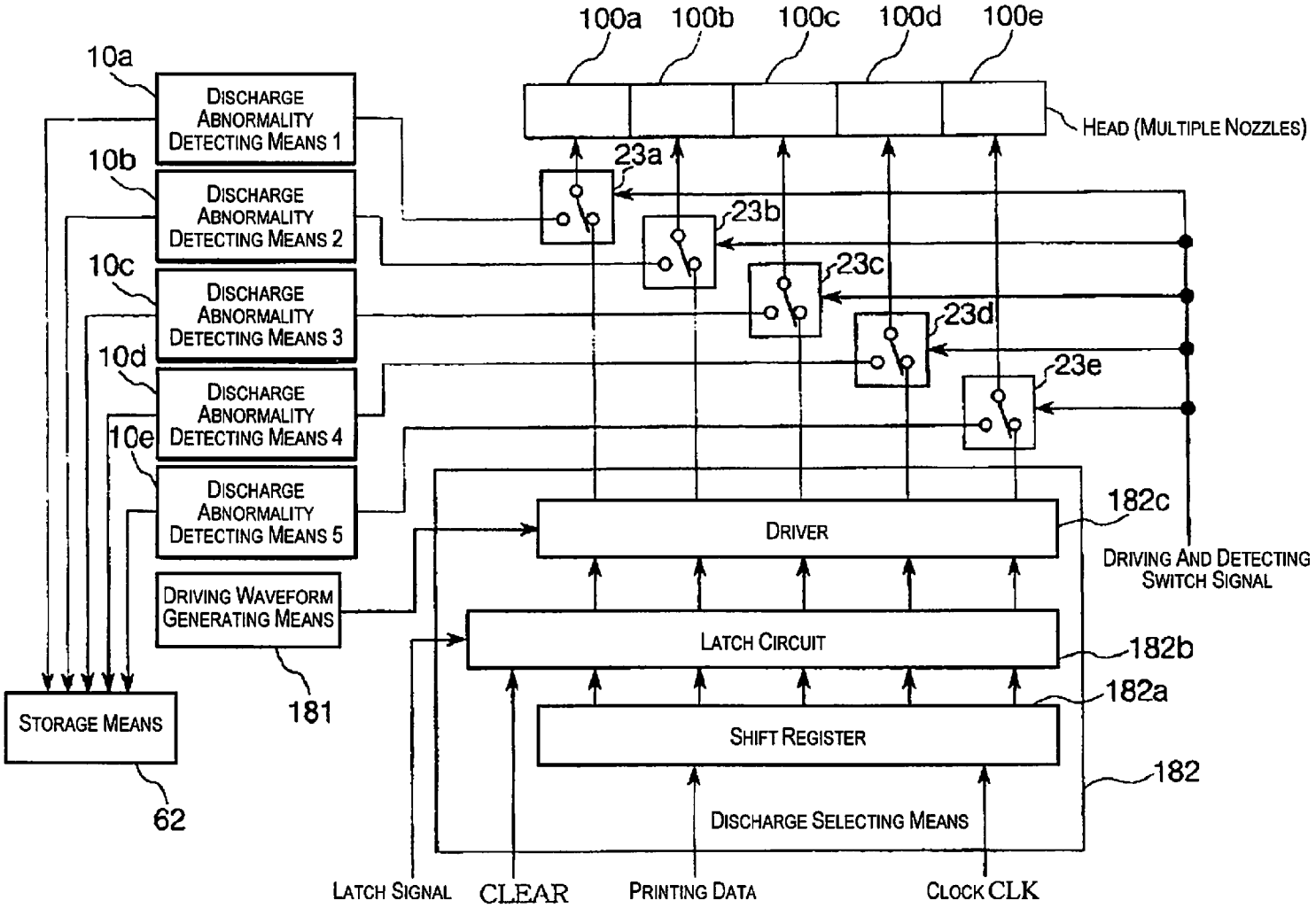
FIG. 28 is an example of the timing of detecting of discharge abnormalities in a plurality of ink jet heads (in a case where the number of discharging abnormality detecting means is the same as the number of ink jet heads).

FIG. 28 is an example of the timing of detecting of discharge abnormalities in the plurality of ink jet heads 100 (in a case where the number of the discharging abnormality detecting means 10 is the same as the number of the ink jet heads 100). The ink jet printer 1 shown in FIG. 28 is provided with the one discharge selecting means 182, five discharging abnormality detecting means 10*a* to 10*e*, five switching means 23*a* to 23*e*, the one driving waveform generating means 181 shared among the five ink jet heads 100*a* to 100*e*, and the one storage means 62. Here, since each of the constituent components has already been described above in the description of FIG. 27, description will be omitted and the connections of the components will be described.

In the same manner as the case shown in FIG. 27, the discharge selecting means 182 latches the printing data which corresponds to each of the ink jet heads 100*a* to 100*e* in the latch circuit 182*h* based on the printing data (the discharge data) which is input from the host computer 8 and the clock signal CLK and drives the electrostatic actuators 120 of the ink jet heads 100*a* to 100*e* which correspond to the printing data according to the driving signal (the voltage signal) which is input from the driving waveform generating means 181 to the driver 182*c*. The driving and detecting switch signals are each input into the switching means 23*a* to 23*e* which correspond to all of the ink jet heads 100*a* to 100*e* and the switching means 23*a* to 23*e* switch the connection with the ink jet heads 100 from the driving waveform generating means 181 to the discharging abnormality detecting means 10*a* to 10*e* after the driving signal is input into the electrostatic actuators 120 of the ink jet heads 100 based on the driving and detecting switch signal regardless of the presence or absence of corresponding printing data (the discharge data).

After the discharging abnormalities are detected and determined for each of the ink jet heads 100*a* to 100*e* by all of the discharging abnormality detecting means 10*a* to 10*e*, the determination results of all of the ink jet heads 100*a* to 100*e* which were obtained in the detecting process are output to the storage means 62, and the storage means 62 holds the presence or absence of discharging abnormalities for each of the ink jet heads 100*a* to 100*e* and the causes of the discharging abnormalities in a predetermined saving region.

In this manner, in the ink jet printer 1 shown in FIG. 28, since detecting of discharging abnormalities and determining of causes are performed by providing a plurality of discharging abnormality detecting means 10*a* to 10*e* which correspond to each of the nozzles 110 of the plurality of ink jet heads 100*a* to 100*e* and performing the switching operations using the plurality of switching means 23*a* to 23*e* which correspond to the discharging abnormality detecting means 10*a* to 10*e*, it is possible to perform detecting of discharging abnormalities and determining of causes of the discharging abnormalities in a short period of time for all of the nozzles 110 at one time.

Figure 29:
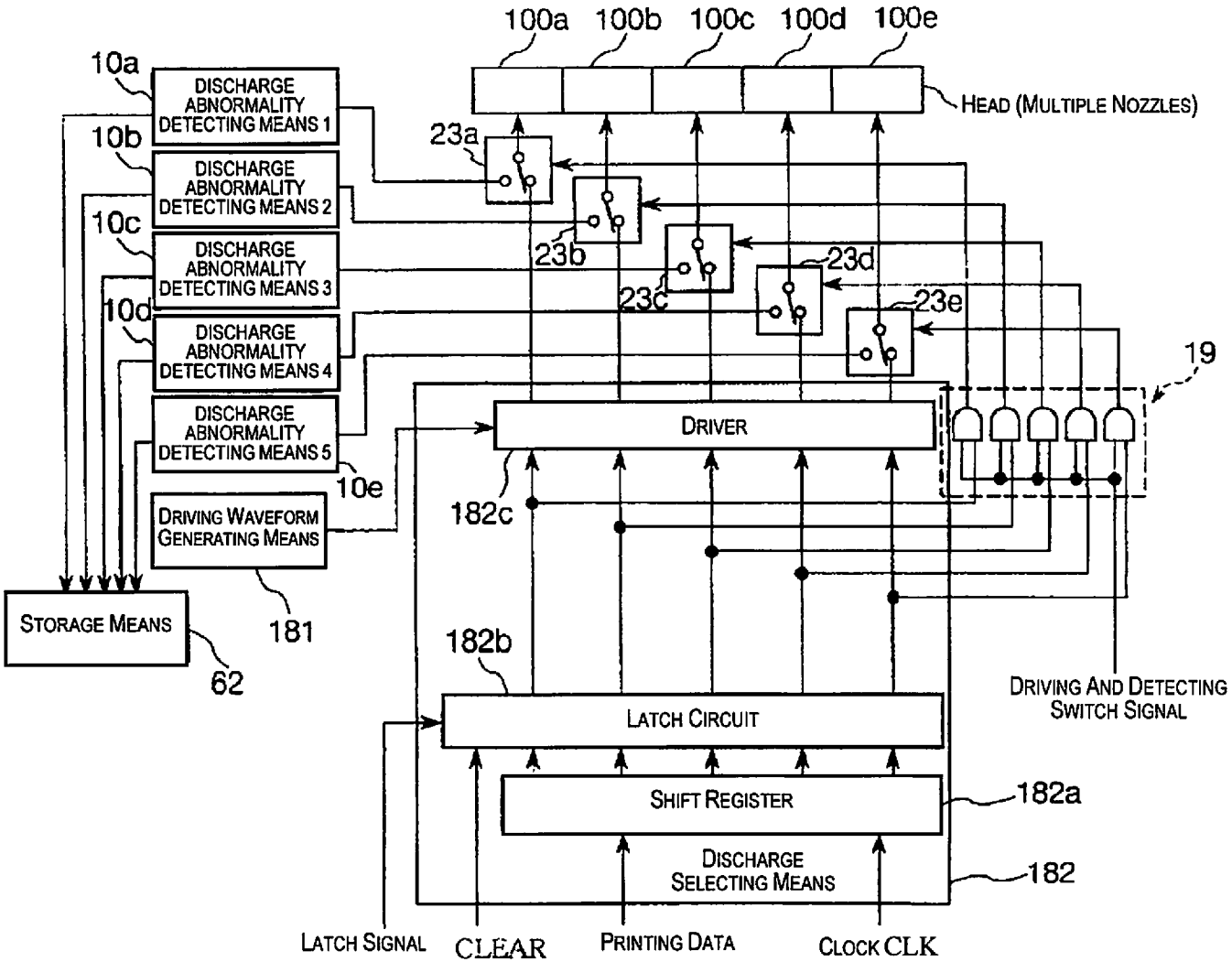
FIG. 29 is an example of the timing of detecting of discharge abnormalities in a plurality of ink jet heads (in a case where the number of discharging abnormality detecting means is the same as the number of ink jet heads and where detecting of discharge abnormalities is performed when there is printing data).

FIG. 29 is an example of the timing of detecting of discharge abnormalities in the plurality of ink jet heads 100 (in a case where the number of the discharging abnormality detecting means 10 is the same as the number of the ink jet heads 100 and where detecting of discharge abnormalities is performed when there is printing data). The ink jet printer 1 shown in FIG. 29 has the configuration of the ink jet printer 1 shown in FIG. 28 with an added (additional) switching control means 19. In the present embodiment, the switching control means 19 is configured by a plurality of AND circuits (logic AND circuits) ANDa to ANDe, and outputs a high level output signal to the corresponding switching means 23*a* to 23*e* when the printing data which is input into each of the ink jet heads 100*a* to 100*e* and the driving and detecting switch signal are input. Here, the switching control means 19 is not limited to the AND circuit (logic AND circuit), and it is sufficient if the switching control means 19 is configured so as to select the switching means 23 which matches the output from the latch circuit 182*b* which is selected by the ink jet head 100 to be driven.

Each of the switching means 23*a* to 23*e* switches the connection with the electrostatic actuators 120 of the corresponding ink jet heads 100*a* to 100*e* from the driving waveform generating means 181 to the respective corresponding discharging abnormality detecting means 10*a* to 10*e* based on the output signal of the respectively corresponding AND circuits ANDa to ANDe in the switching control means 19. In detail, in a case where the printing data, which is input into the corresponding ink jet heads 100*a* to 100*e* in a state where the driving and detecting switch signal is the high level, that is, when the output signal of the corresponding AND circuits ANDa to ANDe is the high level, is output from the latch circuit 182*b* to the driver 182*c*, the switching means 23*a* to 23*e* which correspond to the AND circuits switch the connection with the corresponding ink jet heads 100*a* to 100*e* from the driving waveform generating means 181 to the discharging abnormality detecting means 10*a* to 10*e*.

After the presence or absence of discharging abnormalities in each of the ink jet heads 100 and the causes of the discharging abnormalities in a case where there are discharging abnormalities are detected by the discharging abnormality detecting means 10*a* to 10*e* which correspond to the ink jet heads 100 where the printing data is input, the discharging abnormality detecting means 10 outputs the determination results which are obtained in the detecting process to the storage means 62. The storage means 62 holds one or a plurality of the determination results which are input (obtained) in this manner in a predetermined saving region.

In this manner, in the ink jet printer 1 shown in FIG. 29, the detecting and determining processes are not performed for the ink jet heads 100 where the discharging driving operation is not performed since detecting of discharging abnormalities in the ink jet heads 100 and determining of causes of discharging abnormalities are performed by providing the plurality of discharging abnormality detecting means 10*a* to 10*e* which correspond to each of the nozzles 110 of the plurality of ink jet heads 100*a* to 100*e* and performing predetermined switching operations using only the plurality of switching means 23*a* to 23*e* which are designated by the switching control means 19 when the printing data which corresponds to the respective ink jet heads 100*a* to 100*e* is input from the host computer 8 to the discharge selecting means 182 via the control section 6. Accordingly, it is possible to avoid wasteful detecting and determining processes using this ink jet printer 1.

Figure 30:
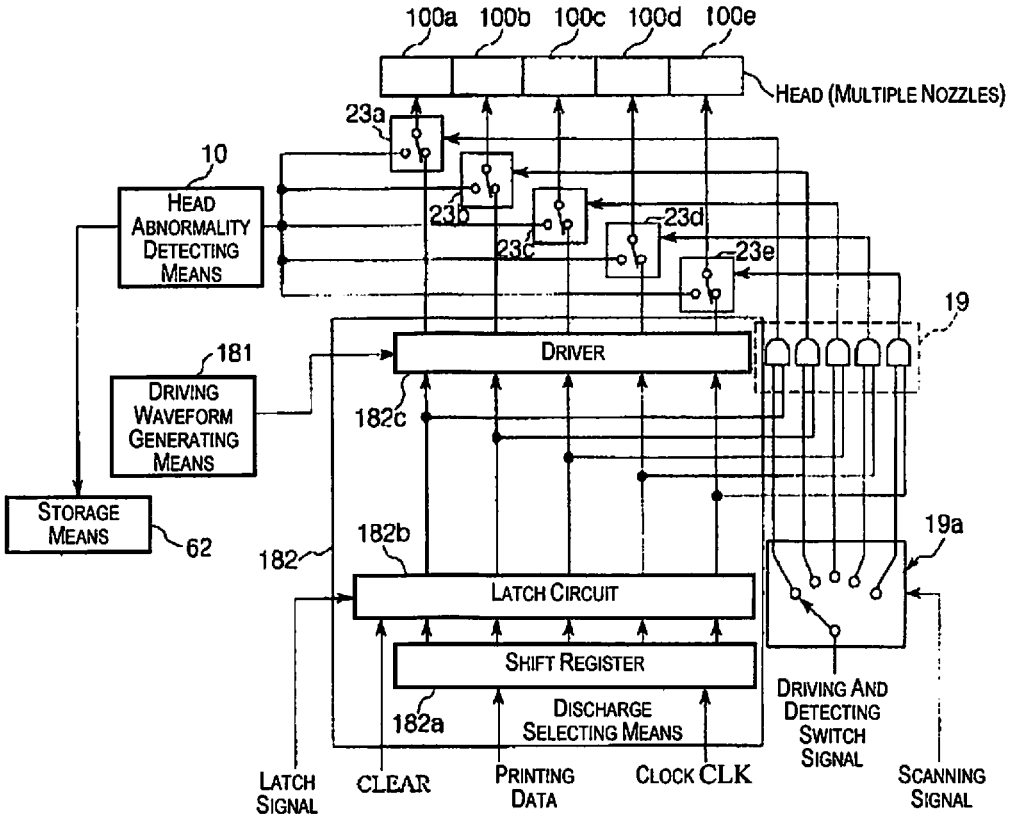
FIG. 30 is an example going round of the timing of detecting of discharge abnormalities in a plurality of ink jet heads (in a case where the number of discharging abnormality detecting means is the same as the number of ink jet heads and where detecting of discharge abnormalities is performed by going round each of the ink jet heads).

FIG. 30 is an example of the timing of detecting of discharge abnormalities in the plurality of ink jet heads 100 (in a case where the number of the discharging abnormality detecting means 10 is the same as the number of the ink jet heads 100 and where detecting of discharge abnormalities is performed by going round each of the ink jet heads 100). The ink jet printer 1 shown in FIG. 30 has the configuration of the ink jet printer 1 shown in FIG. 29 with the one discharging abnormality detecting means 10 with adding of a switch selecting means 19*a* which scans the driving and detecting switch signal (and specifies the ink jet heads 100 where the detecting and determining processes are executed one by one).

The switch selecting means 19*a* is a selector which is connected with the switching control means 19 shown in FIG. 29 and scans (selects and switches) the input of the driving and detecting switch signal to the AND circuits ANDa to ANDe which correspond to the plurality of ink jet heads 100*a* to 100*e* based on a scanning signal (selecting signal) which is input from the control section 6. The scanning (selecting) order of the switch selecting means 19*a* may be the order of the printing data which is input into the shift register 182*a*, that is, the discharging order of the plurality of ink jet heads 100, but may be simply the order of the plurality of ink jet heads 100*a* to 100*e*.

In a case where the scanning order is the order of the printing data which is input into the shift register 182*a*, when the printing data is input into the shift register 182*a* of the discharge selecting means 182, the printing data is latched in the latch circuit 182*b* and output to the driver 182*c* according to the input of the latch signal. In synchronization with the input of the printing data to the shift register 182*a* or the input of the latch signal to the latch circuit 182*b*, a scanning signal for specifying the ink jet head 100 which corresponds to the printing data is input into the switch selecting means 19*a* and the driving and detecting switch signal is output to the corresponding AND circuit. Here, the output terminal of the switch selecting means 19*a* outputs a low level at the time of non-selection.

By logical computation of the printing data which is input from the latch circuit 182*b* and the driving and detecting switch signal which is input from the switch selecting means 19*a*, the corresponding AND circuit (the switching control means 19) outputs a output signal with a high level to the corresponding switching means 23. Then, the switching means 23 where the output signal with a high level is input from the switching control means 19 switches the connection with the electrostatic actuator 120 of the corresponding ink jet head 100 from the driving waveform generating means 181 to the discharging abnormality detecting means 10.

The discharging abnormality detecting means 10 detects discharging abnormalities in the ink jet head 100 where printing data is input and determines the cause of the discharging abnormality in a case where there is a discharging abnormality, and then outputs the determination result to the storage means 62. Then, the storage means 62 holds the determination results which are input (obtained) in this manner in a predetermined saving region.

In addition, in a case where the scanning order is simply the order of the ink jet heads 100*a* to 100*e*, when the printing data is input into the shift register 182*a* of the discharge selecting means 182, the printing data is latched by the latch circuit 182*b* and output to the driver 182*c* according to the input of the latch signal. In synchronization with the input of the printing data to the shift register 182*a* or the input of the latch signal to the latch circuit 182*b*, a scanning (selecting) signal for specifying the ink jet head 100 which corresponds to the printing data is input to the switch selecting means 19*a* and the driving and detecting switch signal is output to the AND circuit which corresponds to the switching control means 19.

Here, when the printing data with regard to the ink jet head 100, which is set according to the scanning signal which is input into the switch selecting means 19*a*, is input into the shift register 182*a*, the output signal of the corresponding AND circuit (the switching control means 19) is a high level, and the switching means 23 switches the connection with the corresponding ink jet head 100 from the driving waveform generating means 181 to the discharging abnormality detecting means 10. However, when the printing data described above is not input into the shift register 182*a*, the output signal of the AND circuit is a low level and the corresponding switching means 23 does not execute the predetermined switching operation. Accordingly, the discharge abnormality detecting process of the ink jet heads 100 is performed based on the logical product of the selection result of the switch selecting means 19*a* and the result which is designated by the switching control means 19.

In a case where the switching operation is performed by the switching means 23, the determination result is output to the storage means 62 in the same manner as described above after the discharging abnormality detecting means 10 detects discharging abnormalities in the ink jet head 100 where the printing data is input and determines the cause of the discharging abnormality in a case where there is a discharging abnormality. Then, the storage means 62 holds the determination results which are input (obtained) in this manner in a predetermined saving region.

Here, since the corresponding switching means 23 does not execute the switching operation as described above when there is no printing data with regard to the ink jet head 100 which is specified by the switch selecting means 19*a*, it is not necessary for the discharge abnormality detecting process to be executed by the discharging abnormality detecting means 10, but such processes may be executed. In a case where the discharge abnormality detecting process is executed without performing the switching operation, the determining means 20 of the discharging abnormality detecting means 10 determines that the nozzle 110 of the corresponding ink jet head 100 is a non-discharging nozzle as shown in the flow chart of FIG. 26 (step S306), and the determination result is held in a predetermined saving region in the storage means 62.

In this manner, in the ink jet printer 1 shown in FIG. 30, it is possible to lessen the burden on the CPU 61 of the control section 6 without processing a large amount of detection result at one time, which is different to the ink jet printer 1 shown in FIG. 28 or FIG. 29, since detecting of discharging abnormalities in the ink jet head 100 and determining of causes of the discharging abnormalities are performed by providing only the one discharging abnormality detecting means 10 with regard to each of the nozzles 110 of the plurality of ink jet heads 100*a* to 100*e*, inputting the printing data, which corresponds to each of the ink jet heads 100*a* to 100*e*, from the host computer 8 to the discharge selecting means 182 via the control section 6, and only the switching means 23, which corresponds to the ink jet head 100 which performs the discharging driving operation according to the printing data, performing the switching operation by being specified by the scanning (selecting) signal at the same time as the inputting of the printing data. In addition, since the discharging abnormality detecting means 10 goes round the states of the nozzles separately from the discharging operations, it is possible to grasp discharging abnormalities for each single nozzle even during driving and printing, and it is possible to know the states of all the nozzles 110 of the head unit 35. Due to this, for example, since the detection of the discharging abnormalities is performed regularly, it is possible to reduce the steps for detecting discharging abnormalities for each single nozzle when printing is stopped. From the above, it is possible to efficiently perform detecting of discharging abnormalities and determining of causes of the discharging abnormalities of the ink jet heads 100.

In addition, it is possible to scale down the circuit configuration of the ink jet printer 1 compared to the ink jet printer 1 shown in FIG. 28 and FIG. 29 and it is possible to prevent an increase in manufacturing costs, which is different to the ink jet printer 1 shown in FIG. 28 or FIG. 29, since the ink jet printer 1 shown in FIG. 30 may be provided with only the one discharging abnormality detecting means 10.

Next, the operation of the printer 1 shown in FIG. 27 to FIG. 30, that is, the discharge abnormality detecting process in the ink jet printer 1 which is provided with the plurality of ink jet heads 100 (mainly, the detection timing), will be described. In the discharging abnormality detecting and determining processes (the process in multiple nozzles), the residual vibration of the diaphragm 121 is detected when the electrostatic actuators 120 of each of the ink jet heads 100 perform an ink droplet discharging operation, and it is determined whether or not discharging abnormalities (missing dots or ink droplet non-discharging) are generated with regard to the relevant ink jet head 100 based on the cycle of the residual vibration and it is determined what the cause of the discharging abnormality is in a case where missing dots (ink droplet non-discharging) are generated. In this manner, in the present invention, when the discharging operation of the ink droplets (liquid droplets) is performed by the ink jet head 100, it is possible to execute the detecting and determining processes, but there are cases where discharging of the ink droplets by the ink jet head 100 is a flushing operation (preliminary discharge or preparatory discharge) rather than a case of actually printing onto a recording sheet P. Below, the discharging abnormality detecting and determining processes (multiple nozzles) will be described for these two cases.

Here, a flushing (preliminary discharging) process is a head cleaning operation where ink droplets are discharged from the entirety of the head unit 35 or the nozzles 110 which are the target when a cap which is not shown in the diagram in FIG. 1 is mounted or in a location where the ink droplets (the liquid droplets) do not reach the recording sheet P (the medium). This flushing process (flushing operation) is executed when, for example, the ink inside the cavities 141 is regularly output or executed as a recovery operation when the ink thickens in order for the ink viscosity inside the nozzles 110 to be held at a value in an appropriate range. Furthermore, a flushing process is also executed in a case where the ink is initially filled into each of the cavities 141 after the ink cartridge 31 is mounted in the printing means 3.

In addition, there are cases where a wiping process (a treatment where attached objects (paper dust, dirt, or the like) which are attached to the head surface of the printing means 3 are wiped away using a wiper which is not shown in the diagram in FIG. 1) is performed in order to clean the nozzle plate (the nozzle surface) 150, but there is a negative pressure inside the nozzles 110 at this time and there is a possibility that inks of other colors (other types of liquid droplets) will be drawn in. As a result, a flushing process is carried out after the wiping process in order to discharge constant amounts of ink droplets from all of the nozzles 110 of the head units 35. Furthermore, it is possible for a flushing process to be executed at an appropriate time in order to secure excellent printing due to the state of the meniscus of the nozzle 110 being held in a normal manner.

Figure 31:
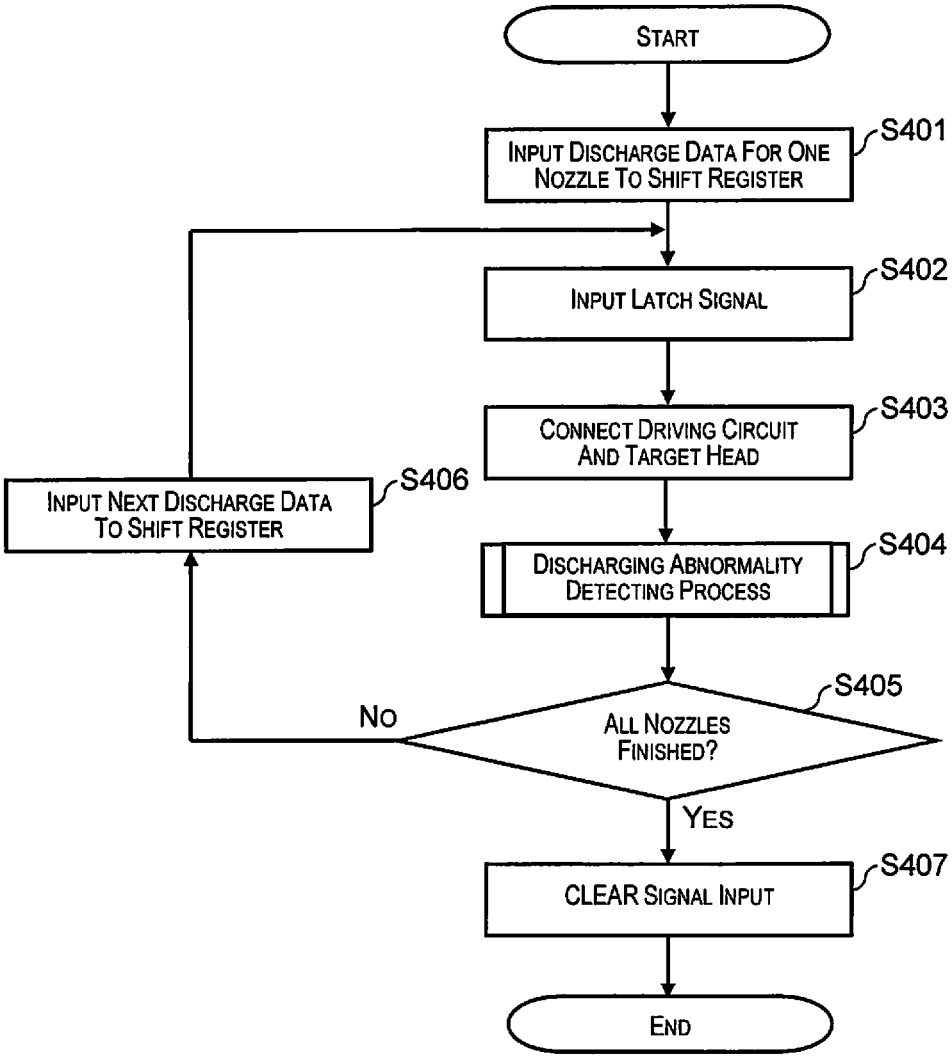
FIG. 31 is a flow chart illustrating the timing of detecting of discharge abnormalities during a flushing operation in the ink jet printer shown in FIG. 27.

Firstly, the discharging abnormality detecting and determining processes during a flushing process will be described with reference to the flow chart shown in FIG. 31 to FIG. 33. Here, these flow charts will be described with reference to the block diagrams of FIG. 27 to FIG. 30 (below, the same applies during printing or the like). FIG. 31 is a flow chart illustrating the timing of detecting of discharge abnormalities during a flushing operation in the ink jet printer 1 shown in FIG. 27.

When a flushing process of the ink jet printer 1 is executed at a predetermined timing, the discharging abnormality detecting and determining processes shown in FIG. 31 are executed. The control section 6 inputs the discharge data for one nozzle to the shift register 182*a* of the discharge selecting means 182 (step S401), the latch signal is input into the latch circuit 182*b* (step S402), and the discharge data is latched. At this time, the switching means 23 connects the electrostatic actuator 120 of the ink jet head 100, which is the target of the discharge data, and the driving waveform generating means 181 (step S403).

Then, the discharging abnormality detecting and determining processes shown in the flow chart of FIG. 24 are executed by the discharging abnormality detecting means 10 with regard to the ink jet head 100 which performed the ink discharging operation (step S404). In step S405, the control section 6 determines whether or not the discharging abnormality detecting and determining processes are finished with regard to the nozzles 110 of all of the ink jet heads 100*a* to 100*e* of the ink jet printer 1 shown in FIG. 27 based on the discharge data which is output to the discharge selecting means 182. Then, when it is determined that these processes are not finished for all of the nozzles 110, the control section 6 inputs the discharge data which corresponds to the nozzles 110 of the next ink jet head 100 to the shift register 182*a* (step S406) and repeats the processes in the same manner by moving to step S402.

In addition, in step S405, in a case where it is determined that the discharging abnormality detecting and determining processes described above are finished for all of the nozzles 110, the control section 6 inputs a CLEAR signal to the latch circuit 182*b* and finishes the discharging abnormality detecting and determining processes in the ink jet printer 1 shown in FIG. 27 by releasing the latch state of the latch circuit 182*b*.

As described above, in the discharging abnormality detecting and determining processes in the printer 1 shown in FIG. 27, since the detection circuit is configured by the one discharging abnormality detecting means 10 and the one switching means 23, the discharging abnormality detecting and determining processes are repeated only for the number of the ink jet heads 100, and there is an effect that the circuit which configures the discharging abnormality detecting means 10 is not so large.

Figure 32:
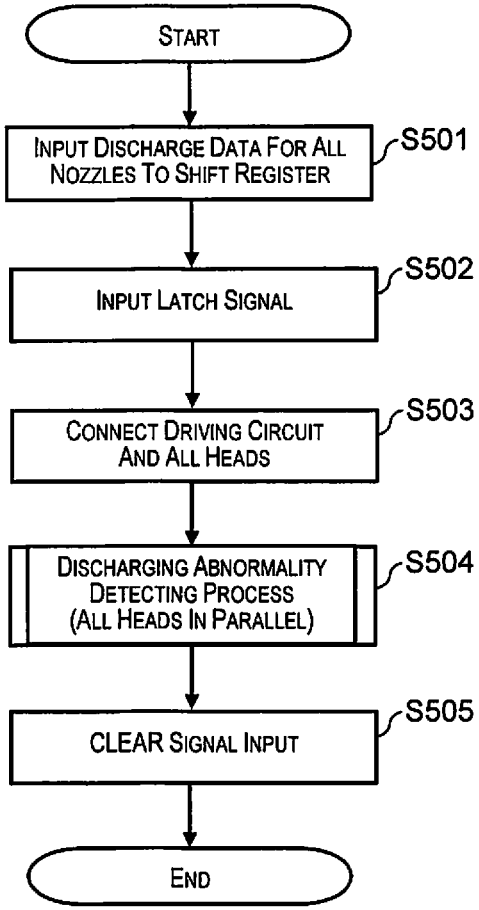
FIG. 32 is a flow chart illustrating the timing of the detecting of discharge abnormalities during a flushing operation in the ink jet printer shown in FIG. 28 and FIG. 29.

Next, FIG. 32 is a flow chart illustrating the timing of the detecting of discharge abnormalities during a flushing operation in the ink jet printer 1 shown in FIG. 28 and FIG. 29. The circuit configuration is slightly different to the ink jet printer 1 shown in FIG. 28 and the ink jet printer 1 shown in FIG. 29, but the ink jet printer 1 shown in FIG. 28 and the ink jet printer 1 shown in FIG. 29 coincide in the point that the number of the discharging abnormality detecting means 10 and the switching means 23 corresponds to the number of the ink jet heads 100 (the numbers are the same). As a result, the discharging abnormality detecting and determining processes during a flushing operation are configured by the same steps.

When a flushing process of the ink jet printer 1 is performed at a predetermined timing, the control section 6 inputs the discharge data for all of the nozzles to the shift register 182*a* of the discharge selecting means 182 (step S501), the latch signal is input into the latch circuit 182*b* (step S502) and the discharge data is latched. At this time, the switching means 23*a* to 23*e* each connect all of the ink jet heads 100*a* to 100*e* and the driving waveform generating means 181 (step S503).

Then, the discharging abnormality detecting and determining processes shown in the flow chart in FIG. 24 are executed in parallel with regard to all of the ink jet heads 100, which performed the ink discharging operation, by the discharging abnormality detecting means 10*a* to 10*e* which respectively correspond to the ink jet heads 100*a* to 100*e* (step S504). In this case, the determination results which correspond to all of the ink jet heads 100*a* to 100*e* are saved in a predetermined holding region of the storage means 62 to be associated with the ink jet heads 100 which are the target of the processes (step S107 in FIG. 24).

Then, in order to clear the discharge data which is latched in the latch circuit 182*b* of the discharge selecting means 182, the control section 6 inputs the CLEAR signal to the latch circuit 182*b* (step S505) and finishes the discharging abnormality detecting and determining processes in the ink jet printers 1 shown in FIG. 28 and FIG. 29 by releasing the latch state of the latch circuit 182*b*.

As described above, in the processes in the printer 1 shown in FIG. 28 and FIG. 29, since the detecting and determining circuit is configured by a plurality of (five in the present embodiment) discharging abnormality detecting means 10 which correspond to the ink jet heads 100*a* to 100*e* and a plurality of switching means 23, the discharging abnormality detecting and determining processes have the effect of being able to be executed in a short period of time for all of the nozzles 110 at one time.

Figure 33:
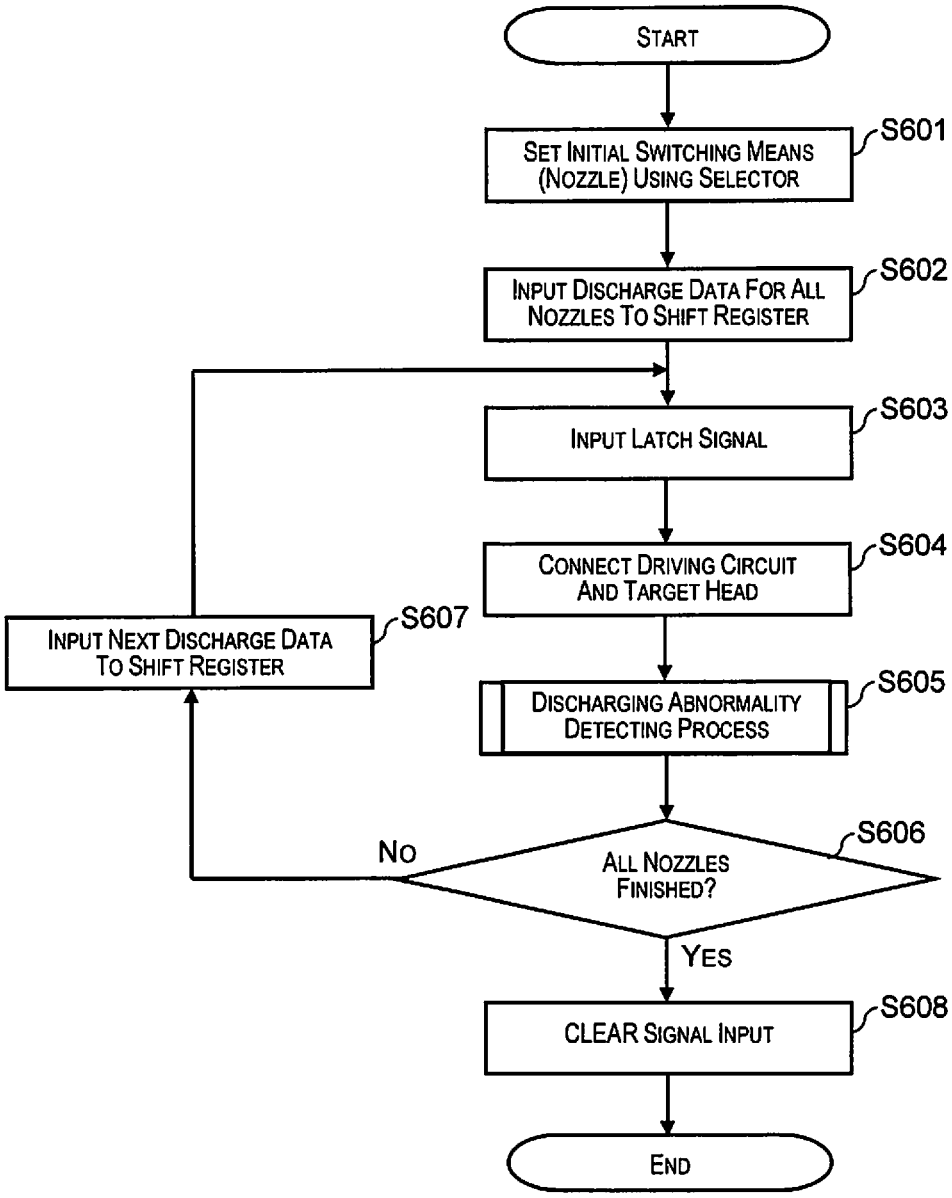
FIG. 33 is a flow chart illustrating the timing of the detecting of discharge abnormalities during a flushing operation in the ink jet printer shown in FIG. 30.

Next, FIG. 33 is a flow chart illustrating the timing of the detecting of discharge abnormalities during a flushing operation in the ink jet printer 1 shown in FIG. 30. Below, in the same manner, the discharging abnormality detecting process and the cause determining process during a flushing operation using the circuit configuration of the ink jet printer 1 shown in FIG. 30 will be described.

When a flushing process of the ink jet printer 1 is executed at a predetermined timing, firstly, the control section 6 outputs a scanning signal to the switch selecting means (selector) 19*a* and sets (specifies) the initial switching means 23*a* and the ink jet head 100*a* using the switch selecting means 19*a* and the switching control means 19 (step S601). Then, the discharge data on all the nozzles is input into the shift register 182*a* of the discharge selecting means 182 (step S602), the latch signal is input into the latch circuit 182*b* (step S603), and the discharge data is latched. At this time, the switching means 23*a* connects the electrostatic actuator 120 of the ink jet head 100*a* and the driving waveform generating means 181 (step S604).

Then, the discharging abnormality detecting and determining processes shown in the flow chart of FIG. 24 are executed with regard to the ink jet head 100*a* which performed the ink discharging operation (step S605). In this case, in step S103 in FIG. 24, due to the driving and detecting switch signal which is the output signal of the switch selecting means 19*a* and the discharge data which is output from the latch circuit 182*b* being input into the AND circuit ANDa and the output signal of the AND circuit ANDa being the high level, the switching means 23*a* connects the electrostatic actuator 120 of the ink jet head 100*a* and the discharging abnormality detecting means 10. Then, the determination results of the discharge abnormality detecting process which is executed in step S106 of FIG. 24 are saved in a predetermined holding region of the storage means 62 to be associated with the ink jet head 100 which is the target of the process (here, the ink jet head 100*a*) (step S107 in FIG. 24).

In step S606, the control section 6 determines whether or not the discharging abnormality detecting and determining processes are finished with regard to all of the nozzles. Then, in a case where it is determined that the discharging abnormality detecting and determining processes are not yet finished for all of the nozzles 110, the control section 6 outputs a scanning signal to the switch selecting means (selector) 19*a*, sets (specifies) the next switching means 23*b* and the ink jet head 100*b* using the switch selecting means 19*a* and the switching control means 19 (step S607), and the process moves to step S603 and the same process is repeated. Below, this loop is repeated until the discharging abnormality detecting and determining processes are finished for all of the ink jet heads 100.

In addition, in a case where it is determined in step S606 that the discharging abnormality detecting and determining processes are finished for all of the nozzles 110, in order to clear the discharge data which is latched in the latch circuit 182*b* of the discharge selecting means 182, the control section 6 inputs the CLEAR signal to the latch circuit 182*b* (step S609) and finishes the discharging abnormality detecting and determining processes in the ink jet printer 1 shown in FIG. 30 by releasing the latch state of the latch circuit 182*b*.

As described above, in the processing in the ink jet printer 1 shown in FIG. 30, it is possible to more efficiently perform detecting of discharge abnormalities and determining of causes of discharge abnormalities in the ink jet head 100 since detecting of discharging abnormalities in the corresponding ink jet head 100 and determining of causes are performed by the detection circuit being configured by the plurality of switching means 23 and the one discharging abnormality detecting means 10 and only the switching means 23, which corresponds to the ink jet head 100 which is specified according to the scanning signal of the switch selecting means (selector) 19*a* and which performs discharge driving according to the discharge data, performing the switching operation.

Here, the discharge data which corresponds to all of the nozzles 110 is input into the shift register 182*b* in step S602 in the flow chart, but the discharging abnormality detecting and determining processes may be performed where the discharge data which is input into the shift register 182*a* is input into the corresponding one ink jet head 100, one nozzle 110 at a time, to match the scanning order of the ink jet heads 100 according to the switch selecting means 19*a* as in the flow chart shown in FIG. 31.

Next, the discharging abnormality detecting and determining processes of the ink jet printer 1 during the printing operation will be described with reference to the flow charts shown in FIG. 34 and FIG. 35. In the ink jet printer 1 shown in FIG. 27, description of the flow chart during the printing operation and of the printing operation is omitted since the discharging abnormality detecting and determining processes are mainly applied during a flushing operation, but the discharging abnormality detecting and determining processes may be performed during a printing operation in the ink jet printer 1 shown in FIG. 27.

Figure 34:
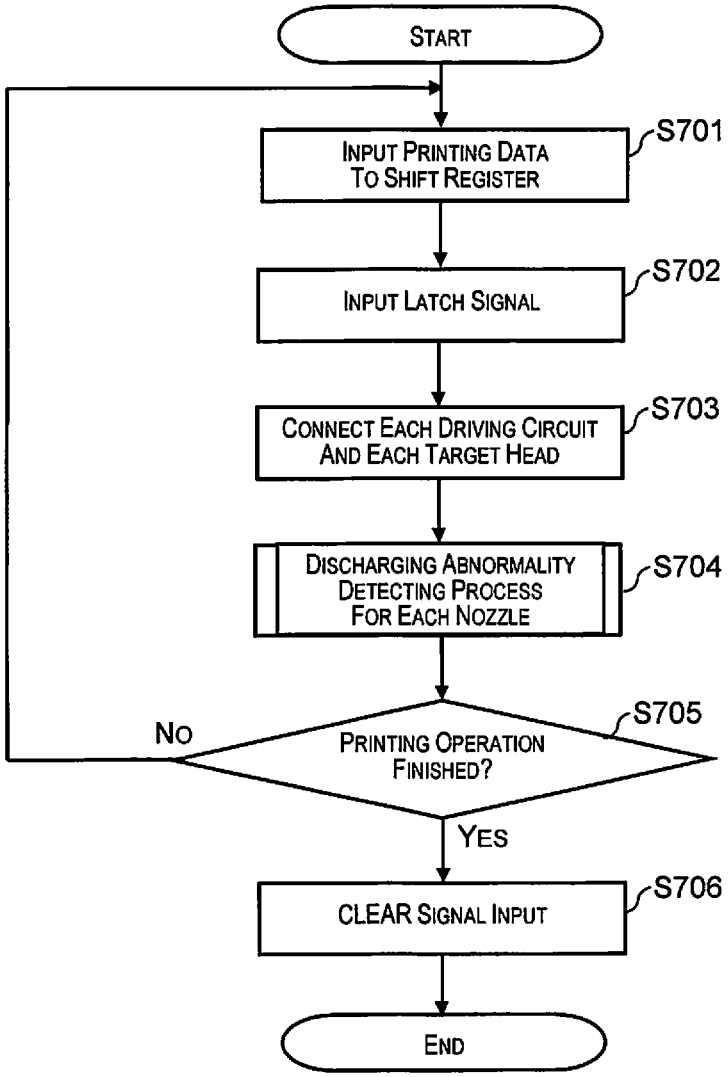
FIG. 34 is a flow chart illustrating the timing of the detecting of discharge abnormalities during a printing operation in the ink jet printer shown in FIG. 28 and FIG. 29.

FIG. 34 is a flow chart illustrating the timing of detecting of discharge abnormalities during a printing operation in the ink jet printer 1 shown in FIG. 28 and FIG. 29. The processes of the flow chart are executed (started) according to the print instructions from the host computer 8. When the printing data from the host computer 8 is input into the shift register 182*a* of the discharge selecting means 182 via the control section 6 (step S701), a latch signal is input into the latch circuit 182*b*

(step S702), and the printing data is latched. At this time, the switching means 23*a* to 23*e* connect all of the ink jet heads 100*a* to 100*e* and the driving waveform generating means 181 (step S703).

Then, the discharging abnormality detecting means 10 which corresponds to the ink jet head 100 which performed the ink discharging operation executes the discharging abnormality detecting and determining processes shown in the flow chart of FIG. 24 (step S704). In this case, the respective determination results which correspond to each of the ink jet heads 100 are saved in a predetermined holding region of the storage means 62 to be associated with the ink jet head 100 which is the subject of the process.

Here, in the case of the ink jet printer 1 shown in FIG. 28, the switching means 23*a* to 23*e* connect the ink jet heads 100*a* to 100*e* with the discharging abnormality detecting means 10*a* to 10*e* based on the driving and detecting switch signal which is output from the control section 6 (step S103 in FIG. 24). As a result, since the electrostatic actuators 120 are not driven in the ink jet heads 100 where there is no printing data, the residual vibration detecting means 16 of the discharging abnormality detecting means 10 does not detect the residual vibration waveform of the diaphragm 121. On the other hand, in the case of the ink jet printer 1 shown in FIG. 29, the switching means 23*a* to 23*e* connect the ink jet heads 100 where there is printing data with the discharging abnormality detecting means 10 based on the output signal of the AND circuit where the driving and detecting switch signal which is output from the control section 6 and the printing data which is output from the latch circuit 182*b* are input (step S103 in FIG. 24).

In step S705, the control section 6 determines whether or not the printing operation of the ink jet printer 1 is finished. Then, when it is judged that the printing operation is not finished, the control section 6 moves the process to step S701, inputs the next printing data to the shift register 182*a*, and repeats the same process.

In addition, when it is determined that the printing operation is finished, in order to clear the discharge data which is latched in the latch circuit 182*b* of the discharge selecting means 182, the control section 6 inputs the CLEAR signal to the latch circuit 182*b* (step S707) and finishes the discharging abnormality detecting and determining processes in the ink jet printers 1 shown in FIG. 28 and FIG. 29 by releasing the latch state of the latch circuit 182*b*.

As described above, it is possible to perform the discharging abnormality detecting and determining processes in a short period of time since the ink jet printer 1 shown in FIG. 28 and FIG. 29 is provided with the plurality of switching means 23*a* to 23*e* and the plurality of discharging abnormality detecting means 10*a* to 10*e* and the discharging abnormality detecting and determining processes are performed with regard to all of the ink jet heads 100 at one time. In addition, it is possible to perform the discharging abnormality detecting and determining processes without performing wasteful detecting since the ink jet printer 1 shown in FIG. 29 is further provided with the switching control means 19, that is, the AND circuits ANDa to ANDe which compute the logical product of the driving and detecting switch signal and the printing data and the switching operation is performed by the switching means 23 with regard to only the ink jet heads 100 which perform the printing operation.

Figure 35:
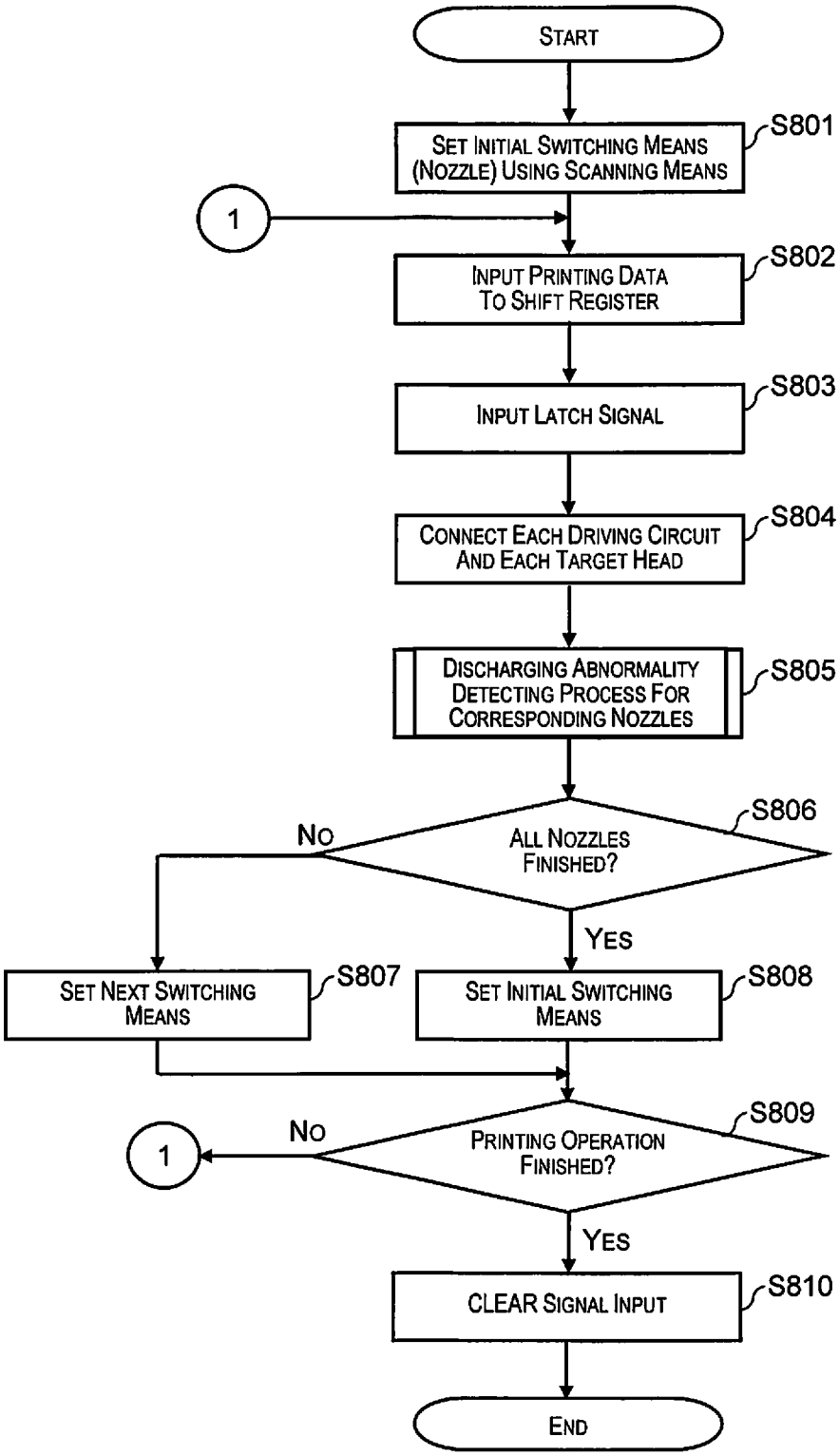
FIG. 35 is a flow chart illustrating the timing of the detecting of discharge abnormalities during a printing operation in the ink jet printer shown in FIG. 30.

Next, FIG. 35 is a flow chart illustrating the timing of detecting discharging abnormalities during a printing operation of the ink jet printer 1 shown in FIG. 30. The processes of the flow chart are executed in the ink jet printer 1 shown in FIG. 30 according to the printing instructions from the host computer 8. Firstly, the switch selecting means 19*a* sets (specifies) the initial switching means 23*a* and the ink jet head 100*a* in advance (step S801).

When the printing data is input from the host computer 8 into the shift register 182*a* of the discharge selecting means 182 via the control section 6 (step S802), the latch signal is input into the latch circuit 182*b* (step S803), and the printing data is latched. Here, in this step, the switching means 23*a* to 23*e* connect all of the ink jet heads 100*a* to 100*e* and the driving waveform generating means 181 (the driver 182*c* of the discharge selecting means 182) (step S804).

Then, in a case where there is printing data in the ink jet head 100*a*, the control section 6 executes the discharge abnormality detecting and determining process shown in the flow chart of FIG. 24 (FIG. 25) (step S805) by the electrostatic actuator 120 after the discharging operation being connected with the discharging abnormality detecting means 10 by the switch selecting means 19*a* (step S103 of FIG. 24). Then, the determination results of the discharge abnormality detecting process which is executed in step S106 of FIG. 24 are saved in a predetermined holding region of the storage means 62 to be associated with the ink jet head 100 which is the subject of the process (here, the ink jet head 100*a*) (step S107 in FIG. 24).

In step S806, the control section 6 determines whether or not the discharging abnormality detecting and determining processes described above are finished for all of the nozzles 110 (all of the ink jet heads 100). Then, in a case where it is determined that the processes described above are finished for all of the nozzles 110, the control section 6 sets the switching means 23*a* which corresponds to the initial nozzle 110 again based on the scanning signal (step S808), and in a case where it is determined that the processes described above are not finished for all of the nozzles 110, the control section 6 sets the switching means 23*b* which corresponds to the next nozzle 110 (step S807).

In step S809, the control section 6 determines whether or not the predetermined printing operation which is instructed by the host computer 8 is finished. Then, in a case where it is determined that the printing operation is not yet finished, the next printing data is input into the shift register 182*a* (step S802) and the same process is repeated. In a case where it is determined that the printing operation is finished, in order to clear the discharge data which is latched in the latch circuit 182*b* of the discharge selecting means 182, the control section 6 inputs the CLEAR signal to the latch circuit 182*b* (step S811) and finishes the discharging abnormality detecting and determining processes in the ink jet printer 1 shown in FIG. 30 by releasing the latch state of the latch circuit 182*b*.

As described above, the liquid droplet discharging apparatus (the ink jet printer 1) of the present invention is provided with a plurality of ink jet heads (liquid droplet discharging heads) 100 which have the diaphragm 121, the electrostatic actuators 120 which displace the diaphragm 121, the cavities 141 where liquid is filled in an inner section and where the pressure in the inner section changes (increases or decreases) due to the displacement of the diaphragm 121, and the nozzles 110 which are linked with the cavities 141 and which discharge the liquid as liquid droplets according to the change (the increase or decrease) in the pressure inside the cavities 141, is further provided with the driving waveform generating means 181 which drives the electrostatic actuators 120, the discharge selecting means 182 which selects which of the nozzles 110 of the plurality of nozzles 110 to discharge liquid droplets from, one or a plurality of the discharging abnormality detecting means 10 which detect the residual vibration of the diaphragm 121 and detect abnormalities in the discharging of the liquid droplets based on the residual vibration of the diaphragm 121 which is detected, and one or a plurality of the switching means 23 which switch the electrostatic actuators 120 from the driving waveform generating means 181 to the discharging abnormality detecting means 10 based on the driving and detecting switch signal, the printing data, or the scanning signal after the discharging operation of the liquid droplets according to the driving of the electrostatic actuators 120, and detects discharging abnormalities of the plurality of nozzles 110 at one time (in parallel) or in sequence.

Accordingly, using the discharging abnormality detecting and determining method of the liquid droplet discharging apparatus and the liquid droplet discharging heads of the present invention, it is possible to perform detecting of discharging abnormalities and determining of the causes of discharging abnormalities in a short period of time, it is possible to scale down the circuit configuration of the detection circuit which includes the discharging abnormality detecting means 10, and it is possible to prevent an increase in manufacturing costs of the liquid droplet discharging apparatus. In addition, since detecting of discharging abnormalities and determining of the causes of discharging abnormalities are performed by switching to the discharging abnormality detecting means 10 after driving of the electrostatic actuators 120, driving of the actuators does not have an effect, and due to this, throughput of the liquid droplet discharging apparatus of the present invention is not decreased or deteriorated. In addition, it is also possible to install the discharging abnormality detecting means 10 in existing liquid droplet discharging apparatuses (ink jet printers) which are provided with predetermined constituent components.

In addition, different to the configuration described above, the liquid droplet discharging apparatus of the present invention is provided with the plurality of switching means 23, the switching control means 19, and one or a plurality of the discharging abnormality detecting means 10 which correspond to the number of the nozzles 110, and performs detecting of discharging abnormalities and determining of the causes of discharging abnormalities by switching the corresponding electrostatic actuators 120 from the driving waveform generating means 181 or the discharge selecting means 182 to the discharging abnormality detecting means 10 based on the driving and detecting switch signal and print data (the printing data) or on the scanning signal, the driving and detecting switch signal, and the discharge data (the printing data).

Accordingly, according to the liquid droplet discharging apparatus of the present invention, it is possible to avoid wasteful detecting and determining processes since the switching means which corresponds to the electrostatic actuators 120 where the discharge data (the printing data) is not input, that is, where the discharging driving operation is not performed, does not perform a switching operation. In addition, in a case where the switch selecting means 19*a* is used, it is possible to scale down the circuit configuration of the liquid droplet discharging apparatus and it is possible to prevent an increase in manufacturing costs of the liquid droplet discharging apparatus since the liquid droplet discharging apparatus may be provided with only the one discharging abnormality detecting means 10.

Figure 36:
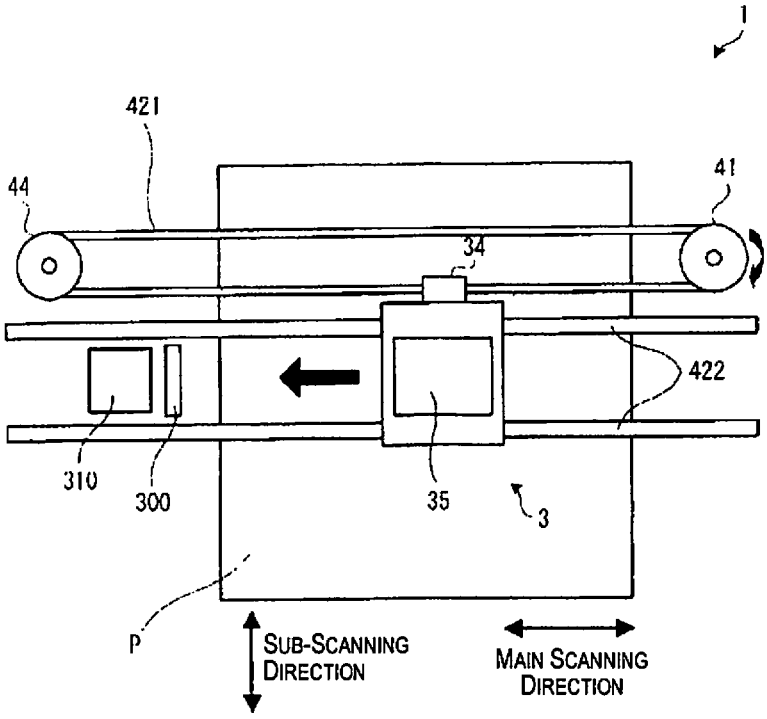
FIG. 36 is a diagram illustrating a schematic structure (with a portion omitted) which is viewed from an upper section of the ink jet printer shown in FIG. 1.

Next, the configuration (the recovery means 24) which executes a recovery process, where the cause of the discharging abnormalities (head abnormalities) with regard to the ink jet heads 100 (the head unit 35) is eliminated in the liquid droplet discharging apparatus of the present invention, will be described. FIG. 36 is a diagram illustrating a schematic structure (with a portion omitted) which is viewed from an upper section of the ink jet printer 1 shown in FIG. 1. The ink jet printer 1 shown in FIG. 36 is provided with a wiper 300 and a cap 310 for performing the recovery process for the ink droplet non-discharging (head abnormalities) in addition to the configuration shown in the perspective diagram of FIG. 1.

The recovery processes which are executed by the recovery means 24 include a flushing process where liquid droplets are preliminarily discharged from the nozzles 110 of each of the ink jet heads 100, a wiping process which uses the wiper 300 (refer to FIGS. 37A and 37B) which will be described later, and a pumping process (a pump suction process) which uses a tube pump 320 which will be described later. That is, the recovery means 24 is provided with the tube pump 320, a pulse motor which drives the tube pump 320, the wiper 300, a vertical movement driving mechanism of the wiper 300, and a vertical movement driving mechanism (which is not shown in the diagram) of the cap 310, and the head driver 33, the head unit 35, and the like function as a portion of the recovery means 24 in a flushing process and the carriage motor 41 and the like function as a portion of the recovery means 24 in the wiping process. Since a flushing process is described above, the wiping process and the pumping process will be described later.

Here, the wiping process refers to a process of wiping off foreign material such as paper dust which is attached to the nozzle plate 150 (the nozzle surface) of the head unit 35 using the wiper 300. In addition, the pumping process (the pump suction process) refers to a process where ink inside the cavities 141 is suctioned and output from each of the nozzles 110 of the head unit 35 by driving the tube pump 320 which will be described later. In this manner, the wiping process is process which is appropriate as the recovery process in the state where paper dust is attached which is one cause of discharging abnormalities of the liquid droplets in the ink jet heads 100 described above. In addition, the pump suction process is a process which is appropriate as a recovery process where air bubbles inside the cavities 141 which were not eliminated by a flushing process described above are removed, or where thickened ink is removed in a case where the ink in the vicinity of the nozzles 110 is thickened by the ink being dried or by the ink inside the cavities 141 aging and deteriorating. Here, in a case where the thickening does not progress to a large extent and the viscosity is not so great, it is possible to perform the recovery process using the flushing process described above. In this case, since the amount of ink which is output is small, it is possible to perform an appropriate recovery process without decreasing throughput or increasing running costs.

The plurality of head units 35 are mounted onto the carriage 32 and moved by being joined with the timing belt 421 via a joining section 34 which is provided at an upper end in the diagram using the carriage motor 41 by being guided by two carriage guiding shafts 422. It is possible for the head unit 35 which is mounted onto the carriage 32 to move in the main scanning direction via the timing belt 421 (moving in conjunction with the timing belt 421) which moves according to the driving of the carriage motor 41. Here, the carriage motor 41 fulfills the role of a pulley for continuously rotating the timing belt 421 and a pulley 44 is provided in the same manner at the other side.

In addition, the cap 310 is for performing capping of the nozzle plate 150 (refer to FIG. 5) of the head unit 35. Holes are formed in the bottom section side surface of the cap 310 and a flexible tube 321 which is a constituent component of the tube pump 320 is connected with the cap 310 as will be described later. Here, the tube pump 320 will be described later using FIGS. 39A and 39B.

While driving the electrostatic actuators 120 of the predetermined ink jet head 100 (the liquid droplet discharging head) during a recording (printing) operation, the ink jet printer (the liquid droplet discharging apparatus) 1 prints (records) a predetermined image or the like on the recording sheet P based on the print data which is input from the host computer 8 by the recording sheet P moving in the sub-scanning direction, that is, downward in FIG. 36, and the printing means 3 moving in the main scanning direction, that is, left and right in FIG. 36.

FIGS. 37A and 37B are diagrams illustrating a positional relationship between the wiper 300 and the printing means 3 (the head unit 35) shown in FIG. 36. In FIGS. 37A and 37B, the head unit 35 and the wiper 300 are shown as a portion of a side surface diagram in a case of viewing the upper side from the lower side in the diagram of the ink jet printer 1 shown in FIG. 36. As shown in FIG. 37A, the wiper 300 is arranged so as to be able to move up and down so as to be able to come into contact with the nozzle surface of the printing means 3, that is, with the nozzle plate 150 of the head unit 35.

Here, the wiping process which is a recovery process which uses the wiper 300 will be described. As shown in FIG. 37A, when performing a wiping process, the wiper 300 is moved upward by a driving apparatus which is not shown in the diagram such that the front end of the wiper 300 is positioned more to the upper side than the nozzle surface (the nozzle plate 150). In this case, when the printing means 3 (the head unit 35) is moved in the leftward direction (the direction of the arrow) in the diagram by being driven by the carriage motor 41, a wiping member 301 comes into contact with the nozzle plate 150 (the nozzle surface).

Here, since the wiping member 301 is configured by a flexible rubber member or the like, the front end portion which comes into contact with the nozzle plate 150 of the wiping member 301 bends and the surface of the nozzle plate 150 (the nozzle surface) is cleaned (wiped off) by the front end section of the wiping member 301 as shown in FIG. 37B. Due to this, it is possible to remove foreign material (for example, paper dust, dirt which floats in the air, pieces of rubber, and the like) such as paper dust which is attached to the nozzle plate 150 (the nozzle surface). In addition, by moving the upper part of the wiper 300 back and forth in the printing means 3, it is possible to carry out the wiping process a plurality of times according to the attachment state of the foreign material (in a case where a large amount of foreign material is attached).

Figure 38:
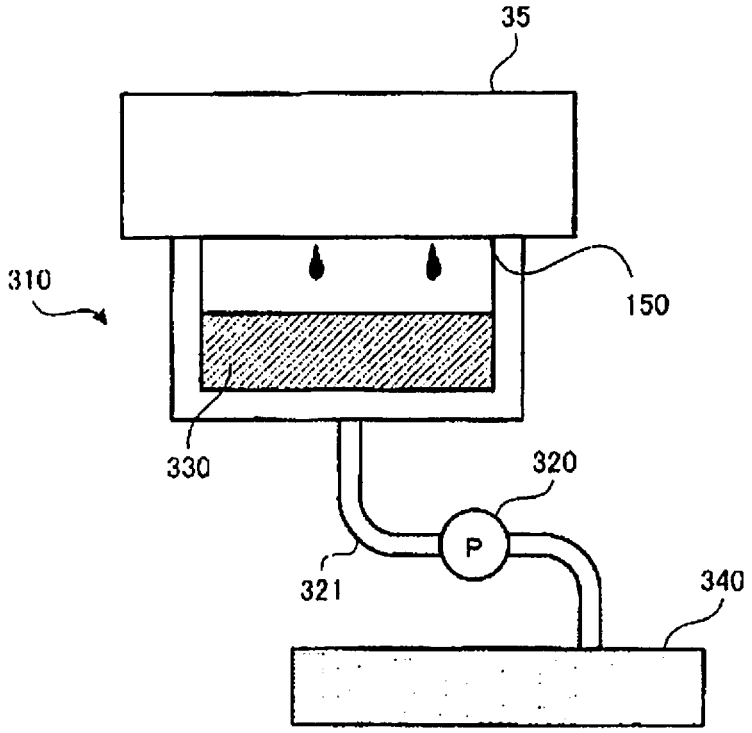
FIG. 38 is a diagram illustrating a relationship between the head unit, a cap, and a pump during a pump suction process.

FIG. 38 is a diagram illustrating a relationship between the head unit 35, the cap 310, and the pump 320 in the pump suction process. The tube 321 forms an ink output path in the pumping process (the pump suction process) and one end of the tube 321 is connected with the bottom section of the cap 310 as described above and the other end is connected with a waste ink cartridge 340 via the tube pump 320.

An ink absorbing body 330 is arranged in the bottom surface of the inner section of the cap 310. The ink absorbing body 330 absorbs and temporarily stores ink which is discharged from the nozzles 110 of the ink jet heads 100 in the pump suction process or the flushing process. Here, due to the ink absorbing body 330, it is possible to prevent the liquid droplets which are discharged from bouncing back and contaminating the nozzle plate 150 during the flushing operation inside the cap 310.

Figure 39A:
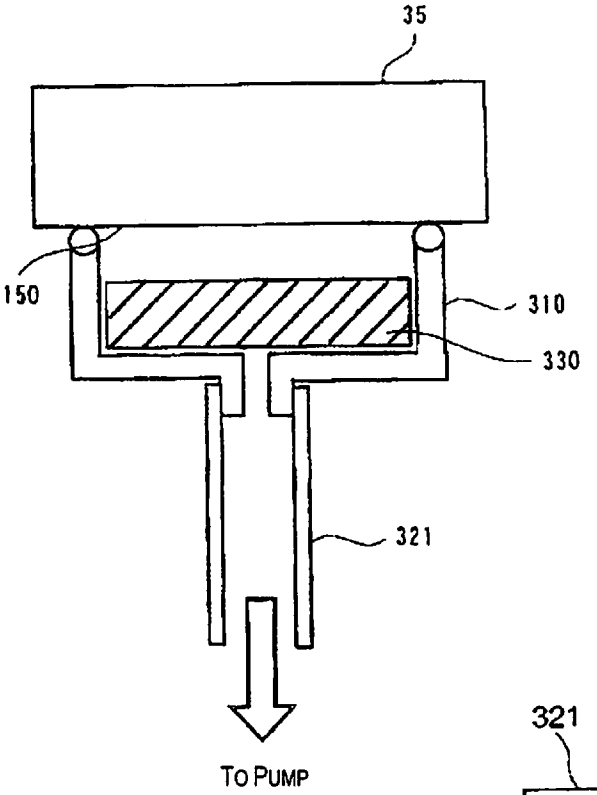
FIGS. 39A and 39B are schematic diagrams illustrating a configuration of a tube pump shown in FIG. 38.
Figure 39B:
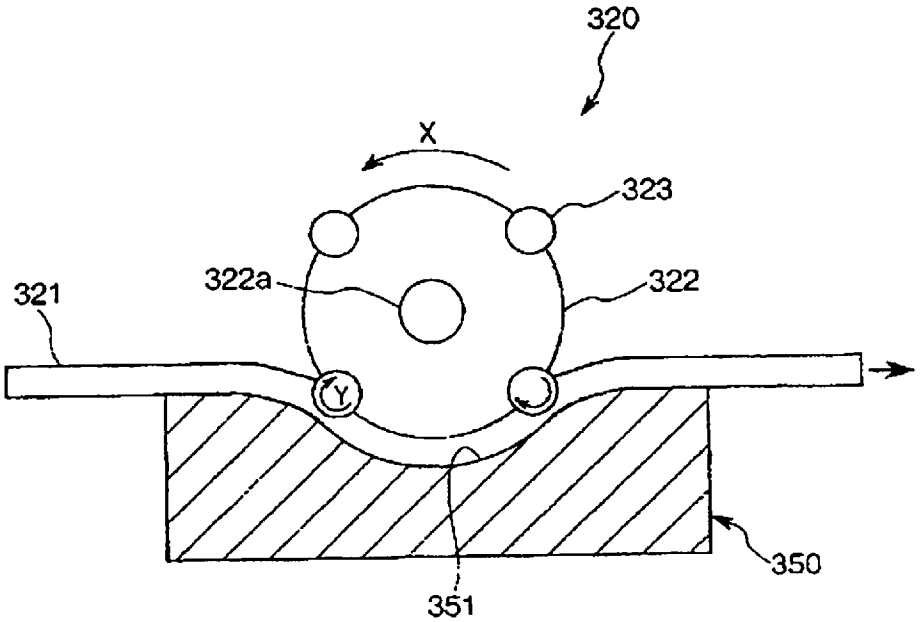

FIGS. 39A and 39B are schematic diagrams illustrating a configuration of the tube pump 320 shown in FIG. 38. As shown in FIG. 39B, the tube pump 320 is a rotary pump and is provided with a rotating body 322, four rollers 323 which are arranged at a circumference section of the rotating body 322, and a guide member 350. Here, the roller 323 is supported by the rotating body 322 and pressurizes the flexible tube 321 which is placed in an arc shape along a guide 351 of the guide member 350.

While one or two of the two rollers 323 which come into contact with the tube 321 rotate in the Y direction due to the rotating body 322 rotating in the X direction of the arrow shown in FIGS. 39A and 39B centering on a shaft 322*a*, the tube pump 320 sequentially pressurizes the tube 321 which is placed in the guide 351 with an arc shape in the guide member 350. Due to this, the tube 321 changes shape, the ink (the material in liquid form) inside the cavities 141 of each of the ink jet heads 100 is suctioned via the cap 310 due to the negative pressure which is generated inside the tube 321, unnecessary ink which is thickened by the mixing in of air bubbles or by drying is output to the ink absorbing body 330 via the nozzles 110, and the waste ink which is absorbed by the ink absorbing body 330 is output to the waste ink cartridge 340 (refer to FIG. 38) via the tube pump 320.

Here, the tube pump 320 is driven by a motor such as a pulse motor which is not shown in the diagram. The pulse motor is controlled by the control section 6. Driving information with regard to the rotational control of the tube pump 320, for example, a look up table where the rotation speed and the number of rotations are recorded, a control program where the sequence control is recorded, and the like are held in the PROM 64 or the like of the control section 6 and the control of the tube pump 320 is performed by the CPU 61 of the control section 6 based on the driving information.

Figure 40:
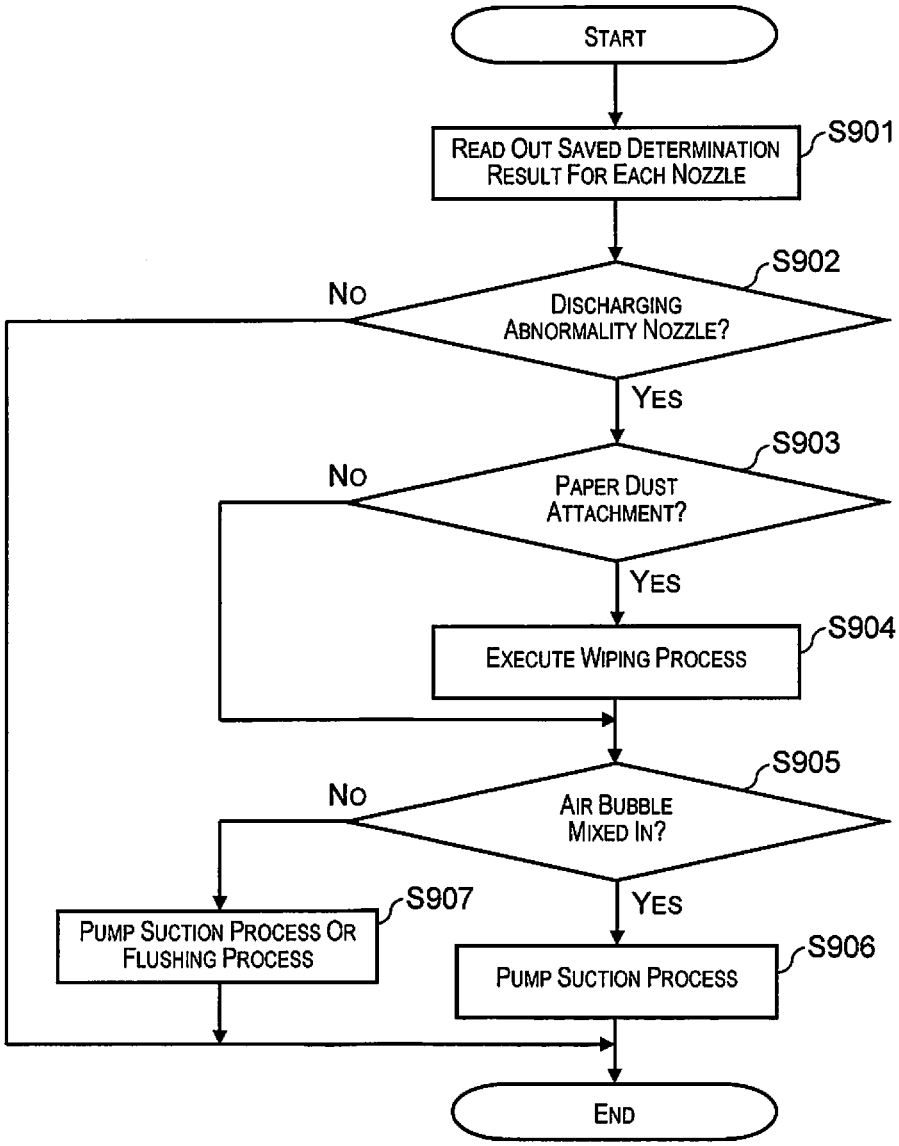
FIG. 40 is a flow chart illustrating a discharge abnormality recovery process in the ink jet printer of the present invention.

Next, the operation of the recovery means 24 (the discharging abnormality recovery process) will be described. FIG. 40 is a flow chart illustrating the discharge abnormality recovery process in the ink jet printer 1 (the liquid droplet discharging apparatus) of the present invention. When the nozzle 110 with a discharging abnormality is detected and the cause of the discharging abnormality is determined in the discharging abnormality detecting and determining processes described above (refer to the flow chart in FIG. 24), the discharging abnormality recovery process is performed at a predetermined timing where the printing operation or the like is not performed by the printing means 3 being moved up to a predetermined standby region (for example, a position where the nozzle plate 150 of the printing means 3 is covered with the cap 310 in FIG. 36 or a position where it is possible to carry out the wiping process using the wiper 300).

Firstly, the control section 6 reads out the determination results corresponding to each of the nozzles 100 which are saved in the EEPROM 62 of the control section 6 in step S107 in FIG. 24 (here, the determination results are for each of the ink jet heads 100 and not the determination results for content which is limited to each of the nozzles 110, and as a result, below, the nozzles 110 with the discharging abnormalities also have the meaning of the ink jet heads 100 where the discharging abnormalities are generated) (step S901). In step S902, the control section 6 determines whether or not there are nozzles 110 with discharging abnormalities in the determination results which are read out. Then, in a case where it is determined that there are no nozzles 110 with discharging abnormalities, that is, in a case where the liquid droplets are discharged normally from all of the nozzles 110, the discharging abnormality recovery process finishes as it is.

On the other hand, in a case where it is determined that some of the nozzles 110 have discharging abnormalities, the control section 6 determines in step S903 whether or not paper dust is attached to the nozzles 110 which are determined to have discharging abnormalities. Then, in a case where it is determined that the paper dust is not attached to the vicinity of the outlet ports of the nozzles 110, the process moves to step S905, and in a case where it is determined that paper dust is attached, the wiping process is executed on the nozzle plate 150 using the wiper 300 described above (step S904).

In step S905, subsequently, the control section 6 determines whether or not air bubbles are mixed into the nozzles 110 which are determined as having discharging abnormalities described above. Then, in a case where it is determined that the air bubbles are mixed in, the control section 6 executes the pump suction process using the tube pump 320 with regard to all of the nozzles 110 (step S906), and the discharging abnormality recovery process is finished. On the other hand, in a case where it is determined that air bubbles are not mixed in, the control section 6 executes the pump suction process using the tube pump 320 or a flushing process with regard to only the nozzles 110 which are determined to have a discharging abnormality or to all of the nozzles 110 based on the length of the cycle of the residual vibration of the diaphragm 121 which is measured by the measuring means 17 described above (step S907), and the discharging abnormality recovery process is finished.

Figure 41:
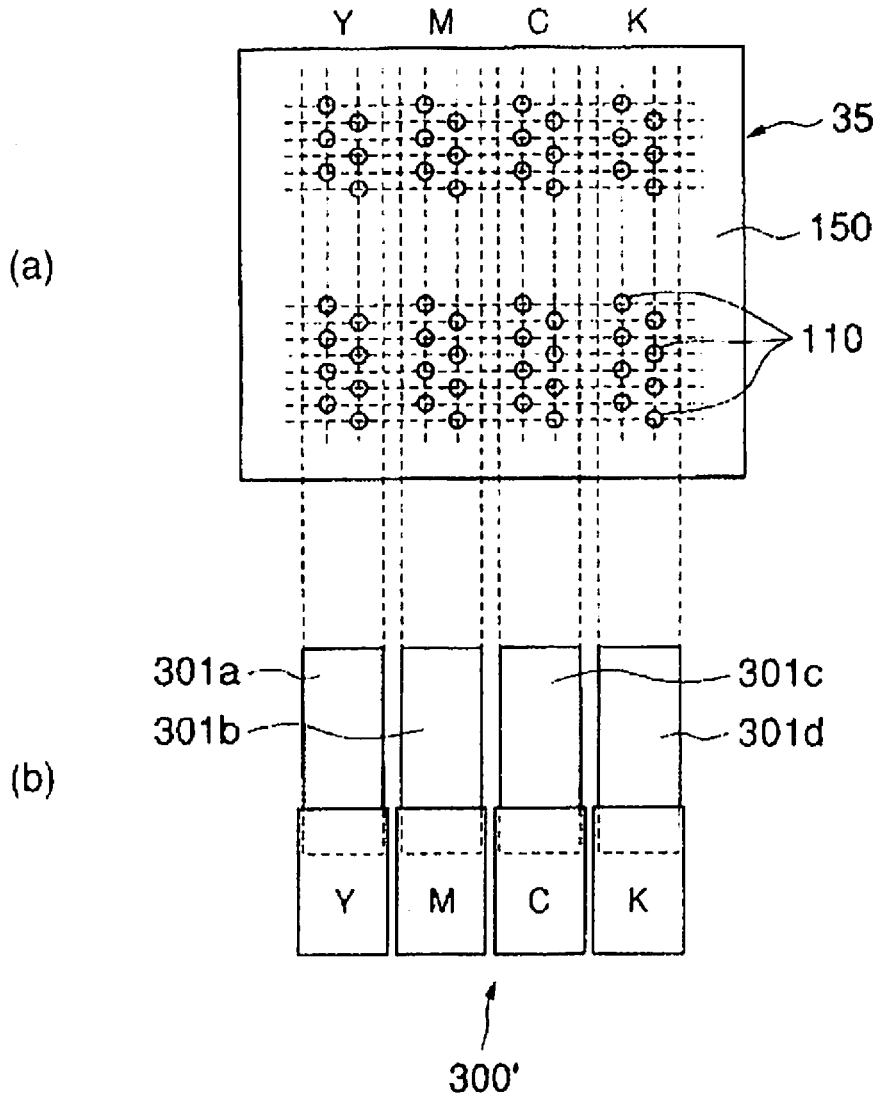
FIG. 41 includes diagrams (a) and (b) for describing another configuration example of a wiper (a wiping means), where the diagram (a) is a diagram illustrating a nozzle surface of a printing means (a head unit) and the diagram (b) is a diagram illustrating the wiper.
Figure 42:
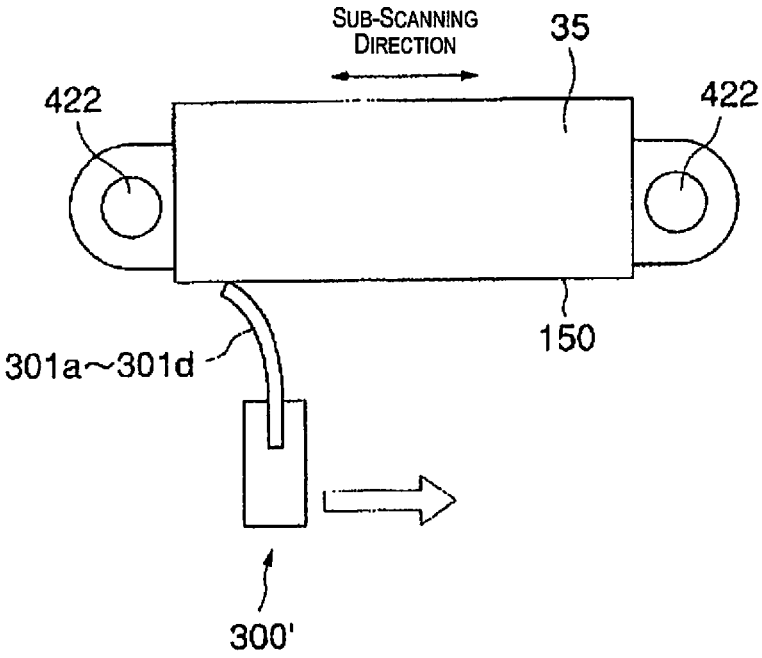
FIG. 42 is a diagram illustrating an operating state of the wiper shown in the diagrams (a) and (b) of FIG. 41.

FIG. 41 includes diagrams (a) and (b) for describing another configuration example (a wiper 300') of a wiper (a wiping means), where the diagram (a) of FIG. 41 is a diagram illustrating the nozzle surface (the nozzle plate 150) of the printing means 3 (the head unit 35) and the diagram (b) is a diagram illustrating the wiper 300'. FIG. 42 is a diagram illustrating an operating state of the wiper 300' shown in FIG. 41.

Below, the wiper 300' which is another configuration example of the wiper will be described based on these diagrams, but the description will center on the points of difference with the wiper 300 described above and description of the same items will be omitted.

As shown in the diagram (a) of FIG. 41, the plurality of nozzles 110 are divided into four sets of nozzle groups on the nozzle surface of the printing means 3 to correspond to inks of each color of yellow (Y), magenta (M), cyan (C), and black (K). The wiper 300' of the present configuration example is able to carry out separate wiping processes for each of the nozzle groups of each of the colors with regard to the four sets of nozzle groups due to a configuration which is described later.

As shown in the diagram (b) of FIG. 41, the wiper 300' has a wiping member 301*a* for the yellow nozzle group, a wiping member 301*b* for the magenta nozzle group, a wiping member 301*c* for the cyan nozzle group, and a wiping member 301*d* for the black nozzle group. As shown in FIG. 42, each of the wiping members 301*a* to 301*d* is independent and able to move in the sub-scanning direction using moving mechanisms which are not shown in the diagram.

The wiper 300 described above carries out a wiping process with regard to the nozzle surfaces of all of the nozzles 110 at one time, but since it is possible to wipe only the nozzle groups where the wiping process is necessary using the wiper 300' of the present configuration example, it is possible to perform a recovery process which is not wasteful.

Figure 43:
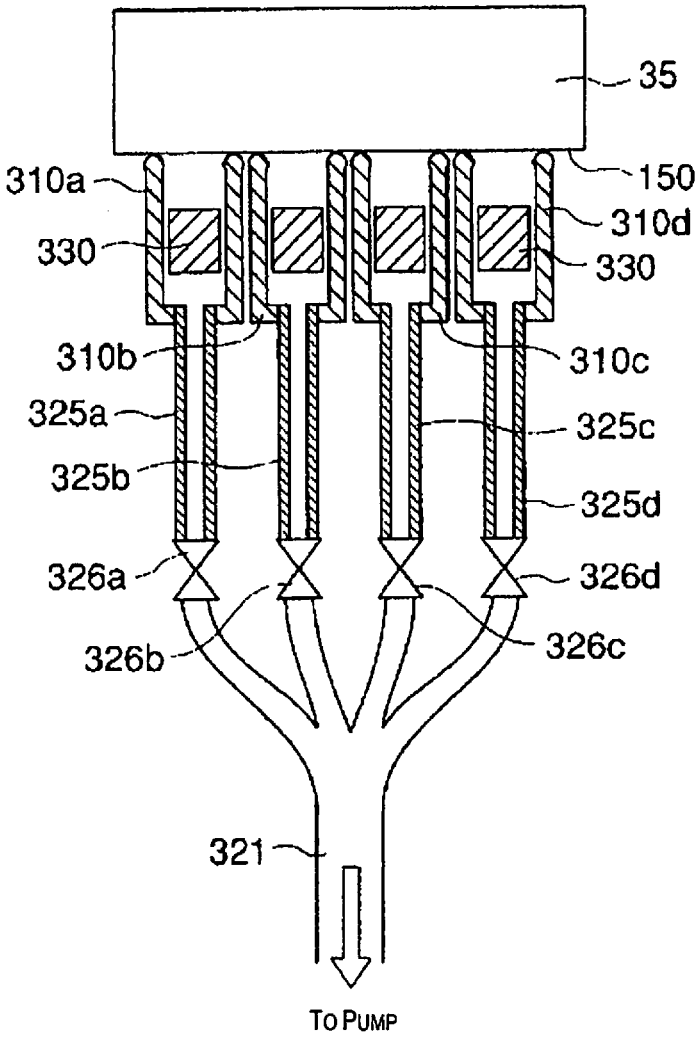
FIG. 43 is a diagram for describing another configuration example of a pumping means.

FIG. 43 is a diagram for describing another configuration example of the pumping means. Below, other configuration examples of the pumping means will be described based on this diagram, but the description will center on the points of difference with the pumping means described above and description of the same items will be omitted.

As shown in FIG. 43, the pumping means of the present configuration example has a cap 310*a* for the yellow nozzle group, a cap 310*b* for the magenta nozzle group, a cap 310*c* for the cyan nozzle group, and a cap 310*d* for the black nozzle group.

The tube 321 of the tube pump 320 is branched into four branch tubes 325*a* to 325*d* and each of the branch tubes 325*a* to 325*d* are respectively connected with each of the caps 310*a* to 310*d*. Valves 326*a* to 326*d* are respectively provided in the middle of each of the branch tubes 325*a* to 325*d*.

The pumping means of the present configuration example described above is able to carry out separate pump suction processes for each of the nozzle groups of each of the colors with regard to the four sets of nozzle groups of the printing means 3 by selecting the opening and closing of each of the valves 326*a* to 326*d*. Due to this, since it is possible to suction only the nozzle groups where the pump suction process is necessary, it is possible to perform a recovery process which is not wasteful. Here, an example where the tube pump 320 carries out suction with the four different colors in the same tube 321 is shown in FIG. 43, but the tubes in the tube pump 320 may be separated for the four colors.

Here, in a case where detection is performed using the discharging abnormality detecting means 10 with regard to all of the nozzles 110, the ink jet printer 1 of the present invention as described above operates with the flow as will be described next. Below, two patterns will be described in sequence for the ensuing flow of the operation after a case where detection is performed using the discharging abnormality detecting means 10 in the ink jet printer 1 of the present invention, but first, the first pattern will be described.

[1A] The ink jet printer 1 performs detection with regard to all of the nozzles 110 using the discharging abnormality detecting means 10 as described above during the flushing process (the flushing operation) or during the printing operation.

As a result of this detection, when there is the nozzle 110 (referred to below as an "abnormal nozzle") where a discharging abnormality is generated, it is preferable that the ink jet printer 1 provide notification to that effect. The means (method) of notification is not particularly limited and may be of any type of, for example, a means using display on the operation panel 7, sound, an audible alarm, or the flashing of a lamp, a means where the respective discharging abnormality information is transmitted through an interface 9 to the host computer 8 or the like or through a network to the print server or the like.

[2A] When there is the nozzle 110 (an abnormal nozzle) where a discharging abnormality is generated in the results of the detection in [1A], the recovery process is performed by the recovery means 24 (by interrupting the printing operation in a case where the printing operation is underway). In this case, as shown in the flow chart of FIG. 40 described above, the recovery means 24 performs the recovery process of the type which corresponds to the cause of the discharging abnormality of the abnormal nozzle. Due to this, for example, since the pump suction process is not performed in a case where the cause of the discharging abnormality of the abnormal nozzle is paper dust attachment, that is, in cases where it is not necessary for the pump suction process to be performed, it is possible to prevent the wasteful output of ink and it is possible to reduce the amount of consumed ink. In addition, since a recovery process of a type which is not necessary is not performed, it is possible to shorten the time which is required for the recovery process, and an improvement in throughput (the number of printed sheets per unit of time) of the ink jet printer 1 is achieved.

In addition, the recovery process may be performed with regard to all of the nozzles 110, but it is sufficient if the recovery process is performed with regard to at least the abnormal nozzles. For example, in a case where the flushing process is performed as the recovery process, the flushing operation may be performed only in the abnormal nozzles. In addition, in a case where the wiping means and the pumping means are configured so as to be able to perform the recovery processes separately for each of the nozzle groups for each color as shown in FIG. 41 to FIG. 43, the wiping process or the pumping suction process may be carried out with regard to only the nozzle group which includes the abnormal nozzles which are detected in [1A].

In addition, in a case where a plurality of the abnormal nozzles where the causes of the discharging abnormalities are different are detected in [1A], it is preferable to perform a plurality of types of recovery processes such that it is possible to eliminate the causes of all of the discharging abnormalities.

[3A] When the recovery process of [2A] is finished, the liquid droplet discharging operation is performed only with regard to the abnormal nozzles which are detected in [1A] and detecting using the discharging abnormality detecting means 10 is performed again only with regard to the abnormal nozzles. Due to this, since it is possible to confirm whether or not the abnormal nozzles which are detected in [1A] are restored to the normal state, it is possible to more reliably prevent generation of discharging abnormalities in the subsequent printing operations.

In addition, here, since detecting using the discharging abnormality detecting means 10 is performed by performing the liquid droplet discharging operation only in the abnormal nozzles, it is not necessary to discharge ink droplets from the nozzles 110 which were normal in [1A]. As such, it is possible to reduce the amount of ink consumption by avoiding the wasteful discharging of ink. Furthermore, it is possible to reduce the burden on the discharging abnormality detecting means 10 and the control section 6.

Here, in a case where there was the nozzle 110 with a discharging abnormality according to the detection in [3A], it is preferable to perform the recovery process again using the recovery means 24.

Below, the second pattern of the ensuing flow of the operation after a case where detecting is performed using the discharging abnormality detecting means 10 in the ink jet printer 1 of the present invention will be described. That is, control in the present invention may be performed with the flow as in the following [1B] to [5B] instead of [1A] to [3A].

[1B] In the same manner as [1A] described above, detecting is performed using the discharging abnormality detecting means 10 with regard to all of the nozzles 110.

[2B] As a result of detecting in [1B], when there is the nozzle 110 (referred to below as the "abnormal nozzle") where a discharging abnormality is generated, the flushing process is executed only with regard to the abnormal nozzle (by interrupting the printing operation in a case where the printing operation is underway). In a case where the cause of the discharging abnormality of the abnormal nozzle is minor or the like, it is possible to restore the abnormal nozzles to the normal state using the flushing process. In addition, since the ink droplets are not discharged from the nozzles 110 which were normal at this time, the ink is not wastefully consumed. Since it is often the case that the cause of the discharging abnormalities is minor when the detection using the discharging abnormality detecting means 10 is frequently performed or the like, it is possible to perform the recovery process efficiently and rapidly by performing the flushing process first on the abnormal nozzles regardless of the cause of the discharging abnormalities.

[3B] When the flushing process of [2B] is finished, the liquid droplet discharging operation is performed only with regard to the abnormal nozzles which are detected in [1B] and detecting using the discharging abnormality detecting means 10 is performed again only with regard to the abnormal nozzles. Due to this, since it is possible to confirm whether or not the abnormal nozzles which were detected in [1B] are restored to the normal state, it is possible to more reliably prevent generation of discharging abnormalities in the subsequent printing operations.

In addition, here, since detecting using the discharging abnormality detecting means 10 is performed by performing the liquid droplet discharging operation only in the abnormal nozzles, it is not necessary to discharge ink droplets from the nozzles 110 which were normal in [1B]. As such, it is possible to reduce the amount of ink consumption by avoiding the wasteful discharging of ink. Furthermore, it is possible to reduce the burden on the discharging abnormality detecting means 10 and the control section 6.

[4B] As a result of detecting in [3B], when there is the nozzle 110 (referred to below as a "still abnormal nozzle") where the discharging abnormality is not eliminated, the recovery process is performed using the recovery means 24. In this case, the recovery means 24 performs a recovery process of a type according to the cause of the discharging abnormality of the still abnormal nozzle as in the flow chart of FIG. 40 described above. As a result, for example, since the pump suction process is not performed in a case where the cause of the discharging abnormality of the still abnormal nozzle is paper dust attachment, that is, in cases where it is not necessary for the pump suction process to be performed, it is possible to prevent the wasteful output of ink and it is possible to reduce the amount of consumed ink. In addition, since a recovery process of a type which is not necessary is not performed, it is possible to shorten the time which is required for the recovery process, and an improvement in throughput (the number of printed sheets per unit of time) of the ink jet printer 1 is achieved.

In addition, since the flushing process is performed in [2B], it is preferable to perform the other recovery processes in [4B]. That is, it is preferable that the pump suction process be executed in a case where the cause of the discharging abnormality of the still abnormal nozzle is the mixing in of air bubbles or thickening due to drying and that the wiping process be performed using the wiper 300 or 300' in a case of paper dust attachment.

Here, the points in [4B] other than the points described above are the same as in [2A].

[5B] When the recovery process of [4B] is finished, the liquid droplet discharging operation is performed only with regard to the still abnormal nozzles which are detected in [3B] and detecting using the discharging abnormality detecting means 10 is performed again only with regard to the still abnormal nozzles. Due to this, since it is possible to confirm whether or not the still abnormal nozzles which were detected in [3B] are restored to the normal state, it is possible to even more reliably prevent generation of discharging abnormalities in the subsequent printing operations.

In addition, here, since detecting using the discharging abnormality detecting means 10 is performed by performing the liquid droplet discharging operation only in the still abnormal nozzles, it is not necessary to discharge ink droplets from the nozzles 110 which were normal in [1B] or [3B]. As such, it is possible to reduce the amount of ink consumption by avoiding the wasteful discharging of ink. Furthermore, it is possible to reduce the burden on the discharging abnormality detecting means 10 and the control section 6.

In [1A] to [3A] and [1B] to [5B] described above, after the recovery process is performed according to the cause of the discharging abnormality, it is preferable that the flushing process be performed with regard to each of the nozzles 110 (all of the nozzles 110). Due to this, it is possible to prevent the ink of each of the colors which remain on the nozzle surface (the nozzle plate 150) from mixing, and it is possible to prevent the color mixing of the inks.

In the liquid droplet discharging apparatus of the present embodiment as described above, compared to liquid droplet discharging apparatuses which are able to detect discharging abnormalities in the prior art, since other components (for example, an optical missing dot detection apparatus or the like) are not necessary, it is possible to detect discharging abnormalities of the liquid droplets without increasing the size of the liquid droplet discharging heads and it is possible to suppress manufacturing costs of the liquid droplet discharging apparatus which is able to perform detecting of discharging abnormalities (missing dots) to be low. In addition, since the discharging abnormalities of the liquid droplets are detected using residual vibration of the diaphragm after the liquid droplet discharging operation, it is possible to detect discharging abnormalities of the liquid droplet during a recording operation.

Second Embodiment

Next, another configuration example of the ink jet head in the present invention will be described. FIG. 44 to FIG. 47 are each cross sectional diagrams illustrating a schematic of another configuration example of the ink jet head (the head unit). Below, description will be given based on these diagrams, but the description will center on the points of difference with the embodiment described above and description of the same items will be omitted.

Figure 44:
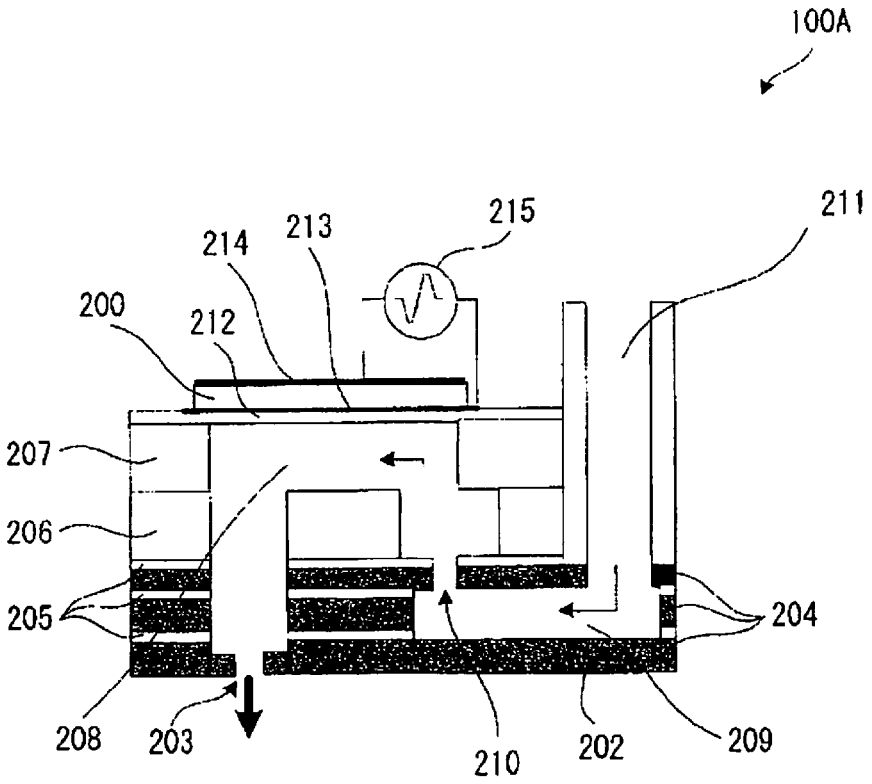
FIG. 44 is a cross sectional diagram illustrating a schematic of another configuration example of the ink jet head in the present invention.

In an ink jet head 100A shown in FIG. 44, a diaphragm 212 is vibrated by the driving of a piezoelectric element 200 and the ink (the liquid) inside a cavity 208 is discharged from nozzles 203. A metal plate 204 which is made of stainless steel is bonded via an adhesive film 205 to a nozzle plate 202 which is made of stainless steel where the nozzles (holes) 203 are formed, and another of the same metal plate 204 which is made of stainless steel is bonded on top via the adhesive film 205. Then, a linking port forming plate 206 and a cavity plate 207 are bonded in sequence on top of the above.

The nozzle plate 202, the metal plate 204, the adhesive film 205, the linking port forming plate 206, and the cavity plate 207 are each formed into a predetermined shape (a shape such that a concave section is formed) and the cavity 208 and a reservoir 209 are formed by superimposing the plates. The cavity 208 and the reservoir 209 are linked via an ink supply port 210. In addition, the reservoir 209 is linked with an ink intake port 211.

The diaphragm 212 is installed in an upper surface of an opening section of the cavity plate 207 and the piezoelectric element (piezo element) 200 is bonded to the diaphragm 212 via a lower section electrode 213. In addition, an upper section electrode 214 is bonded to the piezoelectric element 200 on the opposite side to the lower section electrode 213. A head drive 215 is provided with a driving circuit which generates a driving voltage waveform and vibrates the piezoelectric element 200 and the diaphragm 212 which is bonded with the piezoelectric element 200 by applying (supplying) the driving voltage waveform between the upper section electrode 214 and the lower section electrode 213. The volume of the cavity 208 (the pressure inside the cavities) is changed according to the vibration of the diaphragm 212 and the ink (the liquid) which is filled inside the cavity 208 is discharged as liquid droplets using the nozzles 203.

The amount of liquid inside the cavity 208 which is reduced due to the discharging of the liquid droplets is replenished by ink which is supplied from the reservoir 209. In addition, ink from the ink intake port 211 is supplied to the reservoir 209.

Figure 45:
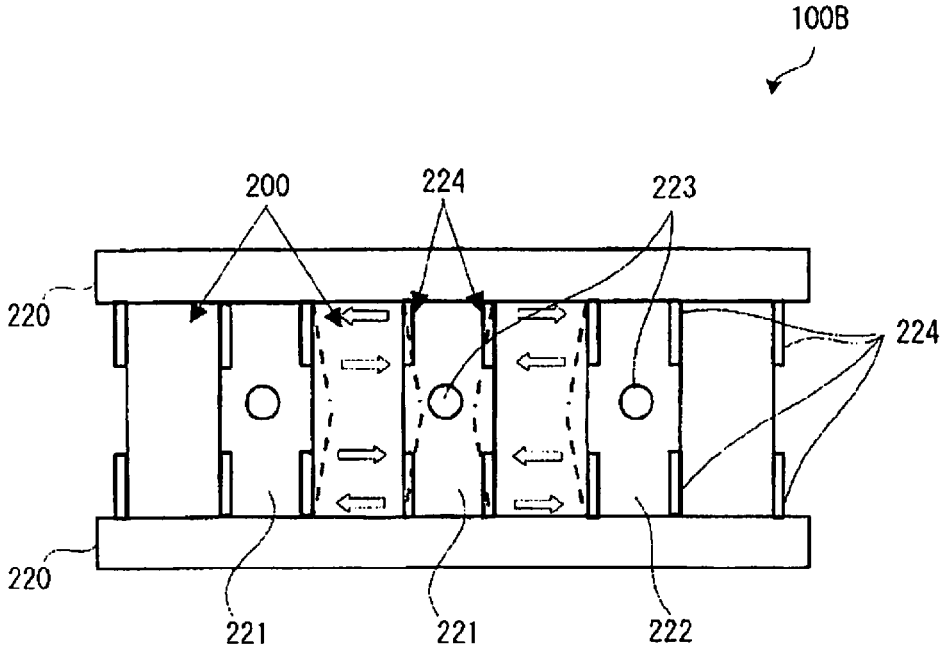
FIG. 45 is a cross sectional diagram illustrating a schematic of another configuration example of the ink jet head in the present invention.

In an ink jet head 100B shown in FIG. 45, the ink (the liquid) inside a cavity 221 is discharged from the nozzles due to driving of the piezoelectric element 200 in the same manner as described above. The ink jet head 100B has a pair of substrates 220 which face each other and a plurality of the piezoelectric elements 200 are installed intermittently at predetermined gaps between both of the substrates 220.

The cavities 221 are formed between the piezoelectric elements 200 which are in contact with each other. A plate (which is not shown in the diagram) is installed at the front of the cavities 221 in FIG. 45, a nozzle plate 222 is installed at the rear, and nozzles (holes) 223 are formed in the nozzle plate 222 at positions which correspond to each of the cavities 221.

A pair of electrodes 224 is installed at each of one surface and the other surface of each of the piezoelectric elements 200. That is, four of the electrodes 224 are bonded with regard to one piezoelectric element 200. By applying a predetermined driving voltage waveform between predetermined electrodes out of the electrodes 224, the piezoelectric elements 200 vibrate by changing shape into the shear mode (shown by the arrow in FIG. 45), the volume of the cavities 221 (the pressure inside the cavities) is changed due to the vibration, and the ink (the liquid) which is filled inside the cavities 221 is discharged as liquid droplets using the nozzles 223. That is, the piezoelectric element 200 itself functions as a diaphragm in the ink jet head 100B.

Figure 46:
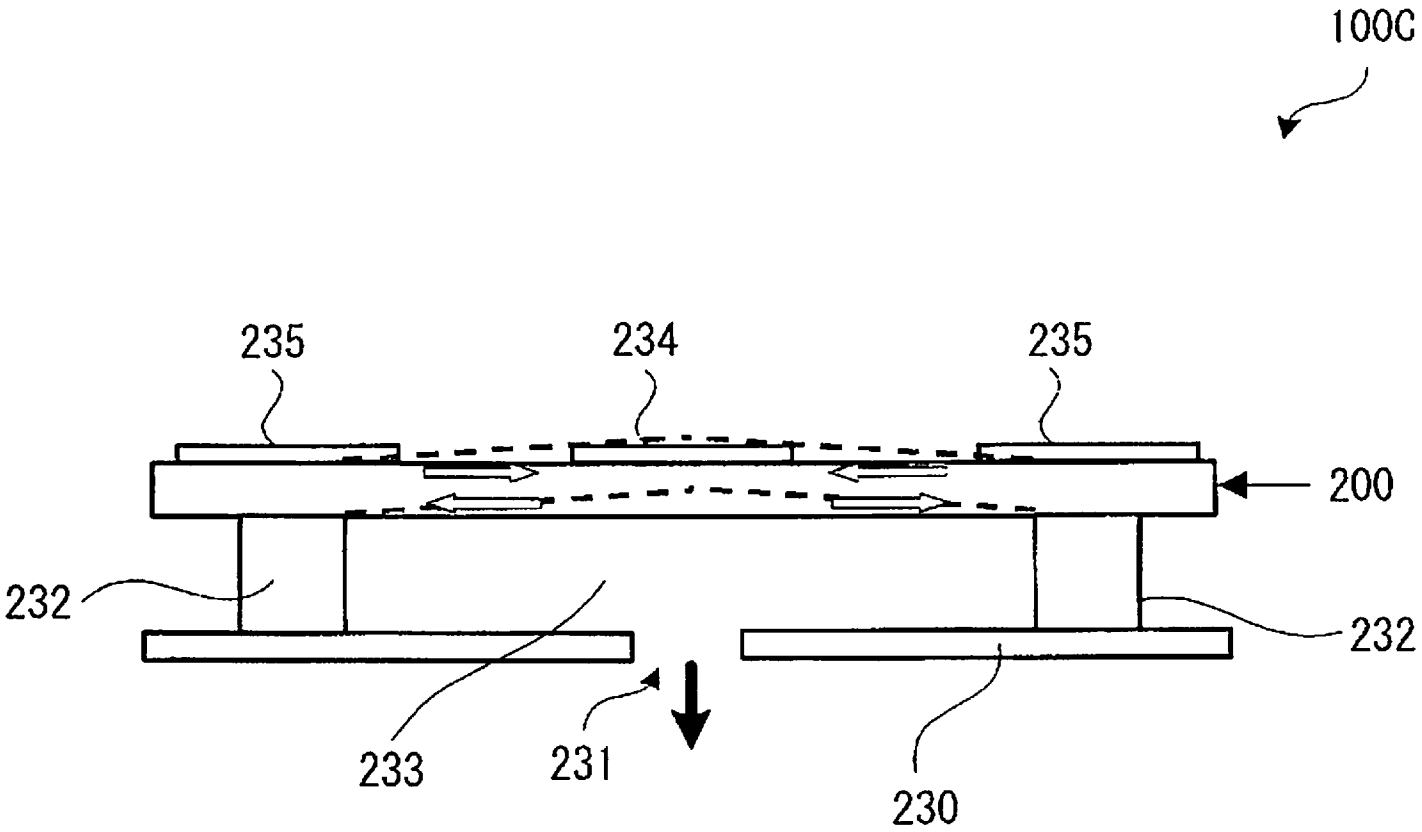
FIG. 46 is a cross sectional diagram illustrating a schematic of another configuration example of the ink jet head in the present invention.

In an ink jet head 100C shown in FIG. 46, the ink (the liquid) inside a cavity 233 is discharged from the nozzles 231 due to driving of the piezoelectric elements 200 in the same manner as described above. The ink jet head 100C is provided with a nozzle plate 230 where a nozzle 231 is formed, a spacer 232, and the piezoelectric elements 200. The piezoelectric elements 200 are installed to be spaced at a predetermined distance with regard to the nozzle plate 230 via the spacer 232 and a cavity 233 is formed in a space which is surrounded by the nozzle plate 230, the piezoelectric elements 200, and the spacers 232.

A plurality of electrodes are bonded with the upper surface of the piezoelectric elements 200 in FIG. 46. That is, a first electrode 234 is bonded with the approximate central portion of the piezoelectric element 200 and second electrodes 235 are each bonded to both side sections of the first electrode 234. By applying a predetermined driving voltage waveform between the first electrode 234 and the second electrode 235, the piezoelectric element 200 vibrates by changing shape into the shear mode (shown by the arrow in FIG. 46), the volume of the cavity 233 (the pressure inside the cavity) is changed due to the vibration, and the ink (the liquid) which is filled inside the cavity 233 is discharged as liquid droplets by the nozzle 231. That is, the piezoelectric element 200 itself functions as a diaphragm in the ink jet head 100C.

Figure 47:
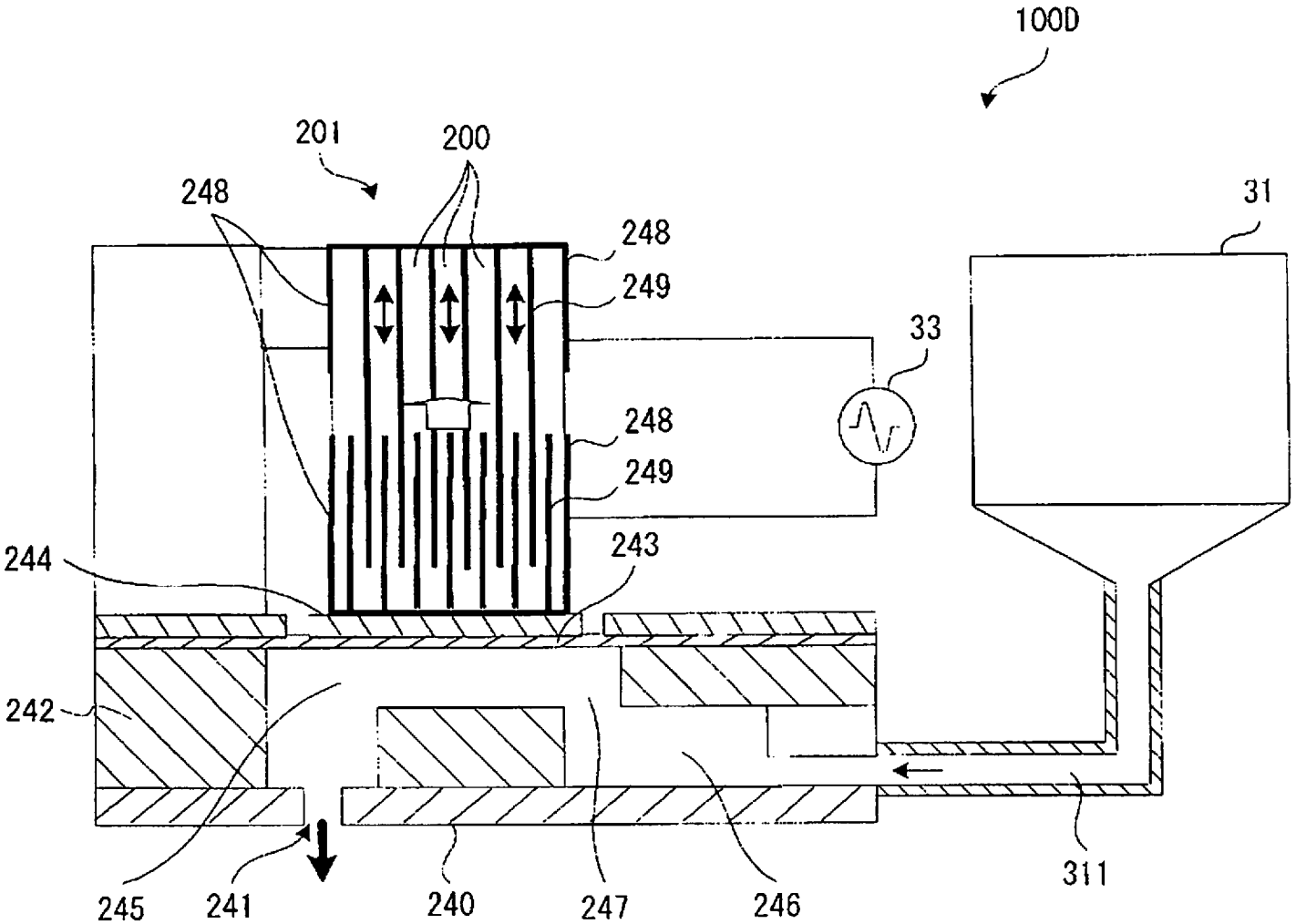
FIG. 47 is a cross sectional diagram illustrating a schematic of another configuration example of the ink jet head in the present invention.

In an ink jet head 100D shown in FIG. 47, the ink (the liquid) inside a cavity 245 is discharged from a nozzle 241 due to driving of the piezoelectric elements 200 in the same manner as the above. The ink jet head 100D is provided with a nozzle plate 240 where the nozzle 241 is formed, a cavity plate 242, a diaphragm 243, and a laminated piezoelectric element 201 where a plurality of piezoelectric elements 200 are laminated.

The cavity plate 242 is formed into a predetermined shape (a shape such that a concave section is formed) and the cavity 245 and a reservoir 246 are formed due to this. The cavity 245 and the reservoir 246 are linked via an ink supply port 247. In addition, the reservoir 246 is linked with the ink cartridge 31 via the ink supply tube 311.

The lower end of the laminated piezoelectric element 201 in FIG. 47 is bonded with the diaphragm 243 via an intermediate layer 244. A plurality of external electrodes 248 and internal electrodes 249 are bonded with the laminated piezoelectric element 201. That is, the external electrodes 248 are bonded with the outer surface of the laminated piezoelectric element 201 and the internal electrodes 249 are installed between each of the piezoelectric elements 200 which configure the laminated piezoelectric element 201 (or inside each of the piezoelectric elements). In this case, portions of the external electrodes 248 and the internal electrodes 249 are arranged so as to alternately overlap in the thickness direction of the piezoelectric element 200.

Then, by applying a driving voltage waveform between the external electrodes 248 and the internal electrodes 249 using the head driver 33, the laminated piezoelectric element 201 is vibrated by changing shape (expanding and contracting in the up and down direction in FIG. 47) as shown by the arrow in FIG. 47, and the diaphragm 243 vibrates due to the vibration. The volume (the pressure inside the cavity) of the cavity 245 is changed due to the vibration of the diaphragm 243 and the ink (the liquid) which is filled inside the cavity 245 is discharged as liquid droplets using the nozzle 241.

The amount of liquid inside the cavity 245 which is reduced due to the discharging of the liquid droplets is replenished by ink which is supplied from the reservoir 246. In addition, ink is supplied to the reservoir 246 from the ink cartridge 31 via the ink supply tube 311.

Also in the ink jet heads 100A to 100D which are provided with piezoelectric elements as described above, it is possible to detect abnormalities in discharging of liquid droplets or to specify causes of the abnormalities based on residual vibration of the diaphragm or of the piezoelectric elements which function as the diaphragm, in the same manner as the electrostatic capacity ink jet head 100 described above. Here, it is possible to adopt a configuration where the ink jet heads 100B and 100C are provided with the diaphragms (the diaphragms for detecting residual vibration) as sensors at positions which face the cavities and the residual vibration of the diaphragms is detected.

Third Embodiment

Figure 48:
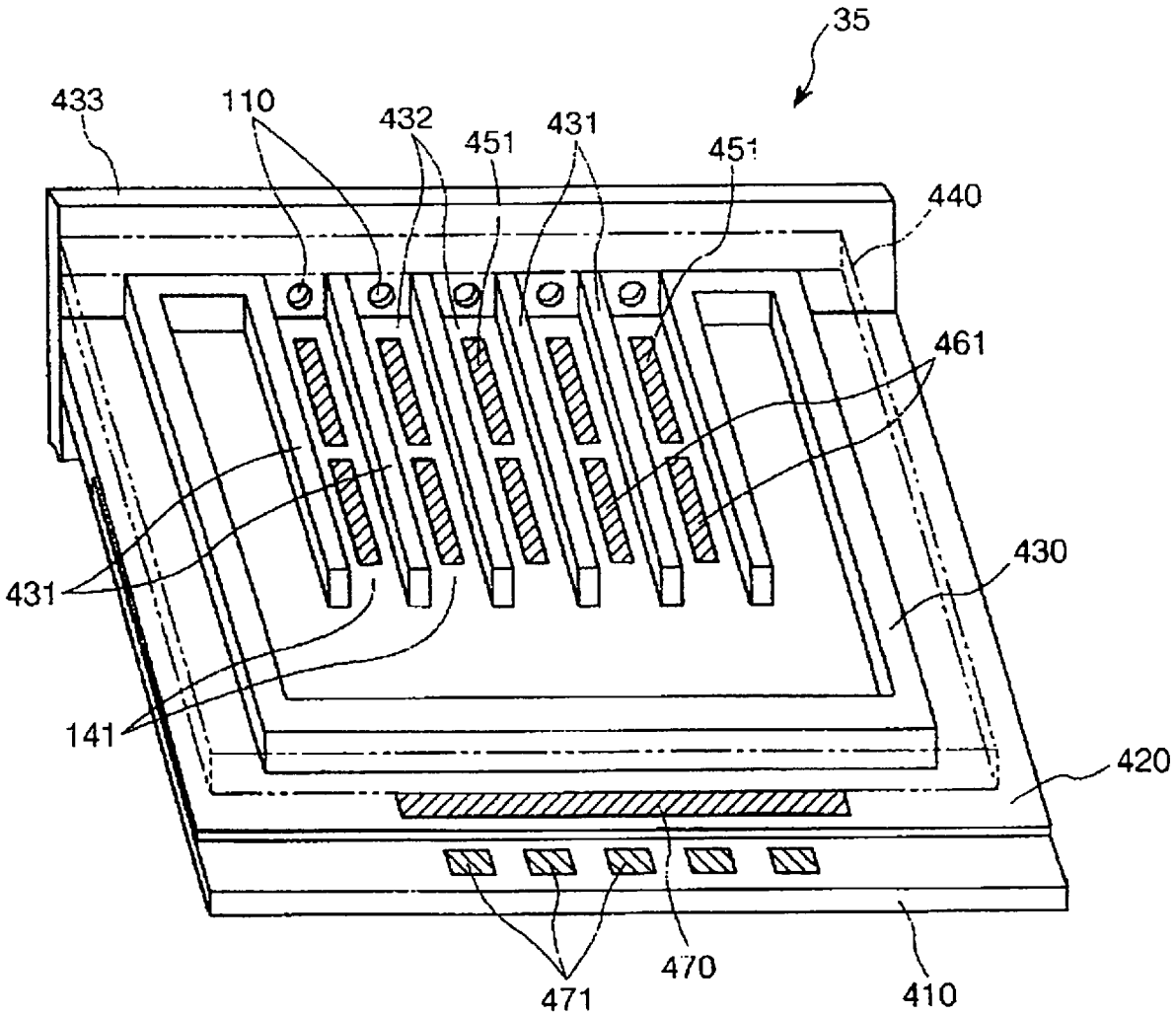
FIG. 48 is a perspective diagram illustrating a configuration of a head unit in a third embodiment.
Figure 49:
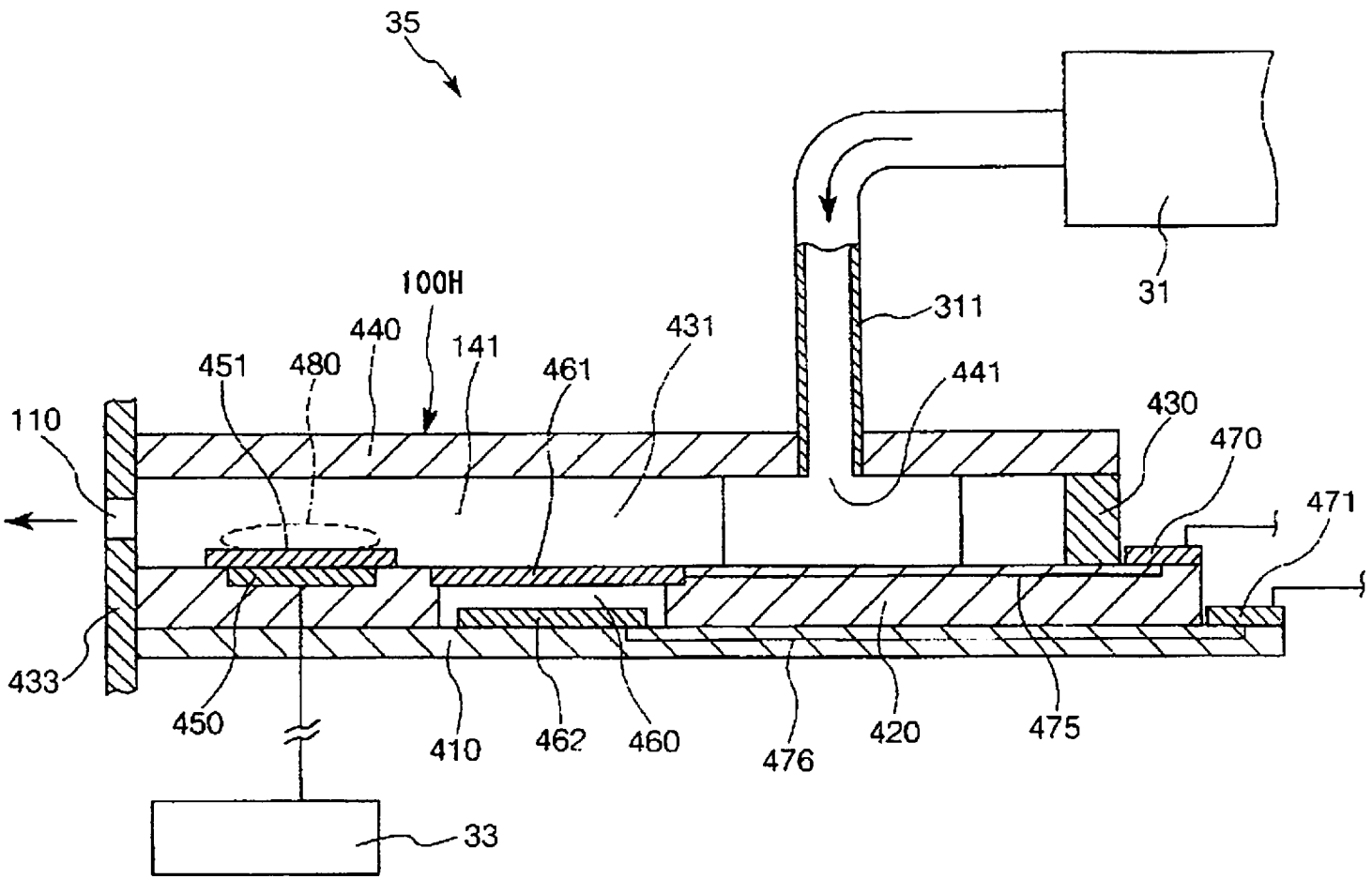
FIG. 49 is a cross sectional diagram of the head unit (the ink jet head) shown in FIG. 48.

Next, still another configuration example of the ink jet head in the present invention will be described. FIG. 48 is a perspective diagram illustrating a configuration of the head unit 35 in the present embodiment and FIG. 49 is a cross sectional diagram of the head unit 35 (an ink jet head 100H) shown in FIG. 48. Below, description will be given based on these diagrams, but the description will center on the points of difference with the embodiment described above and description of the same items will be omitted.

Since the head unit 35 (the ink jet head 100H) shown in FIG. 48 and FIG. 49 uses a so-called film boiling ink jet system (a thermal jet system), the head unit 35 has a configuration where a support plate 410, a substrate 420, an outer wall 430, a partition wall 431, and a ceiling plate 440 are bonded in this order from the lower side in FIG. 48 and FIG. 49.

The substrate 420 and the ceiling plate 440 are installed at predetermined intervals via the outer wall 430 and a plurality (six in the example shown in the diagram) of the partition walls 431 which are arranged to be parallel at equal intervals. Then, a plurality (five in the example shown in the diagram) of cavities (pressure chambers: ink chambers) 141 which are partitioned by the partition walls 431 are formed between the substrate 420 and the ceiling plate 440. Each of the cavities 141 is formed in a strip shape (a rectangular shape).

In addition, the end portions on the left side of each of the cavities 141 in FIG. 49 (the upper end in FIG. 48) are covered by a nozzle plate (the front plate) 433 as shown in FIG. 48 and FIG. 49. The nozzles (holes) 110 which are linked with each of the cavities 141 are formed in the nozzle plate 433 and ink (the material in liquid form) is discharged from the nozzles 110.

In FIG. 48, the nozzles 110 are arranged in straight lines, that is, in rows with regard to the nozzle plate 433, but it is obvious that the arrangement pattern of the nozzles is not limited to this.

Here, the upper ends (the left ends in FIG. 49) of each of the cavities 141 in FIG. 48 are opened without the nozzle plate 433 being provided and the opened openings are configured so as to become nozzles.

In addition, an ink intake port 441 is formed in the ceiling plate 440 and the ink intake port 441 is connected with the ink cartridge 31 via the ink supply tube 311.

Heating elements 450 are each installed (embedded) at locations which correspond to each of the cavities 141 of the substrate 420. Each of the heating elements 450 conducts electricity and generates heat independently at each of the locations according to the head driver (a conducting means) 33 which includes the driving circuit 18. The head driver 33 outputs a signal, for example, in pulse form as the driving signal of the heating elements 450 according to the printing signal (the printing data) which is input from the control section 6.

In addition, the surface of the heating elements 450 on the cavities 141 side is covered by a protective film (an anti-cavitation film) 451. The protective film 451 is provided in order to prevent the heating elements 450 from coming into direct contact with the ink inside the cavities 141. By providing the protective film 451, it is possible to prevent degeneration, deterioration, and the like due to the heating elements 450 coming into contact with the ink.

Concave sections 460 are each formed at locations which correspond to each of the cavities 141 in the vicinity of each of the heating elements 450 of the substrate 420. It is possible for the concave sections 460 to be formed, for example, using methods such as etching or punching.

Diaphragms 461 are installed so as to shield the cavities 141 side of the concave sections 460. The diaphragms 461 change shape elastically (is displaced elastically) in the up and down direction in FIG. 49 following changes in the pressure (the liquid pressure) inside the cavities 141.

The diaphragms 461 also function as electrodes. Even when the diaphragms 461 are entirely conductive, conductive layers and insulating layers may be laminated.

On the other hand, the other side of the concave sections 460 is covered with the support plate 410 and electrodes (segment electrodes) 462 are each installed in locations which correspond to each of the diaphragms 461 on the upper surface of the support plates 410 in FIG. 49.

The diaphragms 461 and the electrodes 462 are arranged so as to face each other to be approximately parallel at a predetermined interval distance.

In this manner, by arranging the diaphragms 461 and the electrodes 462 to be spaced at slight distance intervals, it is possible to form a parallel plate capacitor. Then, when the diaphragms 461 are elastically displaced (changes shape) in the up and down direction in FIG. 49 following the pressure inside the cavities 141, the interval distances between the diaphragms 461 and the electrodes 462 change according to the displacement, and the electrostatic capacity of the parallel plate capacitor changes. In the ink jet head 100H, the diaphragms 461 and the electrodes 462 function as sensors which detect abnormalities in the ink jet head 100H based on variation in electrostatic capacity due to the passing of time according to vibration (residual vibration (attenuated vibration)) of the diaphragms 461.

A common electrode 470 is formed outside the cavities 141 of the substrate 420. In addition, segment electrodes 471 are formed outside the cavities 141 of the support plate 410. It is possible for each of the electrodes 462, the common electrode 470, and the segment electrodes 471 to be formed, for example, using methods such as bonding of metal foils, plating, vapor deposition, and sputtering.

Each of the diaphragms 461 and the common electrode 470 are electrically connected by a conductor 475, and each of the electrodes 462 and each of the segment electrodes 471 are electrically connected by a conductor 476.

Examples of the conductors 475 and 476 respectively include [1] conductors where wires such as metal wires are arranged; [2] conductors which are formed of thin films formed of, for example, a conductive material such as gold or copper on the surface of the substrate 420 or the support plate 410; or [3] conductors where conductivity is imparted by carrying out ion doping or the like in conductor forming portions such as the substrate 420.

Next, actions (operating principle) of the ink jet head 100H will be described.

When electricity is conducted in the heating element 450 by a driving signal (a pulse signal) being output from the head driver 33, the heating element 450 instantly generates heat at a temperature of 300□ C. or more. Due to this, an air bubble (which is different to the air bubble which is mixed in and generated inside the cavity as a cause of discharging abnormalities described above) 480 is generated due to film boiling on the protective film 451 and the air bubble 480 instantly expands. Due to this, the liquid pressure of the ink (the material in liquid form) which is filled inside the cavities 141 expands and a portion of the ink is discharged from the nozzles 110 as liquid droplets.

The amount of liquid inside the cavities 141 which is reduced due to the discharging of the liquid droplets is replenished by new ink which is supplied from the ink intake port 441 into the cavities 141. The ink is supplied from the ink cartridge 31 through the inside of the ink supply tube 311.

Immediately after the liquid droplets of ink are discharged, the air bubble 480 shrinks rapidly and returns to the original state. The diaphragms 461 are elastically displaced (changes shape) due to changes in pressure inside the cavities 141 at this time and attenuated vibration (residual vibration) is generated until the next driving signal is input and the ink droplets are discharged again. When the diaphragms 461 generate attenuated vibration, the electrostatic capacity of the capacitor which is configured by the diaphragms 461 and the electrodes 462 which face the diaphragms 461 changes according to the attenuated vibration. In the ink jet head 100H of the present embodiment, it is possible to detect discharging abnormalities in the same manner as the ink jet head 100 of the first embodiment described above using variation of the electrostatic capacity due to the passing of time.

Fourth Embodiment

Since the hardware configuration of the fourth embodiment is the same as the first embodiment, description of the configuration will be omitted. FIG. 50 is a table illustrating print modes which are prepared in embodiment 4. As shown in FIG. 50, each of the modes of "maximum quality", "high-speed high-quality", "normal" and "high-speed draft" are prepared as print modes in embodiment 4. As shown in FIG. 50, waveforms of (A) to (D) are selected in these modes. The waveform is the latch signal and the driving waveform which is generated by the driving waveform generating means 181.

Figure 51:
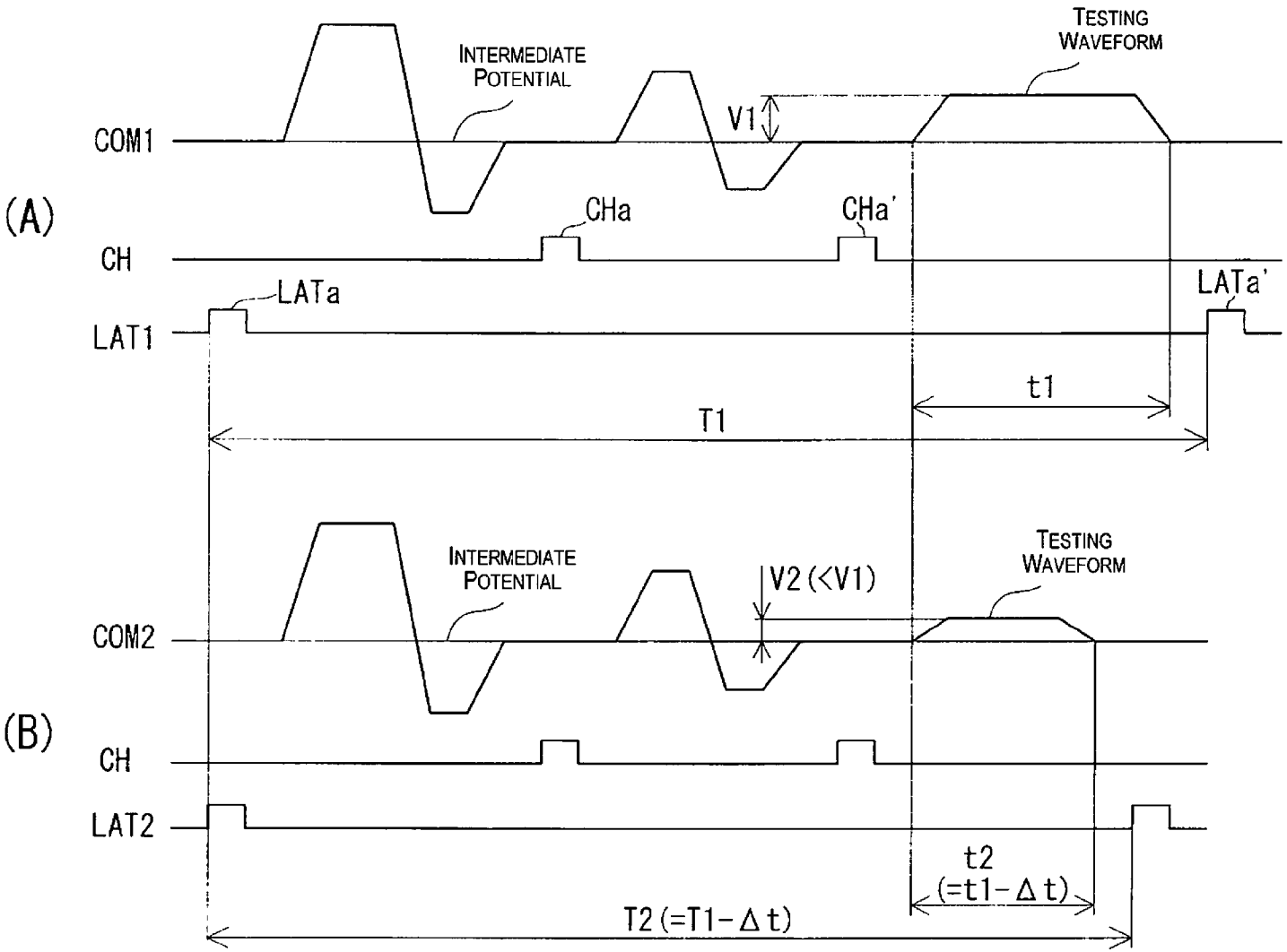
FIG. 51 shows waveforms (A) and (B) of a maximum quality mode and a high-speed high-quality mode.

FIG. 51 shows a waveform (A) which is selected in the maximum quality mode and a waveform (B) which is selected in the high-speed high-quality mode. In a case where the waveform (A) is selected, a signal COM 1 is selected as the driving waveform and a signal LAT 1 is selected as the latch signal. In a case where the waveform (B) is selected, a signal COM 2 is selected as the driving waveform and a signal LAT 2 is selected as the latch signal.

As shown in FIG. 50, in a case where the waveform (A) is selected, the discharge amount for each partition is (12+8+0) ng and the maximum discharge amount is 20 ng. The maximum discharge amount matches with the total value of the discharge amounts for each partition. The partitions in the discharge amounts for each partition refer to the partitions of the signal COM 1 which are able to be partitioned using a channel signal CH. The first partition is defined from a rising edge LATa of the signal LAT 1 shown in FIG. 50 to a rising edge CHa of the channel signal CH. The second partition is defined from CHa shown in FIG. 50 to another rising edge CHa' of the channel signal CH. The third partition is defined from CHa' shown in FIG. 50 to another rising edge LATa' of LAT 1.

The discharge amounts for each partition being 12+8+0 (ng) has the meaning that ink is not discharged in the third partition. In this partition, discharging abnormality detection is carried out as described in embodiment 1. Below, in the third partition of the signal COM 1, a portion where the potential is higher than an intermediate potential is referred to as a "testing waveform".

As shown in FIG. 51, the difference between COM 1 and COM 2 is the voltage value and the length of time of the testing waveform (referred to below as the "testing time"). The voltage value of the testing waveform of COM 1 is a voltage V1 and the voltage value of the testing waveform of COM 2 is a voltage V2 (<voltage V1). The testing time of COM 1 is t1 and the testing time of COM 2 is t2 (=t1−Δt). As shown in FIG. 51, Δt is equal to the difference which is obtained by subtracting the cycle of LAT 2 from the cycle of LAT 1 (the time from LATa to LATa'). The cycle of LAT 1 being longer than the cycle of LAT 2 is shown by the maximum frequency which is able to be set (10/s) in the case of the maximum quality mode being smaller than the maximum frequency which is able to be set in the case of the high-speed high-quality mode (14.8/s). The maximum frequency which is able to be set is the maximum value of the driving frequency of the nozzles. Since the maximum frequencies which are able to be set are different in this manner, the main scanning speed of the printing means 3 in the maximum quality mode is slower than the main scanning speed of the printing means 3 in the high-speed high-quality mode as shown in FIG. 50. The difference in the maximum frequencies which are able to be set and the main scanning speeds corresponds to the print speed of the maximum quality mode being slower than the print speed in the case of the high-speed high-quality mode.

As described above, compared to the high-speed high-quality mode, the maximum quality mode has the advantage that it is possible to reduce residual vibration since the voltage value of the testing waveform is low and the advantage that it is possible to obtain particularly detailed nozzle information since it is possible for the time when it is possible to detect residual vibration to be particularly long, while having a disadvantage in that it is not possible to perform high-speed driving since the driving frequency is reduced.

Figure 52:
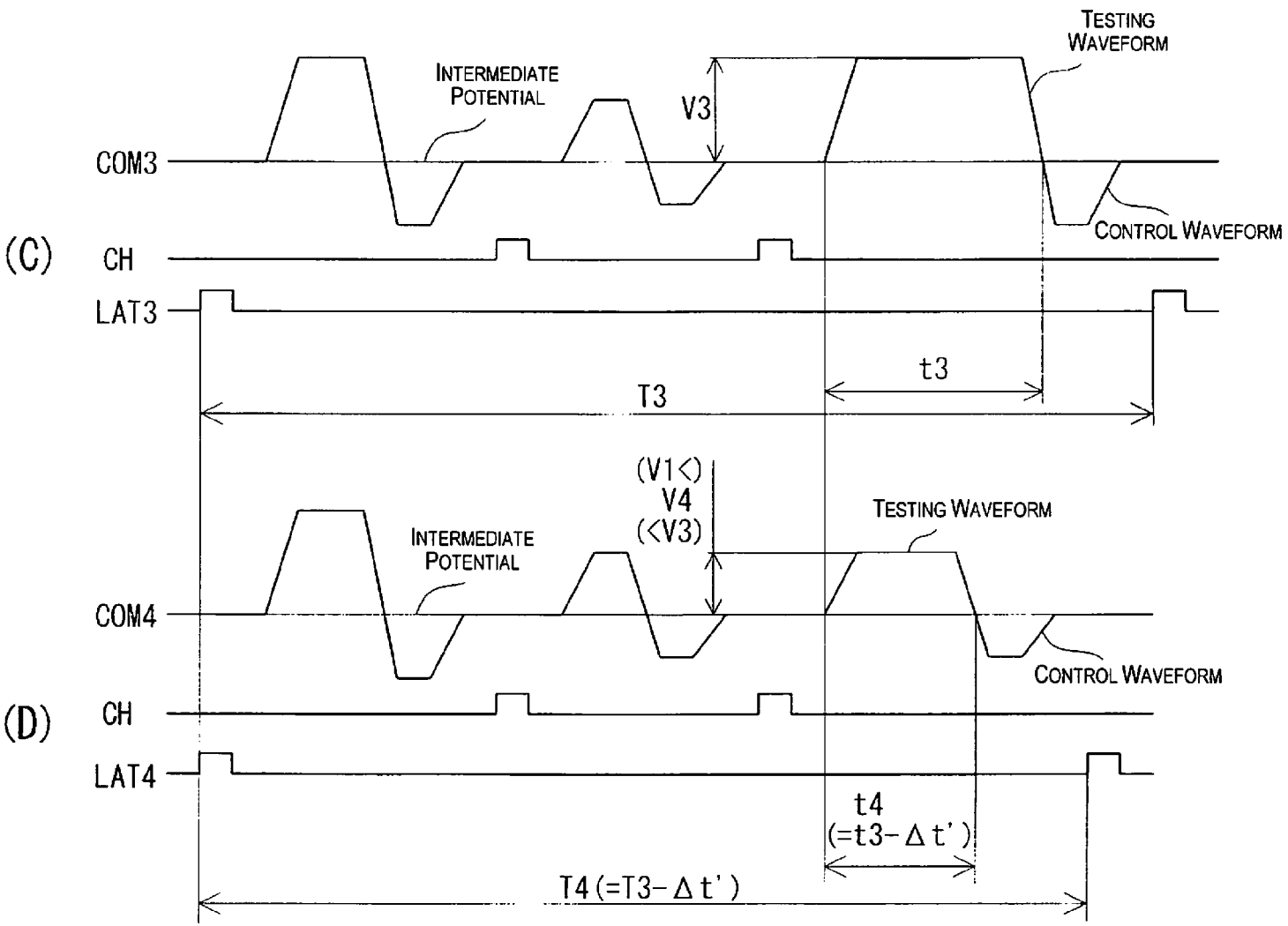
FIG. 52 shows waveforms (C) and (D) of a normal mode and a high-speed draft mode.

FIG. 52 shows a waveform (C) which is selected in the normal mode and a waveform (D) which is selected in the high-speed draft mode. In a case where the waveform (C) is selected, COM 3 is selected as the driving waveform and a signal LAT 3 is selected as the latch signal. In a case where the waveform (D) is selected, COM 4 is selected as the driving waveform and a signal LAT 4 is selected as the latch signal.

As shown in FIG. 50, in a case where the waveform (C) is selected, the discharge amount for each partition is (12+8+12) ng, and the maximum discharge amount is 32 ng. The discharge amount in the third partition being 12 ng has the meaning that abnormality detection and ink discharging are executed according to the testing waveform.

As shown in FIG. 50, in a case where the waveform (D) is selected, the discharge amount for each partition is 12+8+8 (ng), and the maximum discharge amount is 28 ng. The ink discharge amount in the testing waveform being smaller than in the case of the waveform (C) is because the voltage value of the testing waveform as shown in FIG. 52 is smaller in the case of waveform (D) (voltage V4) than in the case of waveform (C) (voltage V3).

As described above, compared to the normal mode, the high-speed draft mode has the advantage that the effects of residual vibration after testing are small since the voltage of the testing waveform is low, while having a disadvantage in that there is a danger that erroneous detections will be generated without the detection signal which is obtained from residual vibration after driving of the piezo element 200 being correctly output since there are cases where the driving amount of the piezoelectric element 200 during abnormality detection is not sufficient.

As shown in FIG. 52, COM 3 and COM 4 are different to each other in the testing time in addition to the voltage values described above. The testing time of COM 3 is t3 and the testing time of COM 4 is t4 (=t3−Δt'). As shown in FIG. 52, Δt' is equal to the difference which is obtained by subtracting the cycle of LAT 4 from the cycle of LAT 3. The cycle of LAT 3 being longer than the cycle of LAT 4 is shown by the maximum frequency which is able to be set (1/s) in FIG. 50 having a value (9.8/s) in the case of the normal mode which is smaller than the value (10.2/s) in the case of the high-speed draft mode. Since the maximum frequencies which are able to be set are different in this manner, the main scanning speed of the printing means 3 in the normal mode is slower than the main scanning speed of the printing means 3 in the high-speed draft mode as shown in FIG. 50. The difference in the maximum frequencies which are able to be set and the main scanning speed correspond to the print speed of the normal mode being slower than the print speed in the case of the high-speed draft mode.

As described above, since the testing times are different, the normal mode has an advantage compared to the high-speed draft mode in that it is possible to obtain detailed nozzle information since it is possible to set the testing time to be long.

Here, the values of the voltages V3 and V4 are larger than the voltages V1 and V2 in order to realize ink discharging. As a result, the signals COM 3 and COM 4 have vibration damping waveforms after the testing waveforms. The vibration damping waveforms are for suppressing the vibration of the meniscus which is generated by the testing waveforms.

When the maximum quality mode and the high-speed high-quality mode which are typically provided as print modes and the normal mode and the high-speed draft mode are compared, there are the following differences. Compared to the normal mode and the high-speed draft mode, the maximum quality mode and the high-speed high-quality mode have an advantage in that it is possible to detect abnormalities without discharging ink and an advantage in that it is possible to obtain detailed nozzle information as it is possible to set the testing time to be long since a vibration damping waveform is not necessary, while having a disadvantage in that there is a danger that erroneous detections will be generated without the detection signal which is obtained from residual vibration after driving of the piezo element 200 being correctly output since the driving amount of the piezo element 200 during abnormality detection is small.

On the other hand, compared to the maximum quality mode and the high-speed high-quality mode, the normal mode and the high-speed draft mode have an advantage in that printing and abnormality detecting are possible at high speed and an advantage in that it is possible to detect residual vibration while printing, while having a disadvantage in that abnormality detection is possible when the ink is not discharged and a disadvantage in that, as ink discharging is performed at the same time as abnormality detecting, the discharge stability of the ink at this time is poor.

As shown in FIG. 50, the resolution in the maximum quality mode is lower than the resolution in the high-speed high-quality mode, and the resolution in the normal mode is lower than the resolution in the high-speed draft mode. Since the liquid droplets of the ink are larger when the resolution is lower, there is an advantage in that it is difficult for residual vibration to have an effect.

The length of the testing time corresponds to the length of the duration. The duration is the time during which the maximum voltage of the testing waveform is continued. That is, in the testing waveform, the duration is a period of time where the voltage value does not change. Here, the testing waveform may adopt a voltage value which is lower than the intermediate potential according to the characteristics of the piezo element 200 or the testing method.

Above, the liquid droplet discharging apparatus and the ink jet printer of the present invention are described based on each of the embodiments which are shown in the diagrams, but the present invention is not limited to these and it is possible to replace each of the sections which configure the liquid droplet discharging head or the liquid droplet discharging apparatus with sections with an arbitrary configuration which is able to exhibit the same functions. In addition, other arbitrary constituent parts may be added to the liquid droplet discharging head or the liquid droplet discharging apparatus of the present invention.

Here, the liquid which is the target to be discharged (the liquid droplets) which is discharged from the liquid droplet discharging head (in the embodiments described above, the ink jet head 100) of the liquid droplet discharging apparatus of the present invention is not particularly limited, and, for example, it is possible to use liquids (including dispersions such as a suspension or an emulsion) which include various types of materials such as the following. That is, the materials include filter material (ink) for a color filter, light emitting material for forming an EL light emitting layer in an organic EL (Electro Luminescence) apparatus, fluorescent material for forming a fluorescent body on an electrode in an electron-emitting apparatus, fluorescent material for forming a fluorescent body in a PDP (Plasma Display Panel) apparatus, electrophoretic material for forming an electrophoretic body in an electrophoretic display apparatus, bank material for forming a bank on the surface of a substrate W, various types of coating materials, liquid electrode material for forming an electrode, particulate material which configures a spacer for configuring a minute cell gap between two substrates, liquid metal material for forming metal wiring, lens material for forming a micro lens, resist material, light diffusing material for forming a light diffusing body, various types of test liquid materials to be used in biosensors such as DNA chips and protein chips, and the like.

In addition, in the present invention, the liquid droplet receiving object which is the target of the discharging of the liquid droplets is not limited to paper such as a recording sheet, and may be other mediums such as a film, woven fabrics, or non-woven fabric, or a work piece such as various types of substrates such as a glass substrate, or a silicon substrate.

In addition, in the liquid droplet discharging apparatus of the present invention, the means and the method where discharging abnormalities and causes of the discharging abnormalities are detected are not limited to a method where analysis is carried out by detecting the vibration pattern of residual vibration of the diaphragm as described above and it is possible to select an appropriate recovery process as long as the cause of the discharging abnormalities is specified irrespective of which detection method is used. As the discharging abnormalities (missing dots) detecting method, it is possible to consider, for example, a method where the vibration state of a meniscus is detected using a light receiving element by an optical sensor such as a laser being irradiated and reflected directly on an ink meniscus inside the nozzles and the cause of the nozzle clogging is specified from the vibration state; a method where, from detection results of a typical optical missing dot detection apparatus (which detects whether or not flying liquid droplets entered the detection range of a sensor) and from the measurement results over the passing of time after the discharging operation, a phenomenon, which is generated within the drying time on the basis of data on the passing of time in the ink jet head in a case where the presence or absence of liquid droplets is detected and missing dots are generated, is estimated to be drying, and a phenomenon which is generated outside the drying time is estimated to be the paper dust or air bubbles; a method where a vibration sensor is added to the configuration described above, it is determined whether or not vibration is applied such that it is possible that air bubbles are mixed in prior to the generation of missing dots, and it is estimated that air bubbles are mixed in a case where this vibration is applied (in this case, the missing dot detecting means is not necessarily limited to being an optical type, and for example, a heat sensitive type which detects changes in the temperature of a heat sensing section upon ink discharging, a method where changes are detected in the charging amount of the detection electrodes where ink droplets are discharged and landed by being charged, or detecting of electrostatic capacity which changes according to the passing of ink droplets between electrodes, may be used), and a method as the detection method of paper dust attachment where the state of a head surface is detected as image information using a camera or the like or where an optical sensor such as a laser scans the vicinity of a head surface and the presence or absence of paper dust attachment is detected; and the like.

In addition, the pump suction recovery process which is one of the recovery processes which is executed by the recovery means 24 is a process which is effective with regard to a case where thickening due to drying or the like has proceeded and a case where air bubbles are mixed in, and in a case where ink jet heads 100 are detected inside the head unit with air bubbles mixed in or thickening due to drying where the pump suction process is necessary, the pump suction process may be executed at one time with regard to the ink jet heads 100 with air bubbles mixed in and the ink jet heads 100 with thickening due to drying without individually determining a process as in steps S905 to S907 in the flow chart in FIG. 40 since it is possible to carry out the same recovery process regardless of the cause. That is, after it is determined whether or not paper dust is attached to the vicinity of the nozzles 110, the pump suction process may be executed without determining whether air bubbles are mixed in or whether there is thickening due to drying.

General Interpretation Of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

The entire disclosure of Japanese Patent Application No. 2013-051377, filed Mar. 14, 2013 is expressly incorporated by reference herein.

What is claimed is:

1. A printing apparatus comprising:

a head unit including a plurality of nozzles configured and arranged to discharge a liquid, a plurality of pressure chambers linked with the nozzles, and a plurality of piezoelectric elements respectively provided in each of the pressure chambers, the head unit being configured and arranged to discharge the liquid from the nozzles by applying a driving signal to the piezoelectric elements; and a control section configured to determine whether or not there is a liquid discharge failure in the nozzles corresponding to the piezoelectric elements based on a detection signal obtained by applying a testing waveform included in the driving signal to the piezoelectric elements, the control section being further configured to detect residual vibration using a first testing waveform in a first print mode performed at a first print speed, and to detect residual vibration using a second testing waveform in a second print mode performed at a second print speed with the first print speed being slower than the second print speed, a period of time for testing with the first testing waveform being longer than a period of time for testing with the second testing waveform.

2. The printing apparatus according to claim 1, wherein a cycle of a timing signal defining a discharge timing in the first print mode is longer than a cycle of a timing signal defining a discharge timing in the second print mode.

3. The printing apparatus according to claim 1, wherein an absolute value of a difference between an intermediate potential and a maximum or minimum potential of the first testing waveform is larger than an absolute value of a difference between an intermediate potential and a maximum or minimum potential of the second testing waveform.

4. The printing apparatus according to claim 1, wherein a movement speed of the head unit in the first print mode is slower than the movement speed of the head unit in the second print mode.

5. The printing apparatus according to claim 1, wherein resolution in the first print mode is lower than resolution in the second print mode.

6. A testing method for testing a plurality of nozzles provided in a printing apparatus having a head unit including the nozzles configured and arranged to discharge a liquid, a plurality of pressure chambers linked with the nozzles, and a plurality of piezoelectric elements respectively provided in each of the pressure chambers, the liquid being discharged from the nozzles by applying a driving signal to the piezoelectric elements, the testing method comprising:

determining whether or not there is a liquid discharge failure in the nozzles corresponding to the piezoelectric elements based on a detection signal obtained by applying a testing waveform included in the driving signal to the piezoelectric elements;

detecting residual vibration using a first testing waveform in a first print mode performed at a first print speed; and detecting residual vibration using a second testing waveform in a second print mode performed at a second print speed, the first print speed being slower than the second print speed, and a period of time for testing with the first testing waveform being longer than a period of time for testing with the second testing waveform.

* * * * *